US007231729B2

(12) United States Patent
Heierling et al.

(10) Patent No.: US 7,231,729 B2
(45) Date of Patent: Jun. 19, 2007

(54) SKI BOOT PROVIDING LONGITUDINAL TORSION

(75) Inventors: Hans-Martin Heierling, Davos (CH); Sven Coomer, Boulder, CO (US)

(73) Assignee: Heierling I-Flex GmbH, Munich (DE)

( * ) Notice: Subject to any disclaimer, the term of this patent is extended or adjusted under 35 U.S.C. 154(b) by 126 days.

(21) Appl. No.: 10/478,716

(22) PCT Filed: May 23, 2001

(86) PCT No.: PCT/US01/16768

§ 371 (c)(1),
(2), (4) Date: Jun. 7, 2004

(87) PCT Pub. No.: WO02/094047

PCT Pub. Date: Nov. 28, 2002

(65) Prior Publication Data

US 2004/0211091 A1 Oct. 28, 2004

(51) Int. Cl.
*A43B 5/04* (2006.01)

(52) U.S. Cl. ..... 36/118.2; 36/117.3; 36/119.1

(58) Field of Classification Search ..... 36/117.3, 36/117.4, 118.2, 119.1
See application file for complete search history.

(56) References Cited

U.S. PATENT DOCUMENTS 4,677,769 A * 7/1987 Ahmad et al. ..... 36/117.2
4,793,076 A * 12/1988 Hilgarth ..... 36/118.9
4,839,972 A * 6/1989 Pack et al. ..... 36/117.2
4,920,665 A * 5/1990 Pack et al. ..... 36/117.2
5,572,806 A * 11/1996 Osawa ..... 36/117.4
5,746,016 A * 5/1998 Freisinger et al. ..... 36/117.1
6,247,252 B1 * 6/2001 Parisotto ..... 36/118.7
6,327,796 B1 * 12/2001 Parisotto ..... 36/118.2
6,665,960 B2 * 12/2003 Parisotto ..... 36/117.2
6,708,425 B2 * 3/2004 Parisotto ..... 36/118.2

FOREIGN PATENT DOCUMENTS

| | | |
|---|---|---|
| DE | 198 53 077 | 6/1999 |
| WO | WO 91/16957 | 11/1991 |
| WO | WO 95/26654 | 10/1995 |
| WO | WO 99/10054 | 3/1999 |
| WO | WO 01/35780 | 5/2001 |

* cited by examiner

*Primary Examiner*—Ted Kavanaugh
(74) *Attorney, Agent, or Firm*—Nixon & Vanderhye P.C.

(57) ABSTRACT

A ski boot comprises an essentially stiff outer boot and a soft inner boot or inner lining for receiving the foot of a skier. The sole of the outer boot is made of an essentially rigid material, preferably plastics, comprising an elastic zone in the metatarsal region of the sole. The elastic zone divides the sole into front and rear sole portions. An intermediate upper shell portion is provided between the front and rear shell portions of the outer boot, which is designed such that front and rear shell portions are pivotable with respect to each other. The heel portion and rear sole portion are designed to be in an essentially rigid relationship such that a maximum force can be applied to the elastic zone of the boot. When the skier leans forward the front and rear shell portions pivot relative to each other. Due to the attachment of the lower leg to the rigid spoiler shaft, the ankle of the skier is braced securely to not flex or bend and the center of gravity of the skier can therefore remain in its most favored and athletically efficient position.

48 Claims, 50 Drawing Sheets

Fig. 17a
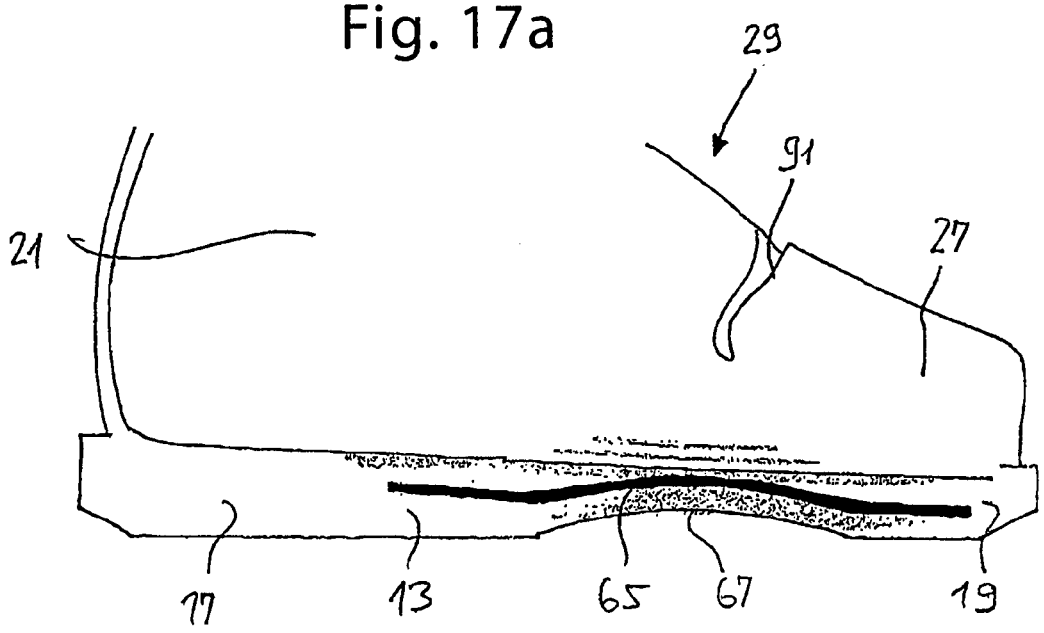
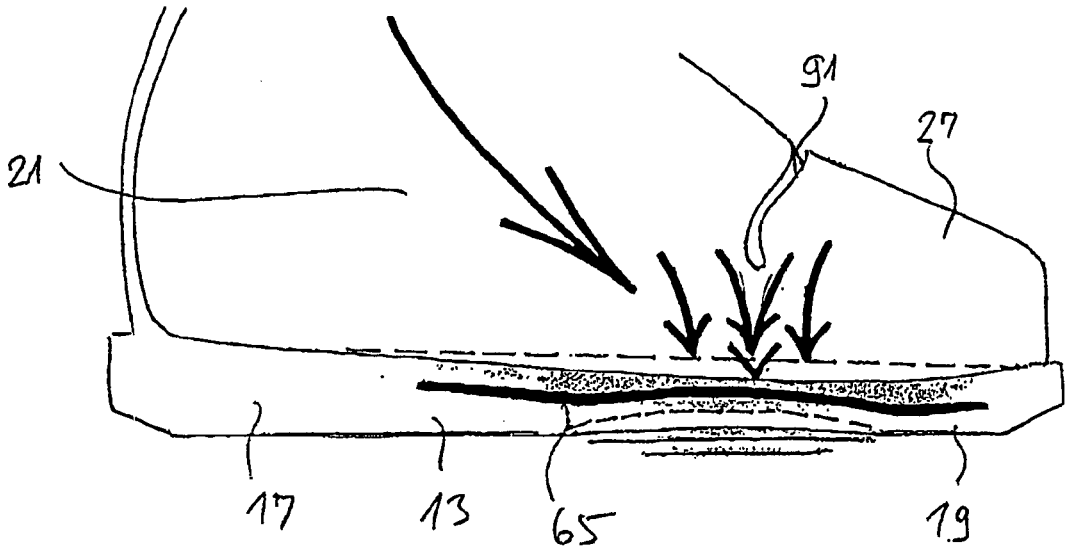
Fig. 17b

SKI BOOT PROVIDING LONGITUDINAL TORSION

This application is the U.S. national phase of international application PCT/US01/16768, filed May 23, 2001, which designate the U.S., the entire contents of which is hereby incorporated by reference

FIELD OF THE INVENTION

The present invention relates to a ski boot that allows bending about a transverse axis, and torsion of the rear boot portion with respect to the front boot portion about the longitudinal boot axis.

PRIOR ART

German patent DE-OS-3343077 discloses a sole for a sports shoe, e.g. ski boot, which becomes stiff upon exertion of an external force. The upper shell of the ski boot should be construed such that a force exerted by the lower leg can be directed via the shaft, ankle and heel portions into the ski. However, as to the technical features of the upper shell the mentioned DE-OS-3343077 is silent.

U.S. Pat. No. 5,746,016 discloses a ski boot with pivotable toe cap and shaft. The toe is designed to be movable during walking, but fixed during skiing. For this reason the upper shell comprises a transversal opening with a cover. A tongue integral with the cover extends below the shell. The tongue can be blocked by means of a lock biased with a spring. In the blocked position, which is selected for skiing, pivoting of the toe cap is not possible. For skiing the shaft as well as the toe cap are stiff.

WO-A-91/16957 relates to an improved set comprising a ski, a ski boot, ski binding and a fulcrum element. WO-A-91/16957 proposes to use a ski boot wherein the toe cap is pivotable with respect to the rest of the boot. In particular, the toe cap is connected to the rear part of the boot by means of a hinge. The fulcrum element is located along a central section of the ski between the front and the rear bindings. When the ski boot flexes or pivots, force is directly applied via the fulcrum element to a central section of the ski to cause the central section to bow under such force.

In recent times, telemark skiing has experienced a renaissance. As to the equipment, telemark skiing differs from downhill skiing in the ski bindings and boots used. In contrast to a downhill ski binding the telemark ski binding has no fixed heel binding, but allows lifting the heel portion so that the rear sole portion (17) is almost at 90° to the ski and the knee of the skier can touch the ski in front of the binding. Consequently, the telemark ski boot must have a very flexible and soft sole which has essentially no tendency to rebound. In addition, the ankle in the telemark boot is not fixed but moves forward and backward when the heel portion is lifted. A telemark boot is therefore very difficult to use when the heel is fixed to the ski.

OBJECT OF THE INVENTION

It is therefore an object of the present invention to provide a novel ski boot which reduces stress to the skier's anatomy and allows a better control of the ski. Another object is to provide a ski boot which allows the skier to maintain a more natural position when skiing. A further object is to provide a ski boot which allows the skier to direct more force into the ski than with conventional boots. Yet a further object is for the ski boot sole to more closely mimic the bending and dynamic response characteristics of the ski directly under the ski boot sole. Yet another object is for the ski boot sole to absorb strain forces effectively and enable the skier to more functionally use the proprioceptive nerve endings in the soles of the feet to improve sensitivity for better balance and control. According to the invention a ski boot according to the descriptive or designating part of claim 1 is characterized in that

- the sole of the outer boot is made of an essentially rigid material, preferably plastics, comprising an elastic zone in the metatarsal region of the sole dividing the sole into front and rear sole portions;
- an intermediate upper shell portion is provided between the front and rear shell portions of the outer boot, which is designed such that front and rear shell portions are bendable with respect to each other;
- the heel portion, shaft, and rear sole portion (17) are designed to be in an essentially rigid relationship;
- the attaching or fixing means comprising at least an ankle fixing and attaching means (39) for extending around the ankle region and fixing the ankle and heel into in the rear heel portion, and
- a lower leg fixing and attaching means for extending around the shinbone-and inner boot shaft and effectively coupling the lower leg to the rear shell shaft, in particular spoiler of the rear shell shaft with little or no play.

By the novel design of the ski boot a force triangle is created that directs all the forces exercised by the skier directly to the elastic bending portion of the sole under the metatarsal area of the foot. The elastic bending portion of the sole is activated in turn by the vibrations and bending activity of the ski. The elasticity of the sole can be designed to respond according to a specific dynamic response that complements the ski's bending and torsional dynamic response qualities. Another advantage of the novel ski boot is that due to the attachment of the lower leg to the rigid spoiler shaft, the ankle of the skier is braced securely to not flex or bend and the center of gravity of the skier can therefore remain in its most favored and athletically efficient position.

Advantageously, the shaft, heel and rear sole portions of the outer boot are made of essentially non-flexible or unyielding plastics such that the heel portion, shaft and rear sole portion form a rigid or essentially non-flexible assembly. This allows the user to apply more force and more directly into the ski than with conventional boots with pliable or yielding shafts. The shaft and spoiler supports the ankle and the lower leg in its strongest position with the stiffest possible support, while the sole bends and rebounds under the forefoot. When the ankle does not have to flex then the knees do not have to flex more than minimally either and therefore also remain in the strongest and most stable position, which can be demonstrated in x-ray motion video. In essence the invention moves the important flex elements from the ankle to the ball of the foot area and the metatarsal heads.

Advantageously, the elasticity of the elastic zone is such that the bent sole has a tendency to flex back and rebound into the neutral plane position. By flexing and rebounding in harmony with the ski the user is able to feel proprioceptively and to coordinate effectively with the ski's most favorable behaviors. Preferably, the elastic zone allows bending about a transverse axis in the metatarsals. This enables the foot to bend naturally while skiing as it does in walking and hiking boots. According to a preferred embodiment of the ski boot the elastic zone is designed such that in addition to bending about a transverse axis a precisely managed torsion of the rear sole portion with respect to the front sole portion about the longitudinal boot axis is possible. Substantial resistance to sole and shaft torsion is favored to the inside for the precise transferring of steering and edging forces from the lower leg shaft over the medial edges, while allowing liberal torsion over the outside edges to permit natural and dynamic alignment of the lower leg anatomy and control of balance at all times.

Advantageously, either the intermediate shell portion or the sole comprises a guide or deflection means for causing a torsion of the front and rear boot portions about the longitudinal boot axis when they are bent with respect to each other. By this means the forces exerted by the skier can be directed most effectively e.g. to the medial side of the ski in order to support edging when most needed in difficult snow and terrain. The guide means can be one or more transverse beams formed in the sole and/or one or more transverse cuts in the intermediate shell portion. The beams may extend at an angle to the longitudinal boot axis.

Preferably, the guide means are arranged such that the rear boot portion is deflected laterally relative to the front boot portion. This allows for a natural and dynamic alignment and adaption of the lower leg for maintaining balance and control. There may be flex cut adjustment or blocking means provided for insertion into the transverse cuts to limit or adjust the maximum relative flexing or reduction of the opening between the front and rear boot portions. This allows the ski boot to adapt naturally to the individual skills of the skier. The adjustment or blocking means can be plugs, bolts, retaining plates or the like. In order to prevent opening of the flex cuts in the intermediate shell portion, a connecting means can be provided for interconnecting shell portions located in front and behind the cuts or openings.

Advantageously, the intermediate shell portion extends from the front shell portion forming the toe cap to the shaft and preferably comprises an opening at least in the metatarsal area. An opening in the metatarsal area is a simple means for creating a boot whose front and rear shell portions are bendable relative to each other. Preferably, the opening in the outer boot shell extends from the instep towards the sole. The opening in the metatarsal area may be V-shaped, round or oval or can be designed as longitudinal cuts or slots. It is to be understood that the opening may extend even as far as to the shaft without compromising the advantages of the novel boot.

If cuts are provided in the shell, then they can extend from the instep in a curve forwards and downwards (curved cuts). Instead of providing an opening or cuts, the intermediate shell portion may be made of a flexible material which is foldable or compressible to allow as much as about 15 mm reduction over the metatarsals to allow the bending between the front and rear parts of the ski boot sole.

According to a preferred embodiment the elastic zone comprises an elastic, preferably removable insert. Alternatively, the sole may comprise in the longitudinal direction areas of different elasticity so that the desired bendability of the sole is achieved. Another embodiment provides that the elastic zone comprises a structurally engineered elastic inner shell reinforcement frame insert permanently embedded in the outer boot. The elastic frame insert may comprise an easily bendable corrugated section in the metatarsal area. Said corrugated section may be sandwiched between a flat upper layer and a flat lower layer which bond the corrugations to create the desired dynamic response and elasticity in bending and torsion. It is desirable that the range of bending motion downward is limited to a maximum 3 mm from the neutral plane of the sole and that at the same time the tendency for any bending motion upward is blocked. An adjustment system can be provided so that the bending motion of the sole can be regulated to about 3 mm according to the skier's weight and ability level.

Advantageously, the outer boot comprises an inner shell frame that allows downward bending in the metatarsals while blocking tendencies to bend upwards. If a inner shell frame is provided, then the outer boot shell plastics can be thinner and flexible as the desired technical features are incorporated into the inner shell frame. The inner shell frame may be spoon shaped in the metatarsal area so that downward flexing is possible but upward flexing blocked. According to another embodiment the inner shell frame comprises corrugations in the metatarsal area that allows downward flexing but block tendencies of the boot sole to flex upwards. According to a still another embodiment the sole comprises a rigid leaf type spring imbedded in the sole plastic to allow a designated range of bending and dynamic response downward. The advantage of a leaf type spring is that its dynamic properties can be easily designed and controlled. It can be incorporated in the sole at a favorable price.

Preferably, the insert is designed as a flex and torsion box, or two opposing leaf springs, positioned under the imbedded reinforcing frame that is open at both sides of the sole to allow a designated amount of downward bending elasticity and blocked from upward bending, with the respective dynamic rebound response of both the top and bottom surfaces. Advantageously, the flex and torsion box connects the top and bottom surfaces of the sole with a vertical reinforcing I-beam membrane positioned in the sagital plane so that bending pressures on the top surface are transferred directly to bend the bottom surface to create a more effective bending and torsion box zone. This vertical I-beam or other effective material and shape can be snap fitted into position when desired and avoids deformation of the torsion box when flexing, retaining the optimum strength and dynamic properties of the torsion box. Other torsion box adjustment inserts, such as blocks made of assorted material properties, can also be used.

Another embodiment of the sole provides that the reinforcement of the torsion box insert may be designed such that the superior surface closest to the metatarsal bones is thinner and flexible, while the distal surface is made completely rigid to resist all bending forces. In this embodiment just the front and rear shell portions pivot relative to each other but not entire sole itself. The properties of the insert may be premolded with assorted dynamic response qualities. Although the insert is preferably integrated into the sole of the shell it can also be molded into detachable toe and heel walling sole plates, that are attached to the shell's sole, e.g. by screws or snap-fitted over respective retainers molded into the shell's sole.

According to a preferred embodiment the outer boot comprises an inner shell frame extending in or on the sole and also upward to form a part of the heel and ankle shaft. This design has the advantage that medial and lateral flexibility, and torsional rotations of the lower leg can be managed intentionally by design. Advantageously, the inner shell frame comprises on the medial side a shaft that extends a designated height above the medial and lateral ankle bones, and wraps around the heel area as an interconnected and stabilizing heel counter. Thereby the desired control of both medial and lateral shaft torsion, and the respective internal and external control of the lower leg shaft torsion when edging and steering the skis can be achieved. Preferably, the sole, rear and front shell portions are made from one piece.

Advantageously, the sole comprises a detachable lower sole. The lower sole can incorporate the desired flex and torsion characteristics so that the qualities of the ski boot sole can easily be altered according to the skier's weight and ability. Although the lower sole can be made in one piece, the detachable lower sole is preferably made in at least two separate portions, namely a toe and a heel portion. Said portions may be attached and secured to shell's sole by screws, bolts, snap-on connections and the like.

Like conventional boots the ski boot according to the invention can comprise an outer boot shell, preferably made of an unyielding plastics, and a soft inner boot or lining. Preferably, the inner boot is removable or retractable from the outer boot.

In order to provide a good hold of the ankle in the ski boot, ankle fixing and attaching means are provided which extend from the medial (inner) side of the outer boot to the lateral (outer) side and embrace and pull the ankle and heel of the skier back into the heel portion of the shell and inner boot. Preferably, flexible and essentially non-stretchable strap means are used as fixing and attaching means. The closures may be any of the known closure means known in the art. Advantageously, the ankle fixing and attaching means are arranged at an angle greater than 120 degrees, preferably at an angle between 130 and 145 degrees with respect to the sole for pulling the ankle of the skier's foot back into the heel portion.

According to a preferred embodiment of the invention the first or top lower leg fixing and attaching means are flexible but essentially non-stretchable strap means attached to the spoiler of the shaft. Said first strap means can be a part of the outer boot shell plastics or separate textile or plastic straps. It is of importance that the first strap allows to couple the inner boot and leg shaft effectively and with minimal or no play to the outer boot shaft or spoiler. The top lower leg strap may extend inside the outer boot shaft for embracing the inner boot and lower leg shaft directly with no outer boot shell plastics between strap and inner boot shaft. Preferably, the top leg fixing and attaching means are attached or fixed to the shell shaft spoiler a short distance from the top of the shaft end for coupling the upper inner boot and lower leg shaft end with a minimal or no play between the shaft and spoiler, respectively. This ensures that a maximum momentum can be applied to the elastic zone through the rigid shaft and spoiler portion. There may be provided second and third lower leg fastening and attaching means in the shaft portion which can be part of the outer boot shell plastics. Advantageously, foot fastening means are provided in the metatarsal region of the outer boot. Advantageously, foot fastening means are provided in the metatarsal region of the outer boot for user friendly adjustability.

It is of importance that the instep portion of the outer boot above the ankle fixing and attaching means is compressible or yielding so that the ankle can effectively be embraced by the ankle strap means. Flexible and elastic strap means have the advantage of adapting more readily to variables in foot volumes, shapes and adaptive activity, while also allowing for natural motions without losing support or control.

Object of the present invention is also a ski boot characterized in that the sole of the outer boot is made of an essentially rigid material, preferably plastics, comprising an elastic zone in the metatarsal region of the sole dividing the sole into front and rear sole portions; and an intermediate upper shell portion is provided between the front and rear shell portions of the outer boot, which is designed such that front and rear shell portions are bendable or pivotable with respect to each other, and wherein the front sole portion and the shaft are interconnected by at least a cable extending from the boot shaft to the front sole portion. By this design the elastically bendable toe cap is coupled with the rigid shell spoiler shaft so that forward knee motions that activate the force triangle cause increased tension of the cable and immediately increase both the sole's resistance to bending and it's rebound rate, and proportionately to the amount of forward motion force applied by the skier. The same effect occurs when the bending and vibrational forces of the ski activate the sole and the cable tension respectively. Preferably, tensioning adjustment means are provided for the selected tensioning of the cable. Tensioning means can be a lever, knob or the like which cooperate with one end of the cable. Advantageously, the cable extends in grooves provided in the sole.

Yet another object of the present invention is a system comprising a ski boot, as described above, a ski, and a ski binding comprising front and rear binding parts for receiving and fastening the front and heel boot portions, i.e. toe cap and heel of the boot. Advantageously, an replaceable or adjustable elastic or spring-based suspension element is provided which is mounted under the boot sole between the front and rear binding parts. The elastic suspension element assists the front and rear binding sole supporting platforms in transferring and absorbing the bending and vibrational forces from the ski to the boot sole, as well as from the boot sole to the ski, and help to amplify the tactile messages between the sensitive proprioceptive nerve sensors in the soles of the feet so that the skier may respond proactively and quickly to the constantly changing relativity between the skier, the skis and the snow surfaces. An adjustment screw system enables the skier to tighten or loosen the elastic or spring based suspension element to control the dynamic response and rebound rate of the elastic sole. The elastic suspension element assists the front and rear binding sole supporting platforms spacers in absorbing and transferring the bending and vibrational forces from the ski to the boot sole, as well as from the boot sole to the ski. This helps to amplify the tactile messages between the ski and the sensitive proprioceptive nerve sensors in the soles of the feet, so that the skier may respond proactively and quickly to the constantly changing relativity between the skier, the skis and the snow surfaces.

According to another embodiment of the system a curved leaf-type spring suspension element is mounted on the ski ahead of or under the front binding parts and behind the rear binding parts, by passing through hollow binding elevators, such that the curved spring element can cooperate with the boot sole surface when attached in the bindings. This is advantageous as the force exerted by the skier on the leaf spring suspension element effectively transfers forces from the skier ahead of and behind the bindings, for added influence over the skis, as well as working with the dynamic response of the sole in attenuating the high frequency vibrations and resonances that are generated and cannot be absorbed by the skis, and especially shorter length skis.

The invention will now be explained in further detail with respect to the drawings, which depict different basic concepts of the inventive ski boot. In the figures like parts are designed with like numerals. The figures show:

FIG. 1: A side view of a first embodiment of the novel ski boot comprising only 3 buckles and an opening in the shell of the outer boot over the metatarsals and instep;

FIG. 2: The inner side of the ski boot of FIG. 1;

FIG. 3: A side view of a second embodiment of a ski boot comprising only 2 buckles and an opening in the shell of the outer boot extending from the toe cap to the shaft;

FIG. 4: The inner side of the ski boot of FIG. 3;

FIG. 5: a side view of a third embodiment of a ski boot showing a rather conventional looking 4 buckle boot with an opening in the shell around the metatarsal portion of the outer boot;

FIG. 6: A front top view of the front boot portion of the boot of FIG. 5;

FIG. 7: An over head view of the front portion of the boot of FIG. 5 with the flex slot openings in a neutral position;

FIG. 8: The boot in FIG. 7 with the flex slot opening in a reduced and flexed position;

FIG. 9: The boot in FIG. 7 naked and without buckles resting in the neutral position;

FIG. 10: Schematically, the force triangle in the boot of FIG. 5 with transversal flex cuts, set in bindings on a ski, delivering lower leg flexing motions through the force triangle directly to the elastic forefoot (metatarsal) area of the sole;

FIG. 11: Schematically, the force triangle in the boot of FIG. 3, set in bindings on a ski;

FIG. 12: Schematically, the force triangle in the boot of FIG. 1

FIG. 13: A perspective view of a fourth embodiment with an essentially open design of the outer boot.

FIG. 14: a side view of the boot of FIG. 13;

FIG. 15: An embodiment of an elastic sole;

FIG. 16: An embodiment of a boot sole comprising a leaf spring;

FIGS. 17*a* and 17*b*: A further embodiment of a sole comprising a leaf spring system in neutral and unloaded position (a) and (b) loaded position;

FIGS. 18*a* and 18*b* a sole system with a detachable sole portion in assembled (a) and disassembled position (b);

FIG. 19. Another embodiment of a ski boot comprising a rigid inner shell frame;

FIG. 20 the inner shell frame of FIG. 19;

FIG. 21 another embodiment of the inner shell frame having a plurality of corrugations in the forefoot region;

FIG. 22 a boot sole with longitudinally and partially transversally extending reinforcing beams;

FIG. 23 another embodiment of a sole with 3 reinforcing beams:

FIG. 24 a ski boot with an imbedded concave reinforcement frame and a sole with corrugations and siping cuts in the beams in two different positions;

FIG. 25 a ski boot sole with premolded slots and rods received in the slot for controling and adjusting the sole bending and dynamic response qualities;

FIG. 26 a side view of a ski boot sole with means (cable assembly) for adjusting the sole elasticity and response;

FIG. 27 a bottom view of the ski boot sole of FIG. 26;

FIG. 28 a partial side view of the ski boot of FIG. 26;

FIG. 29 a cable bridge which can be inserted into a transverse hole extending in the sole under the forefoot region (top view on the left side and side view on the right side);

FIG. 30 a perspective view of the cable bridge of FIG. 29

FIG. 31 schematically, the function of the cable bridge of FIG. 30

FIG. 32 another schematic illustration of the function of the cable tensioning system;

FIG. 33 a frontal view of the leg of a skier with a boot having asymmetrical flex cuts in the outer boot shell;

FIG. 34 the flex cuts of FIG. 33 more in detail;

FIG. 35 the medial aspect (inner side) of a ski boot with a transverse flex cut in the instep portion having flex cut adjustment or blocking means inserted therein;

FIG. 36: the lateral aspect (outer side) of a ski boot of FIG. 35

FIG. 37: an embodiment of the flex cut adjustment or blocking means in the form of a retaining plate;

FIG. 38 a partial perspective view of the flex cut and the inserted retaining plate in two different positions (a and b);

FIG. 39: a perspective view of the instep portion with means for limiting the extent of the opening of the flex cut;

FIG. 40 a transverse arrangement of the limitation means of FIG. 39;

FIG. 41 an embodiment of an outer boot shell in which the limitation means in form of a bridge are molded directly into the outer shell;

Figure 1:
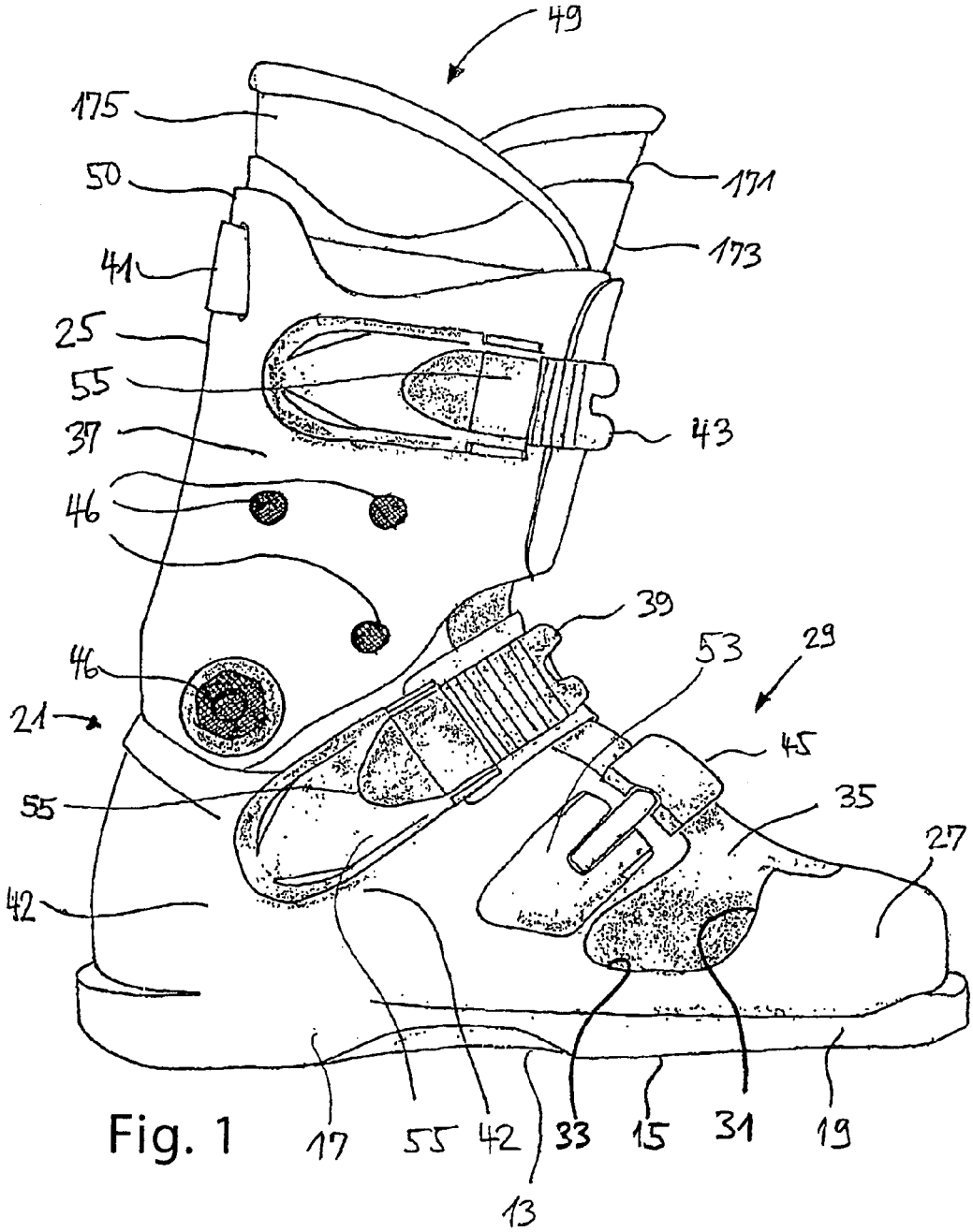
Figure 2:
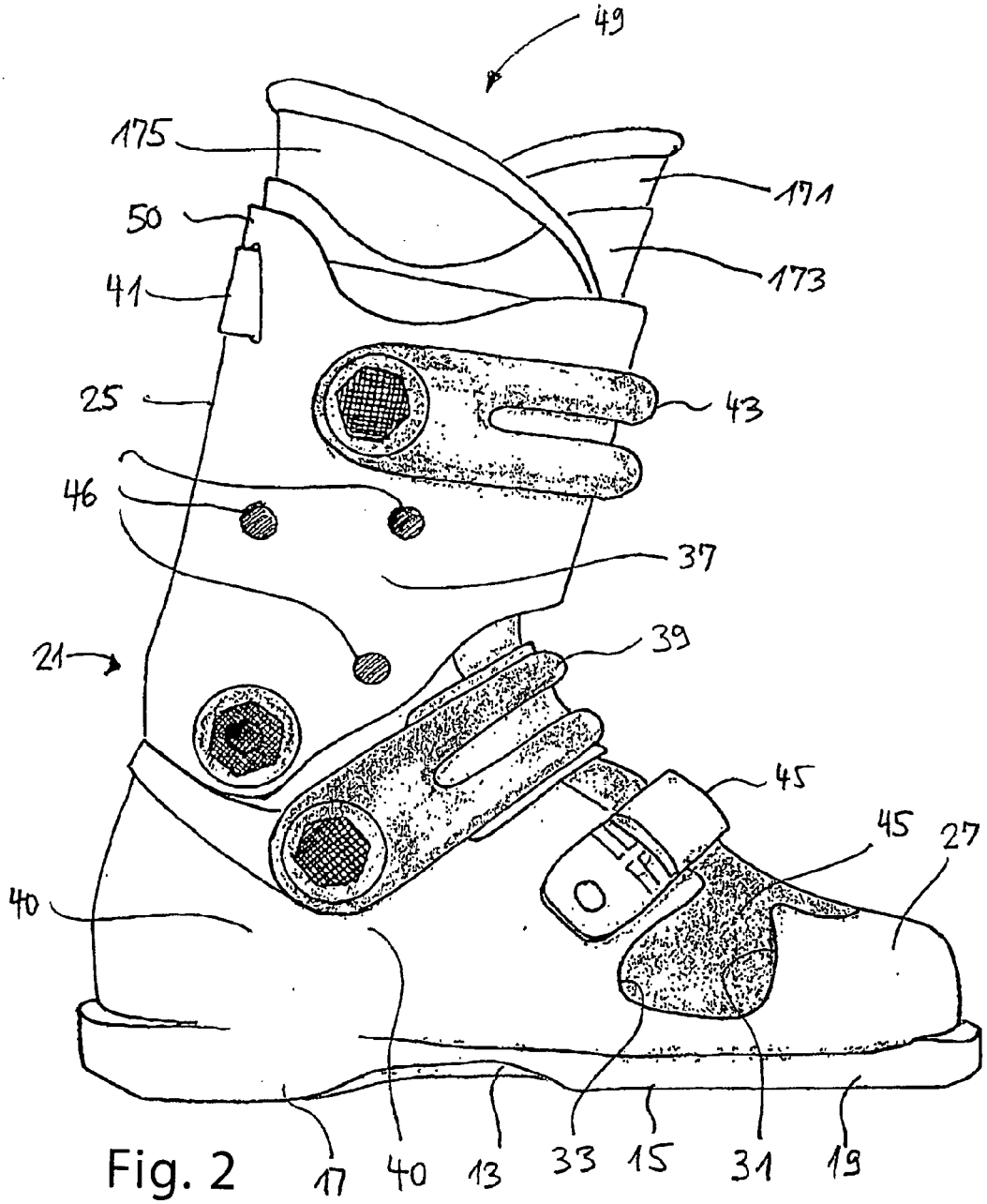
Figure 44:
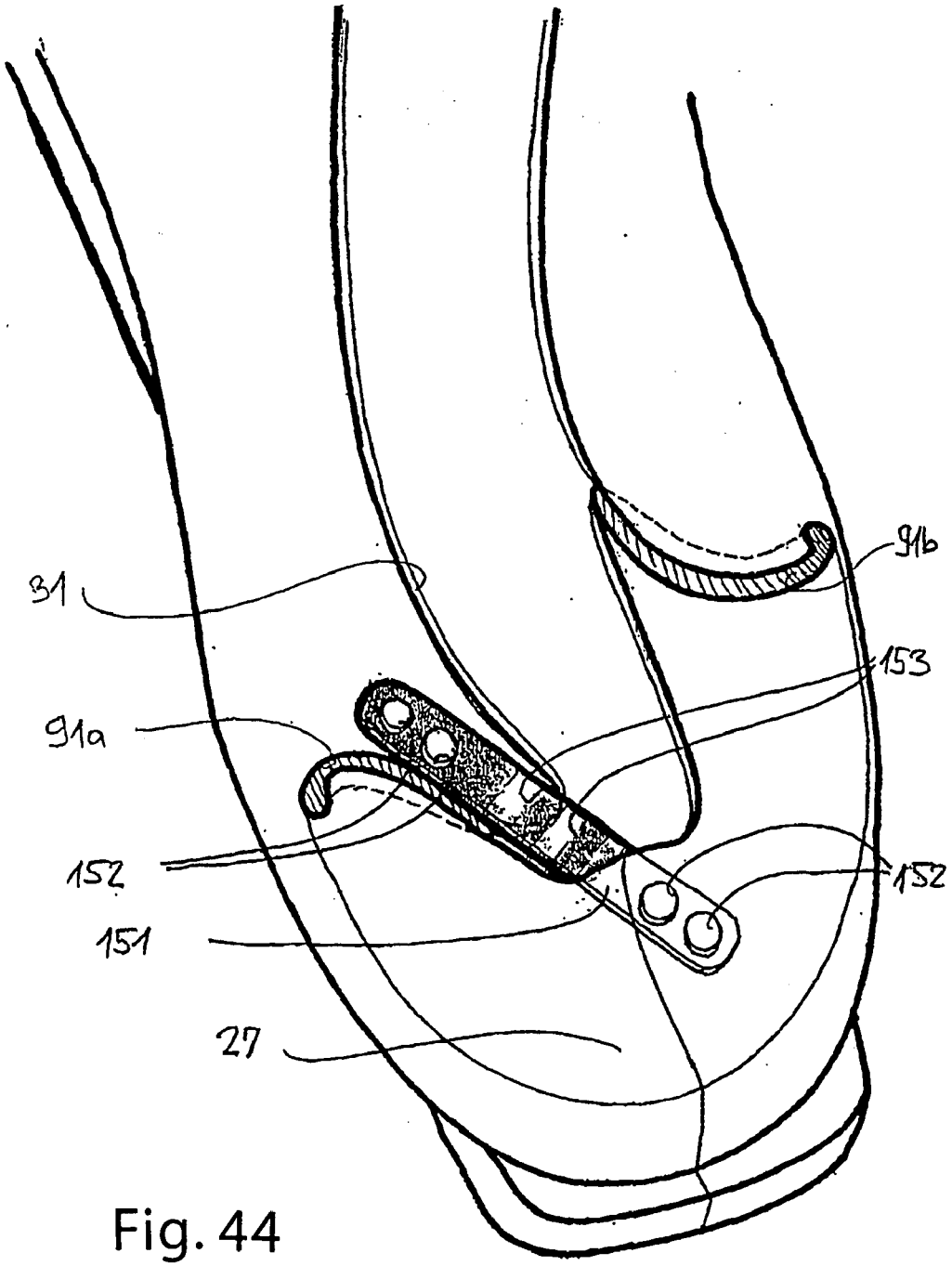
Figure 45:
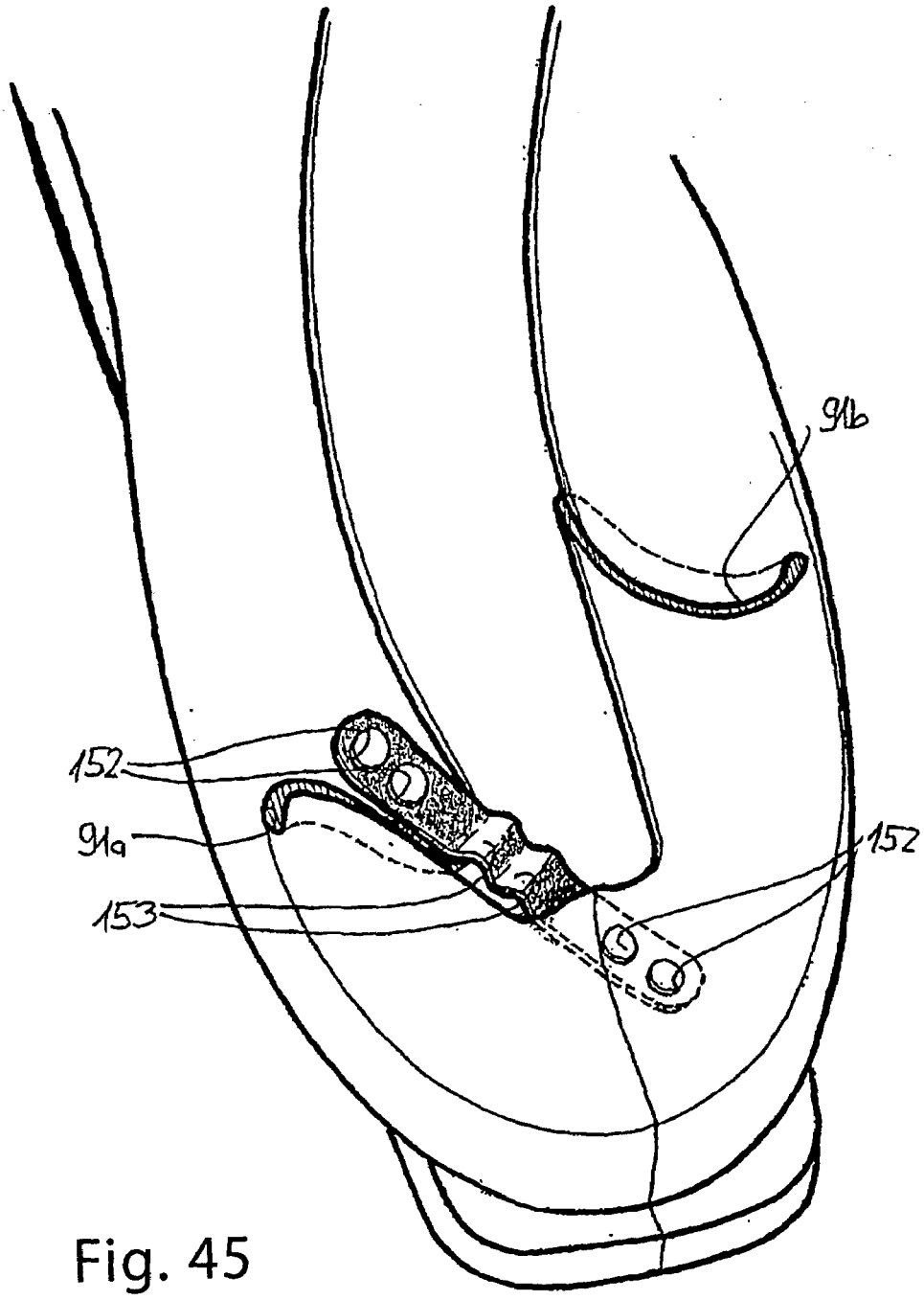
Figure 46:
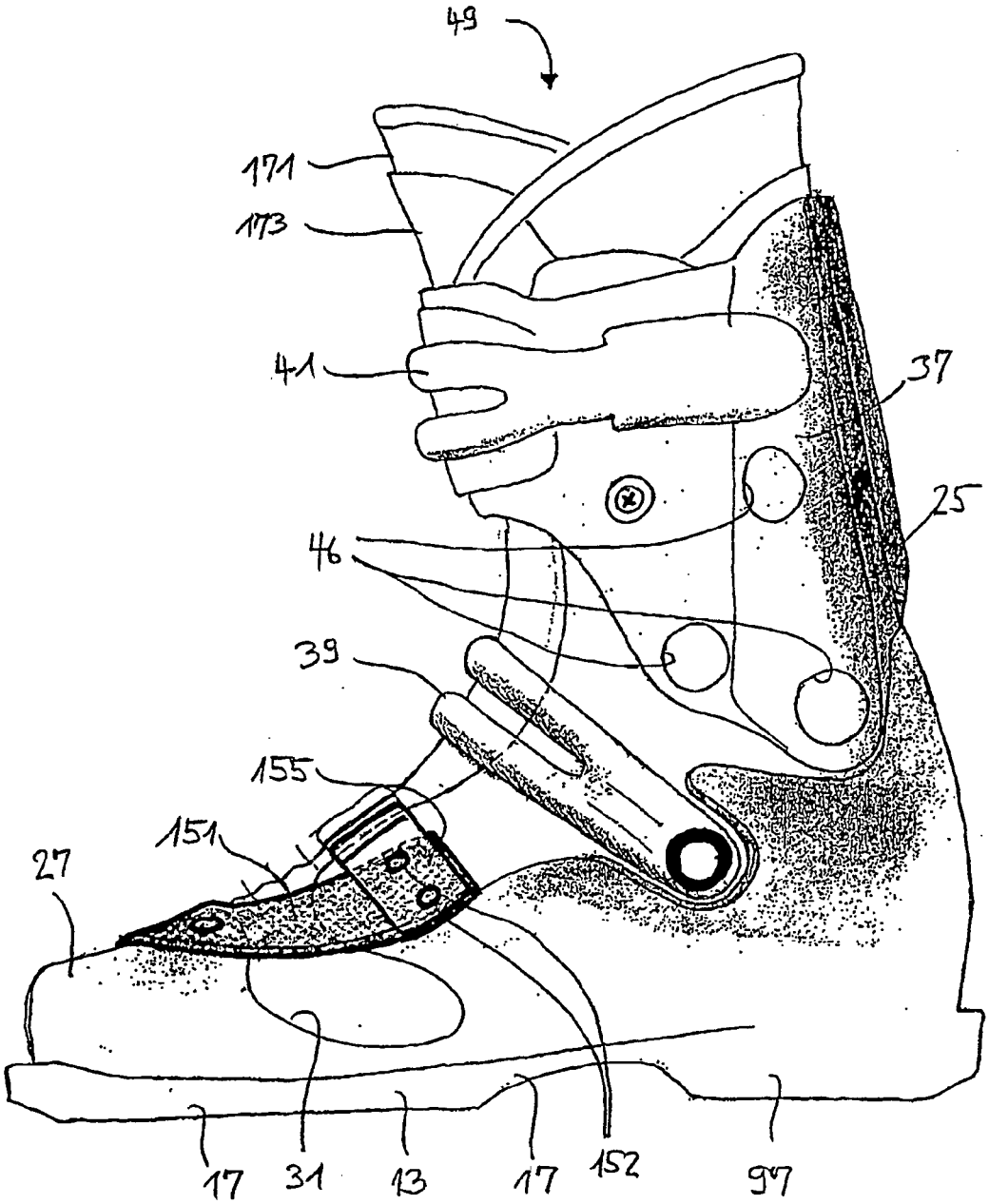
Figure 47:
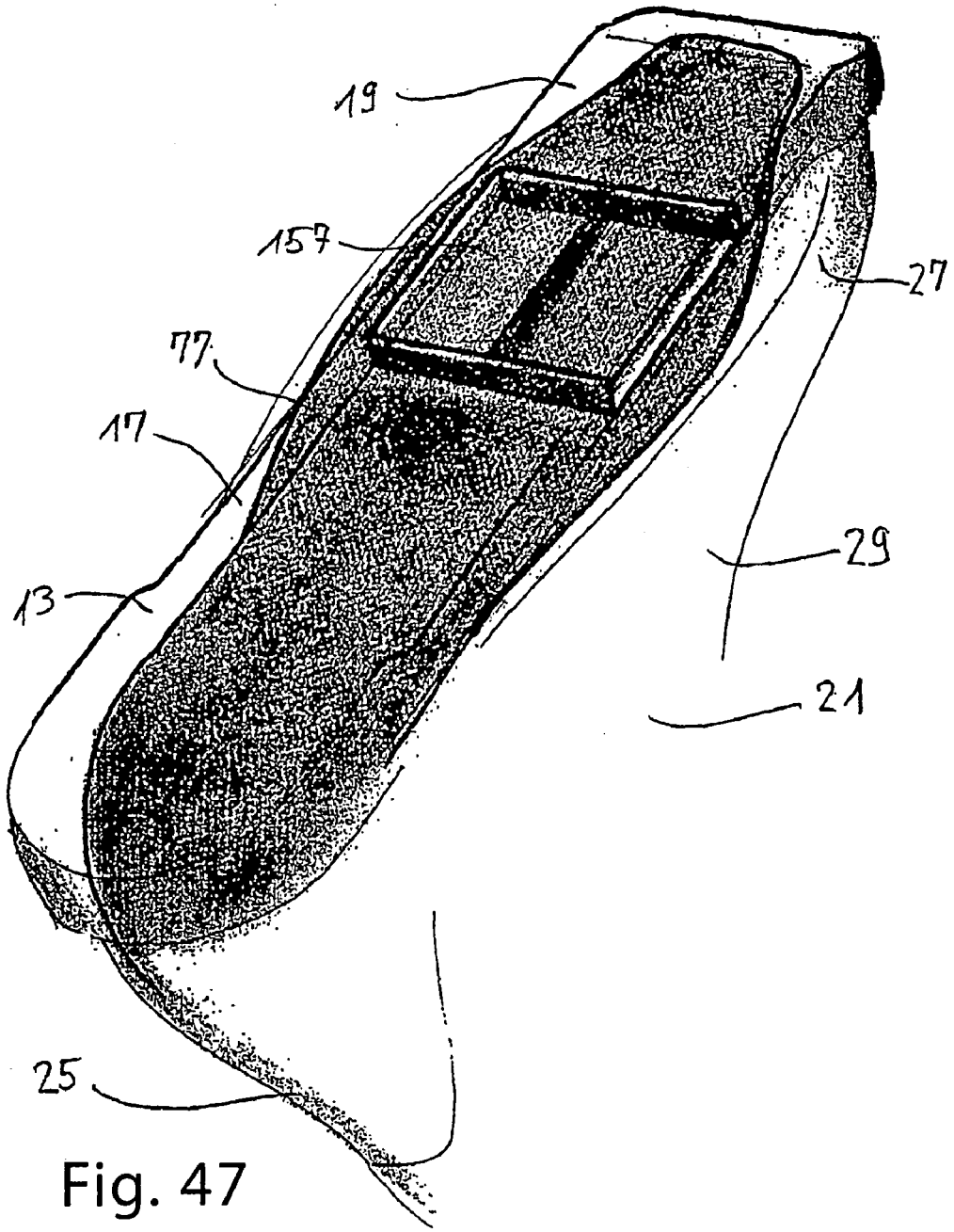
Figure 48:
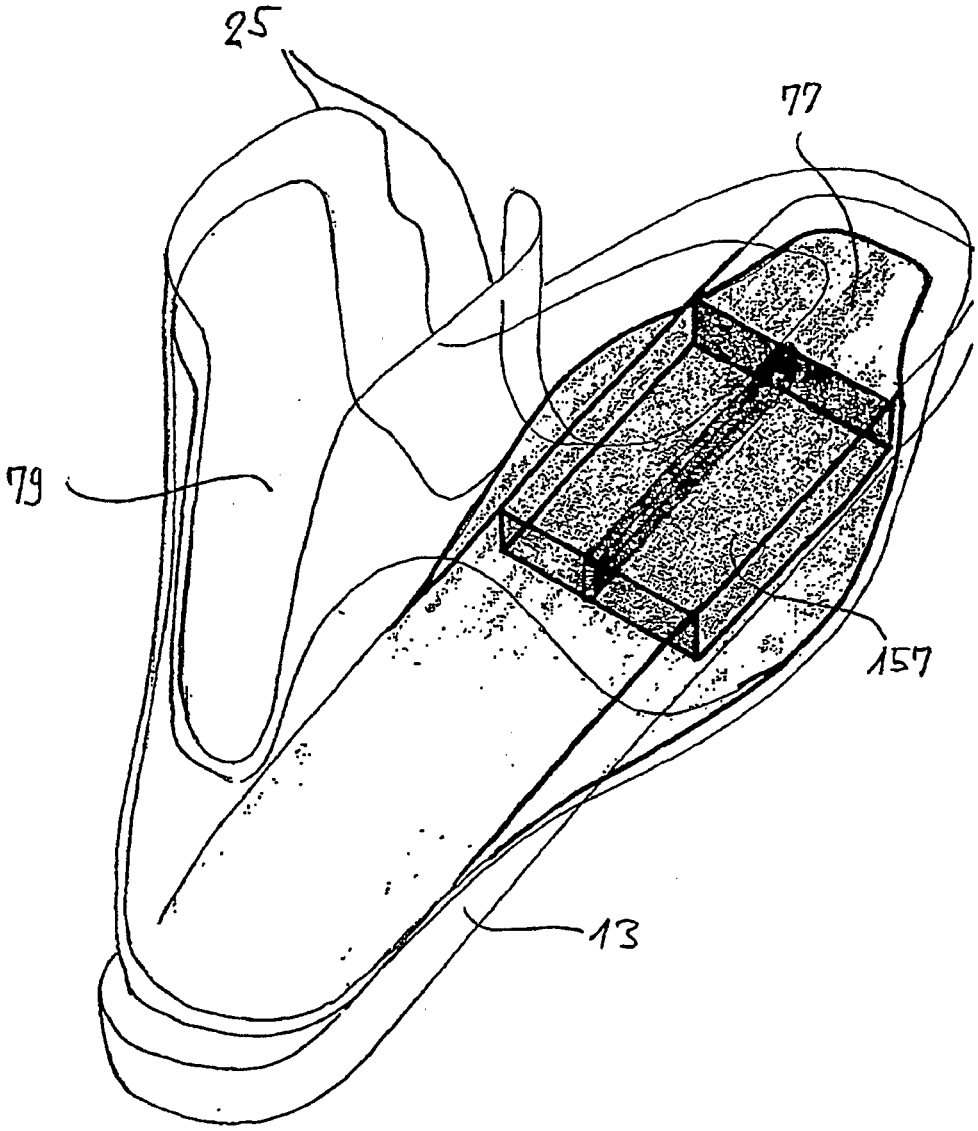
Figure 49:
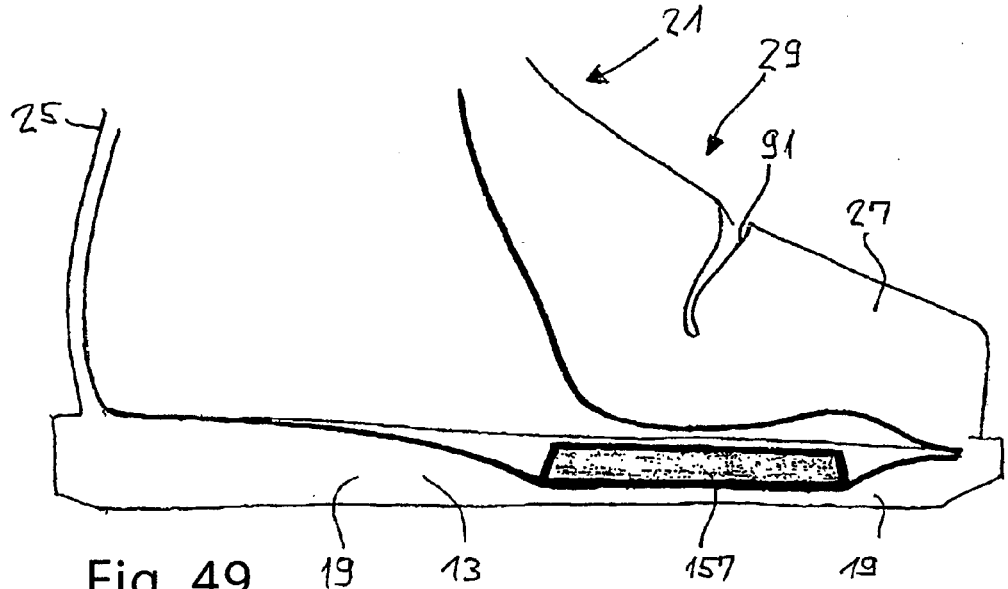
Figure 50:
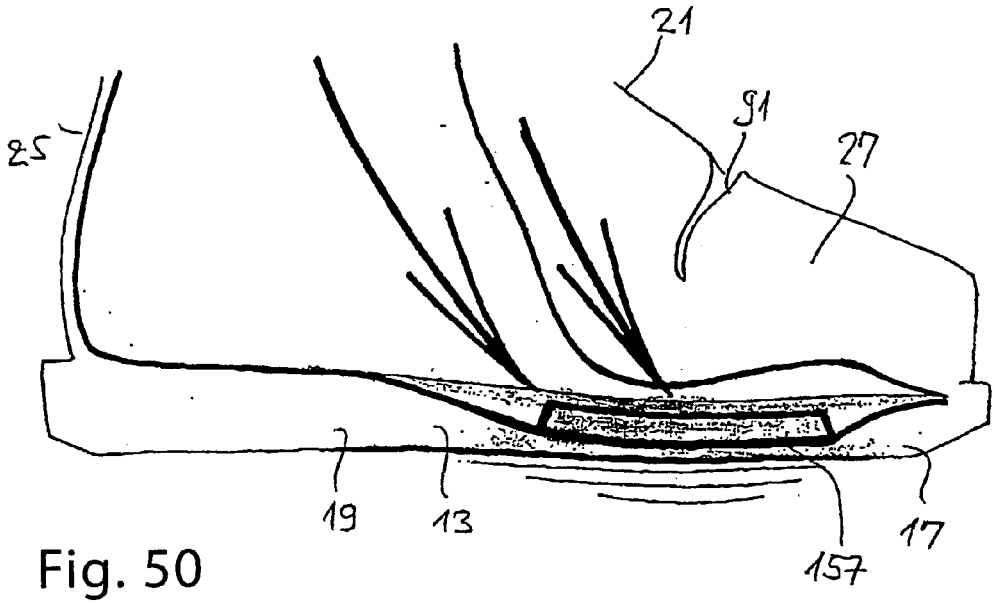
Figure 51:
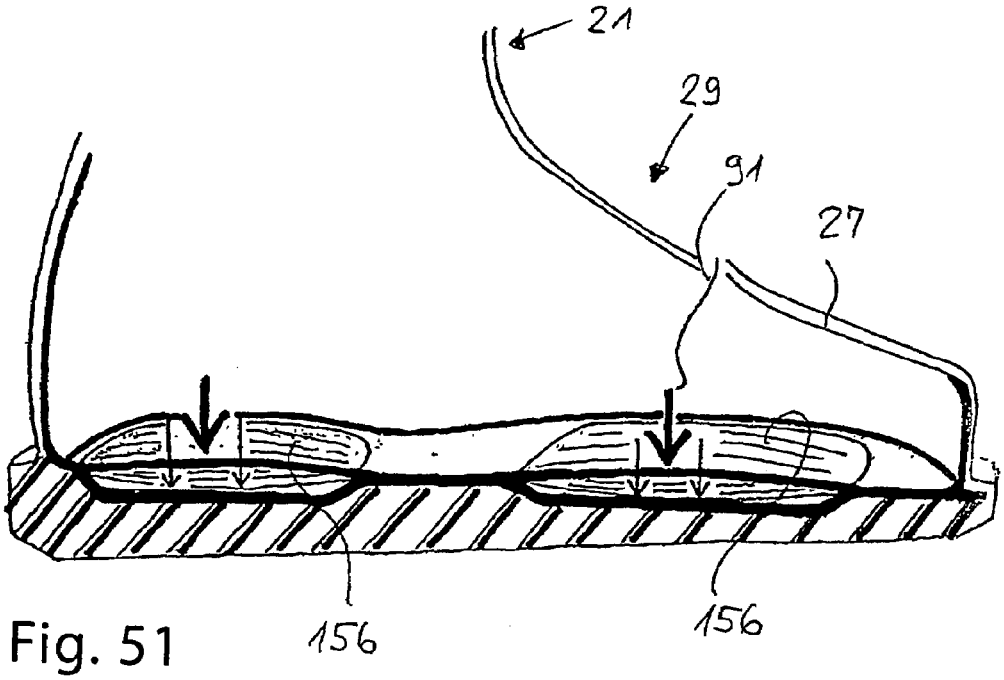
Figure 52:
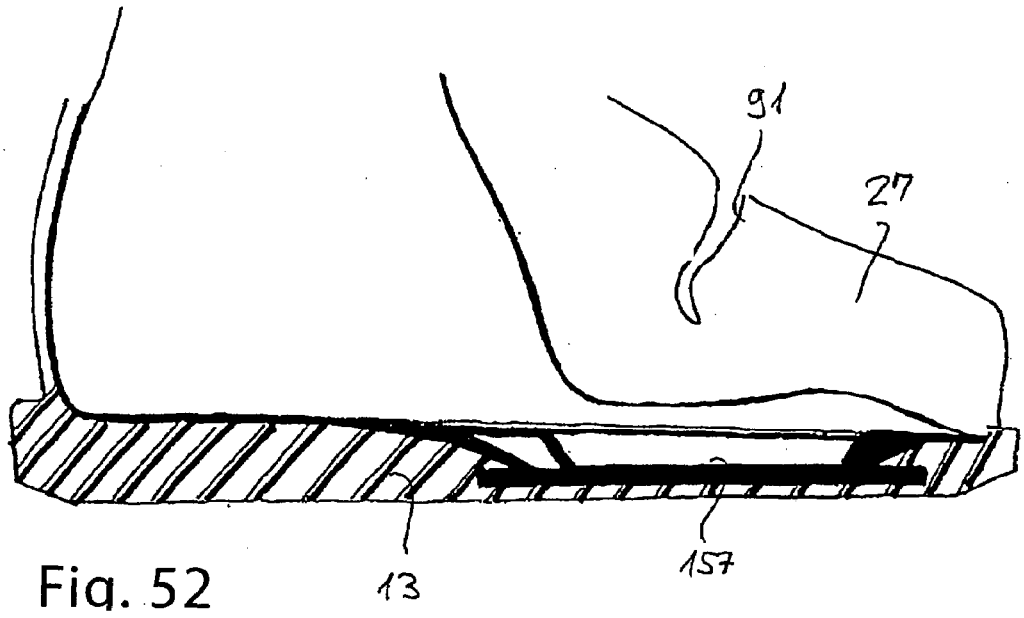
Figure 53:
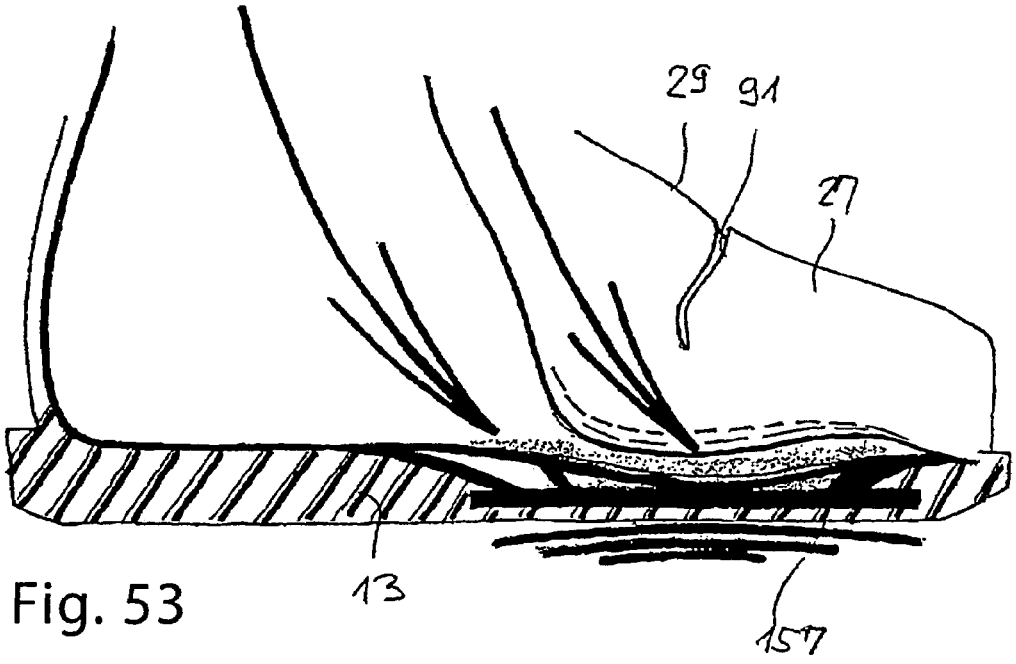
Figure 54:
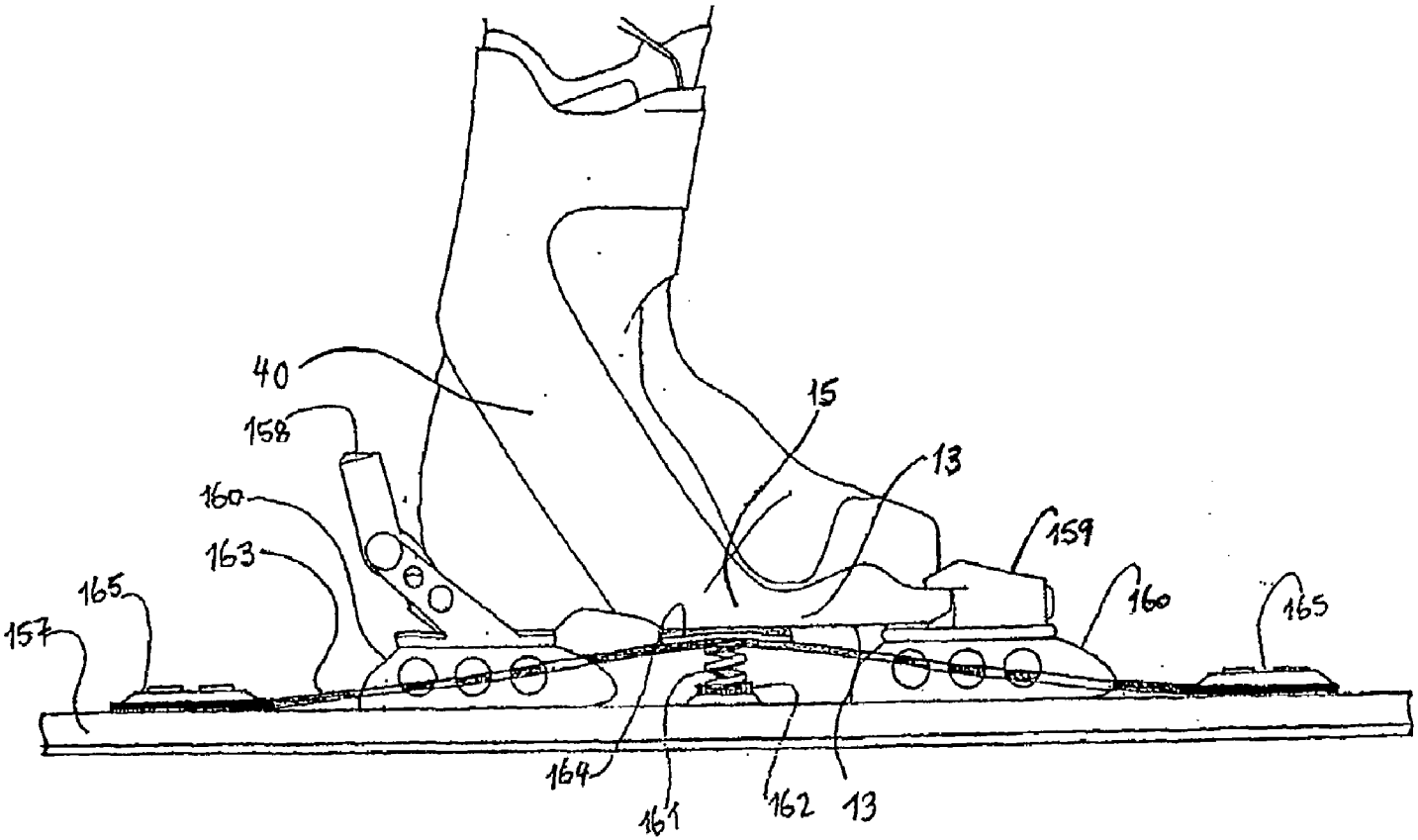
Figure 55:
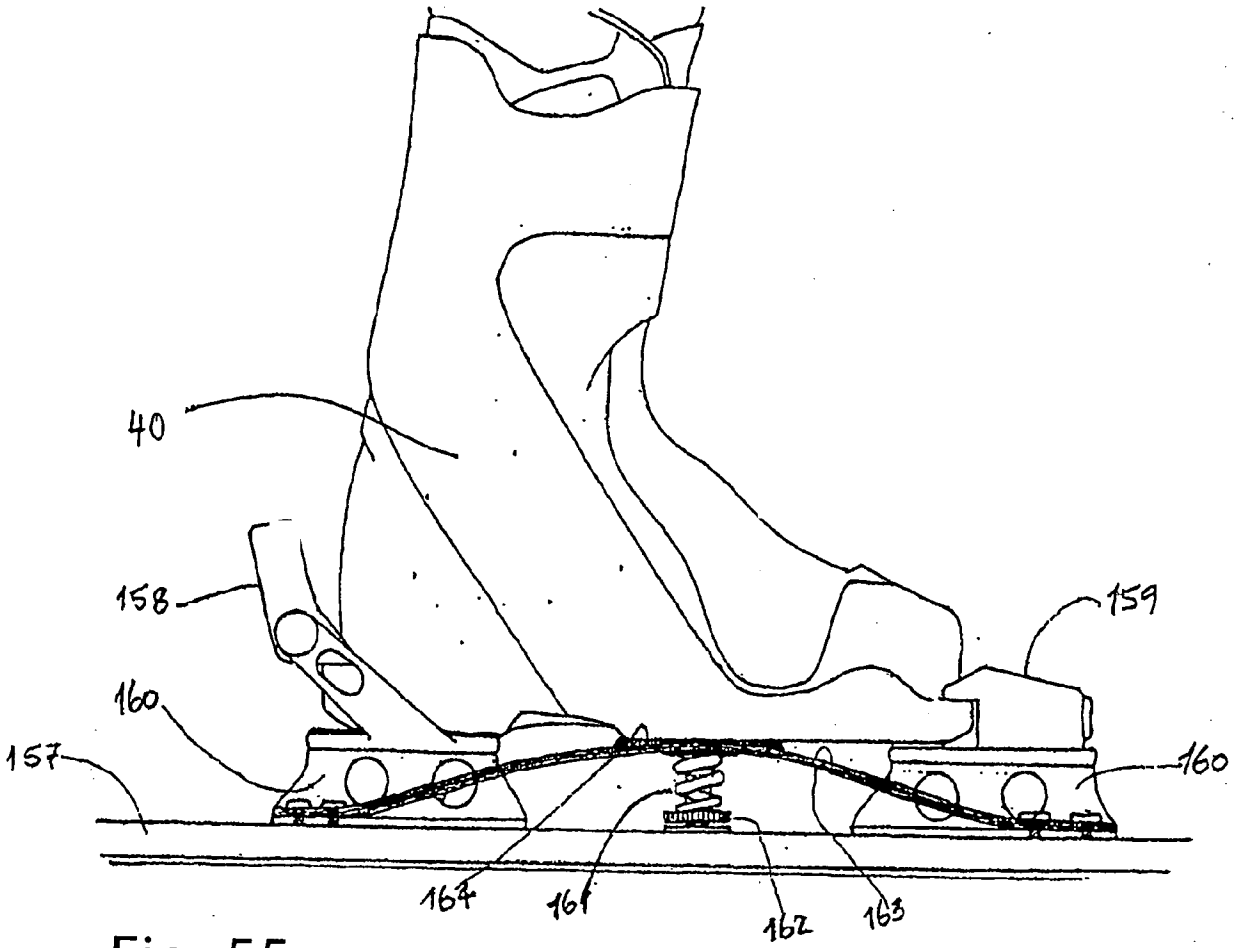
Figure 56:
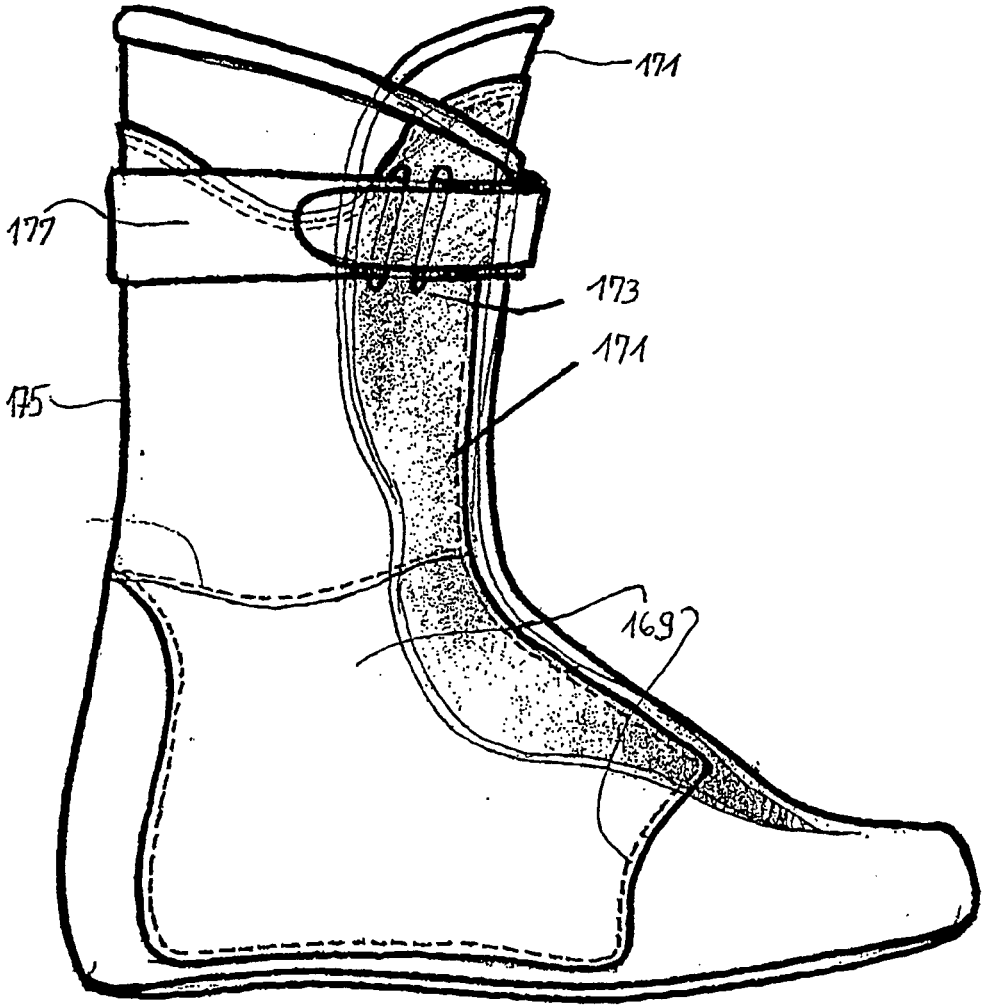

FIG. 44 an embodiment of the bridge using a reinforced webbing with creases to allow controlled deformation when flexed;

FIG. 45 shows the embodiment of FIG. 44 when front and rear shell portions are flexed relative to each other;

FIG. 46 a 3 buckle boot model as in FIGS. 1 and 2 with a transverse webbing system as shown in FIGS. 44 and 45;

FIG. 47 schematically a further embodiment of a ski boot with a so-called torsion box system integrated in the metatarsals of the sole;

FIG. 48 the torsion box system of FIG. 47 from another perspective;

FIG. 49 schematically, a longitudinal section through the boot of FIG. 47;

FIG. 50 the ski boot of FIG. 49 after dynamic forces are applied;

FIG. 51 another embodiment of the torsion box system with a bubble relief on the superior (proximal) sole surface;

FIG. 52 another embodiment of the torsion box with a flexible superior layer and an essentially inflexible distal layer or surface that cannot be flexed;

FIG. 53 The embodiment of FIG. 52 when rear shell portion is pivoted relative to the front shell portion;

FIG. 54 a ski, ski boot and ski binding set having a leaf-type spring mounted on the ski between front and rear binding parts;

FIG. 55 the set of FIG. 54 with a shorter leaf-type suspension element;

FIG. 56 an embodiment of an inner boot.

In the FIGS. 1 to 14 different embodiments of ski boots 11 according to the invention are shown. The characteristics of the novel boot are an essentially rigid rear boot portion and a front boot portion being bendable or elastic with respect to the rear boot portion. In particular, the ski boot 11 has a sole 13 comprising an elastic zone 15, where the metatarsus of the foot received in the boot will be located, dividing the sole 13 into a rear sole portion 17 and a front sole portion 19. The rear sole portion 17 is integral with a rear shell portion 21 comprising a heel portion 23 and shaft 25 extending upwards from the circumference of the rear sole portion 17. The front sole portion 19 is integral with a front shell portion 27 extending upwards from the circumference of the front sole portion 19. Between front and rear shell portions 21, 27 an intermediate shell portion 29 is located which extends from the shaft 25 to the front shell portion 27. The front shell portion 27 essentially corresponds to the toe cap of the boot. Rear and front shell portions 21, 27 are bendable relative to each other due to the elastic design of the sole 13 in the metatarsals and the intermediate shell portion 29 of the ski boot which is foldable or compressible at least in the region located above the elastic zone 15.

According to the first embodiment shown in FIGS. 1 and 2 the intermediate shell portion of the ski boot 11 comprises an opening 31 in the shell plastics extending behind the front shell portion 27 or toe cap. The opening 31 has a pear-like shape. The edges 33 of the opening 31 extend approximately from the rim edges of the instep portion a distance downwards to the sole, then parallel to the sole and again upwards to the rim edges of the instep. Due to the deep opening 31 in the metatarsal area the shell plastics presents essentially no obstacle to the bending of the front boot portion when the skier is walking or is pressing the knees forward when skiing. The opening 31 is usually covered by a more elastic and impermeable cover 35 which prevents the intrusion of snow and water.

Figure 3:
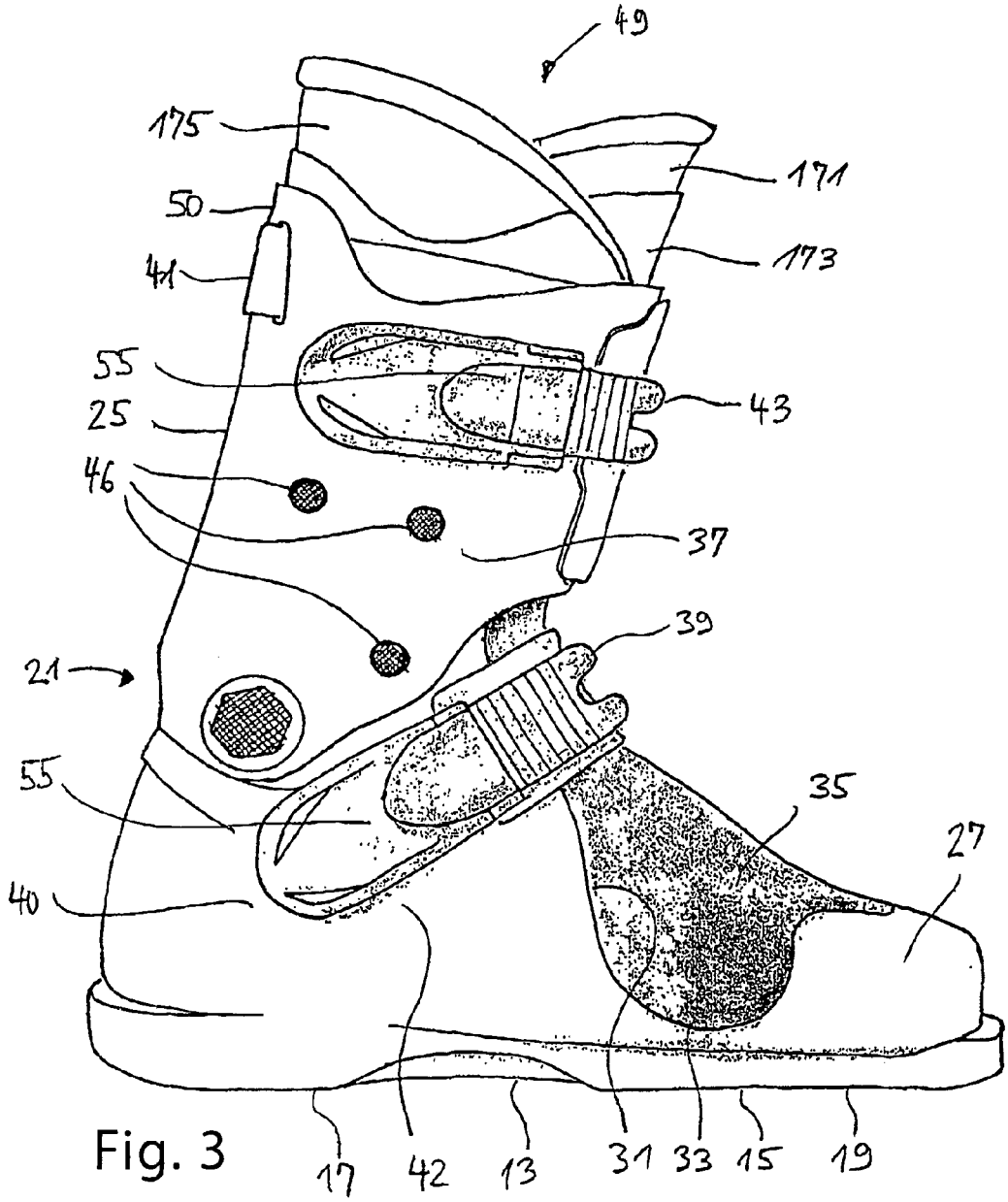
Figure 4:
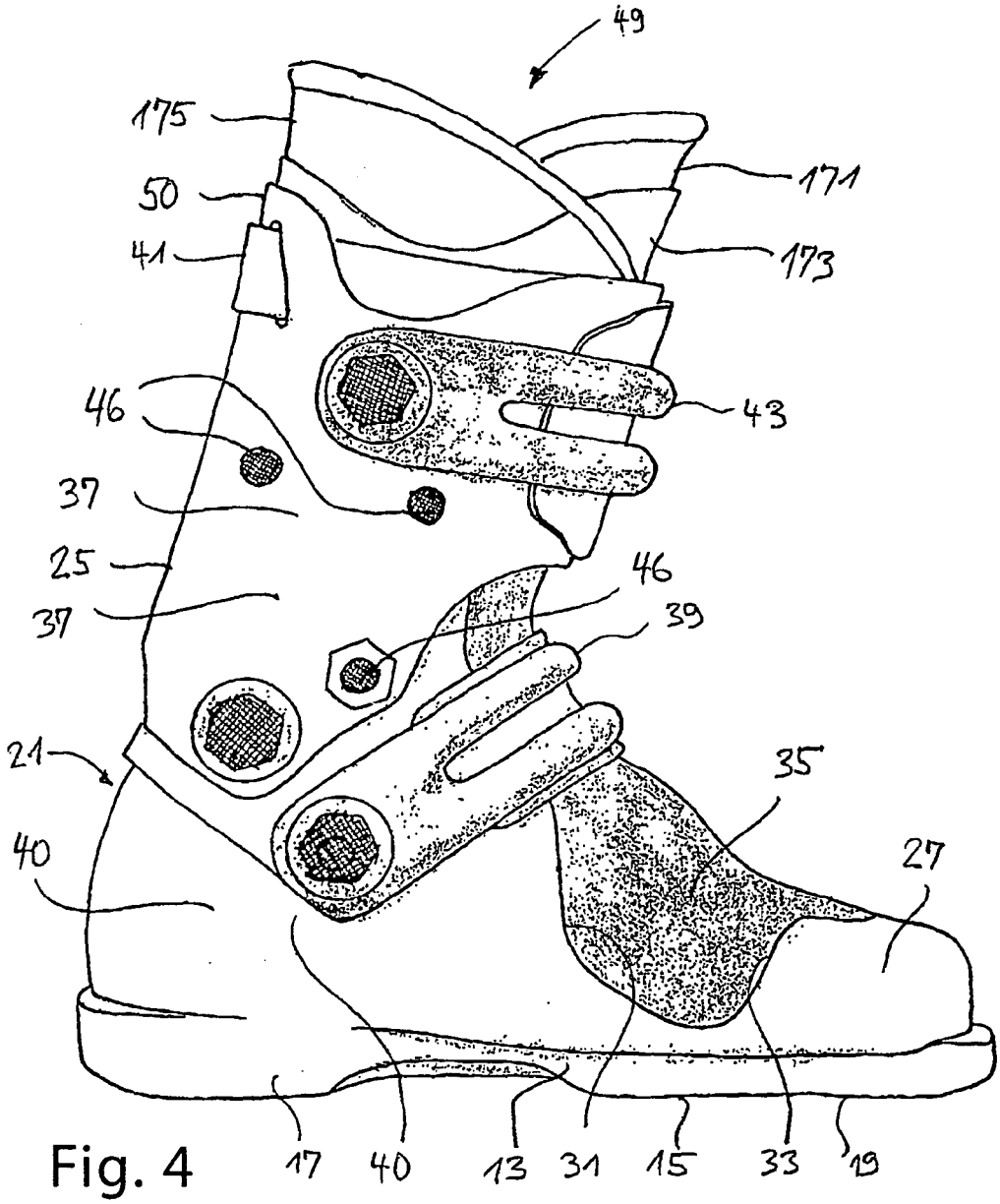
Figure 5:
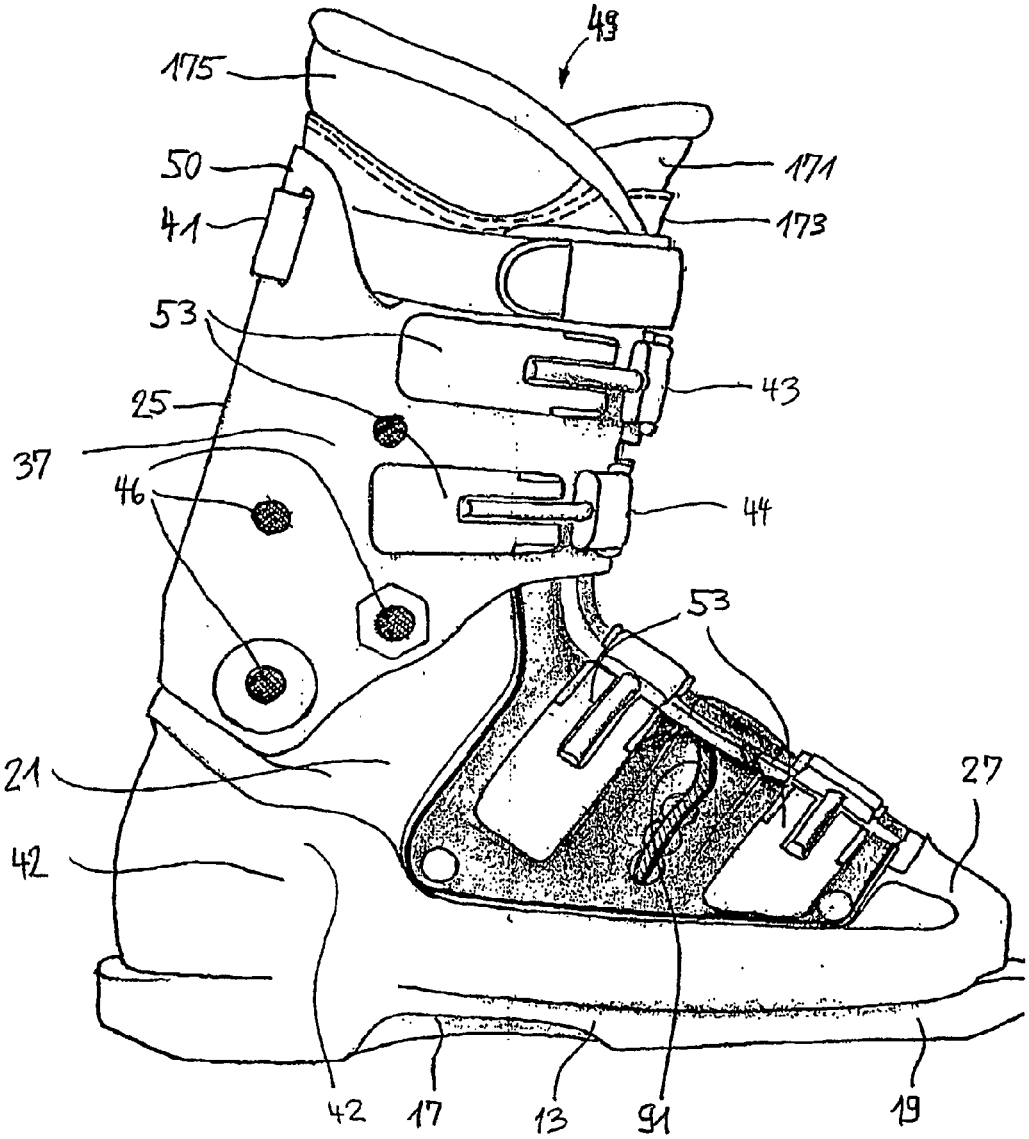
Figure 6:
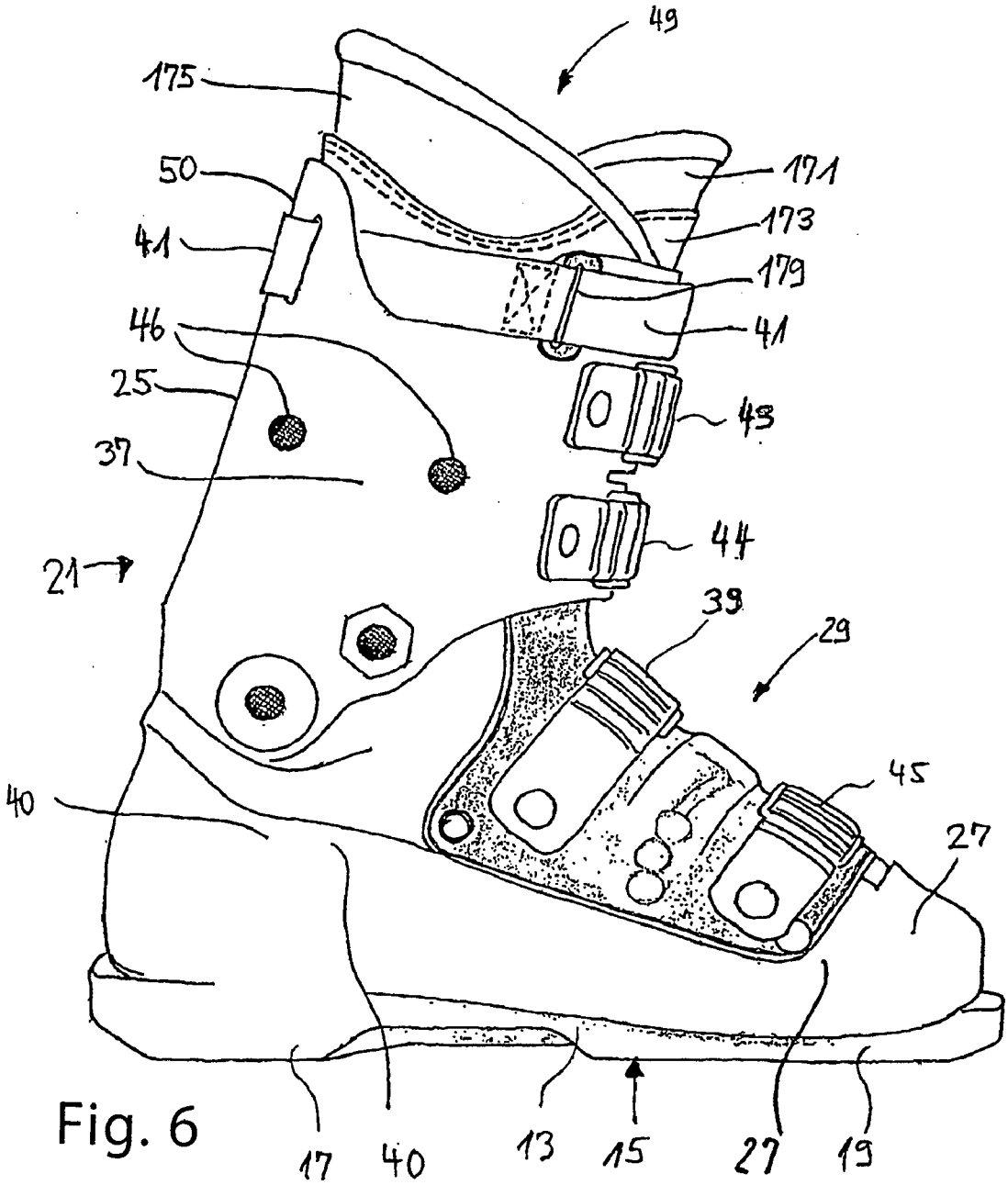
Figure 7:
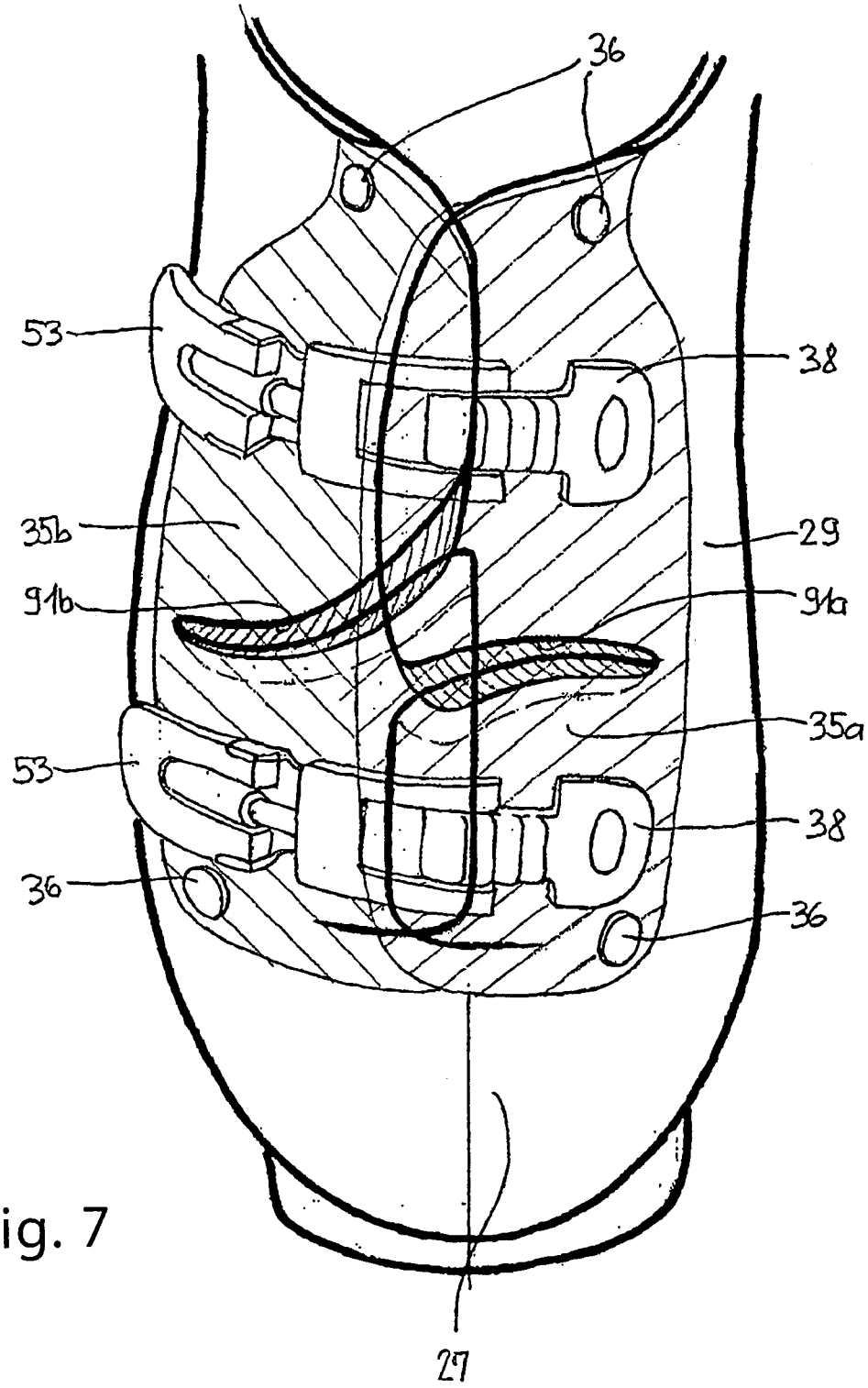

According to a second embodiment shown in FIGS. 3 and 4 the opening 31 is more apparent than in the first embodiment. The opening 31 extends not only just above the elastic zone 15 but from the deepest point of the opening 31 at an angle towards the shaft 25 leaving the shell more open. This is of importance for more effectively supporting the foot in the ski boot and in eliminating the infringement of the instep by the overlapping shell plastics. The space created is replaced with soft and pliable plastic parts that serve to insulate against snow and water, and to eliminate the transfer of unwanted forces between the skis and the front of the lower leg, and also to create a most efficient force triangle effect.

Figure 8:
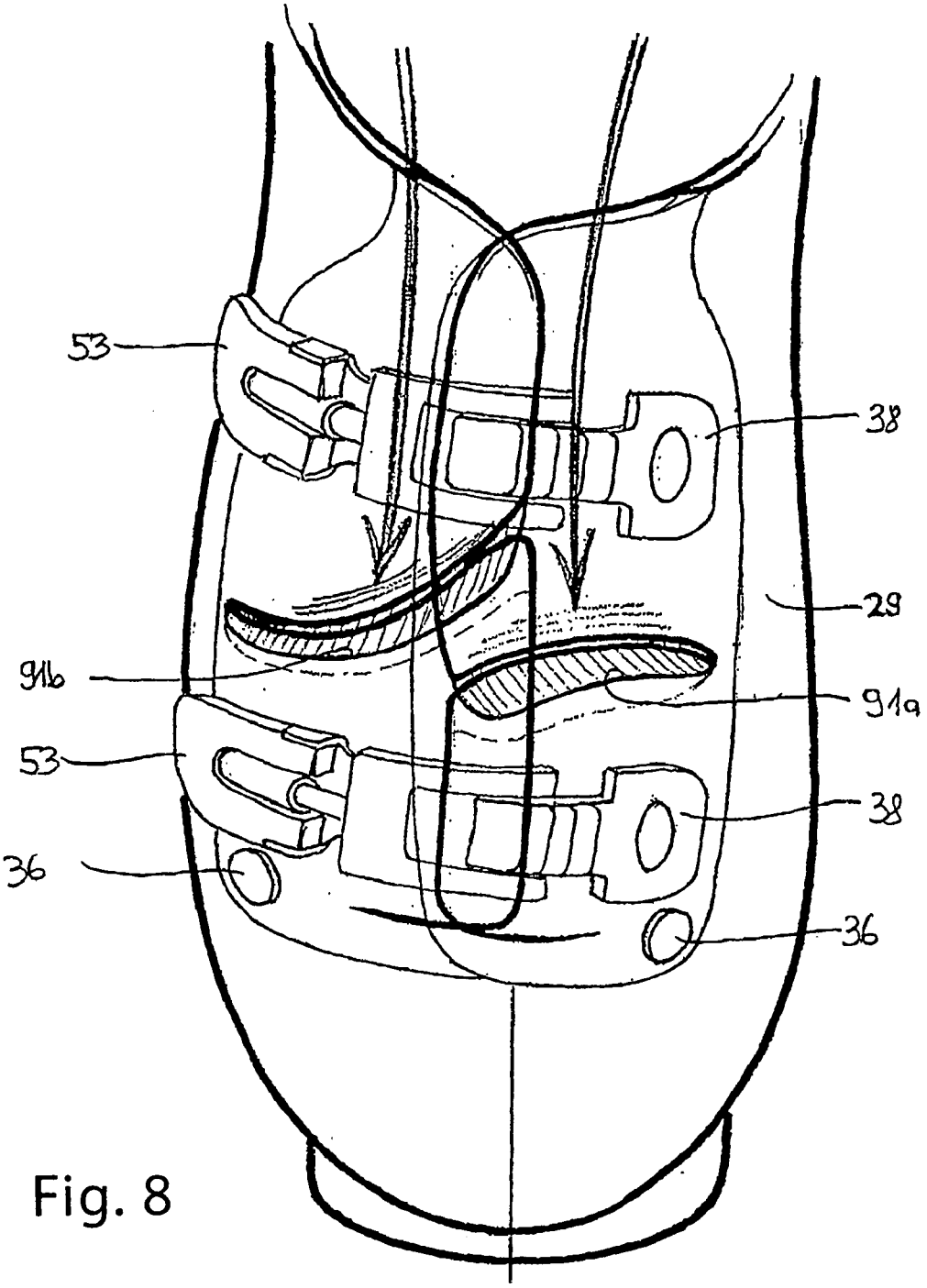
Figure 9:
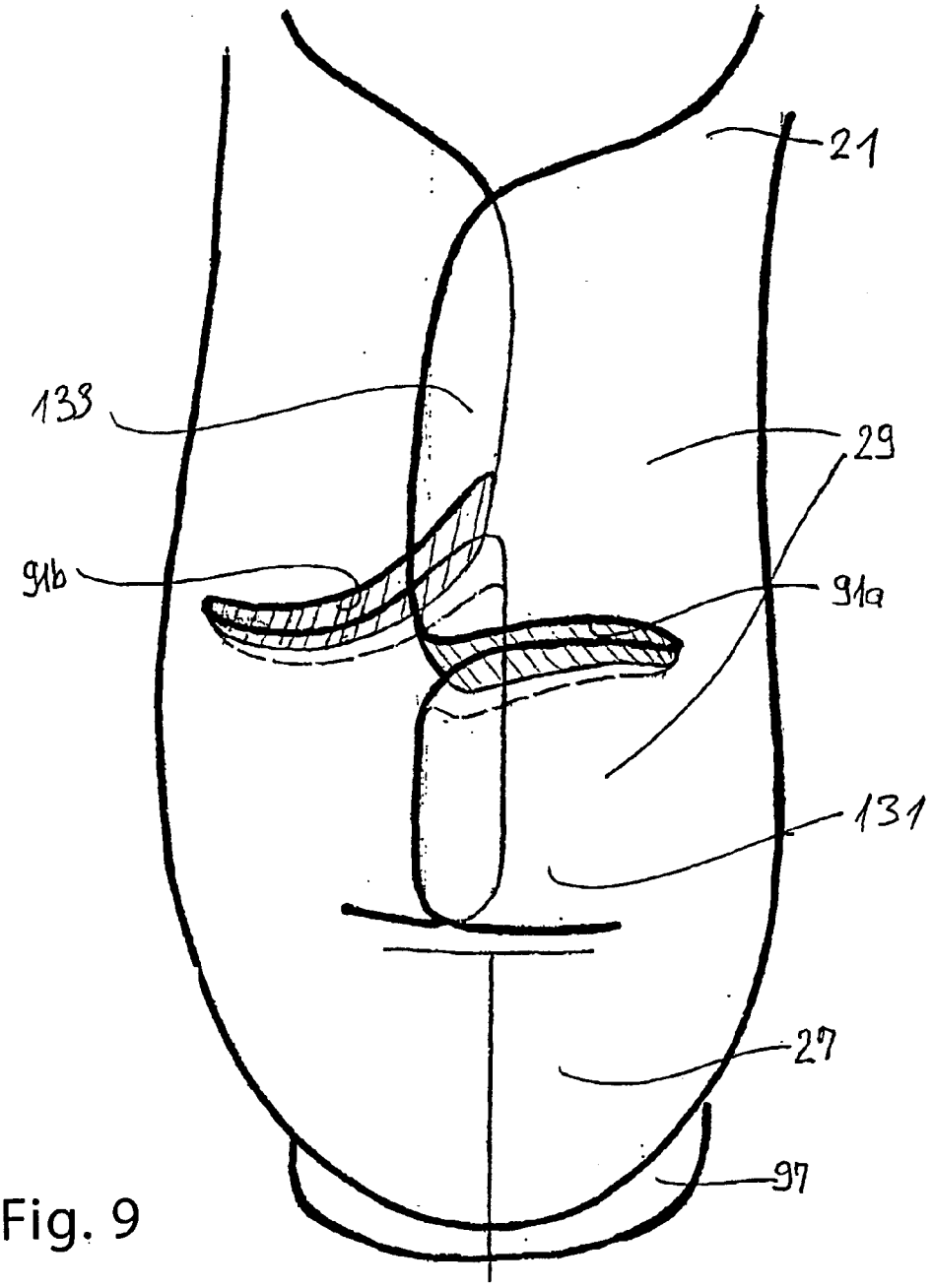

According to a third embodiment shown FIGS. 5 to 9 the opening 31 is reduced to transverse cuts 91*a*, 91*b*. The cuts 91*a*, 91*b* are formed in the side panels of the intermediate shell portion 29, which can overlap as in conventional ski boots. The cuts 91*a*, 91*b* are rounded and extend from the edge of the side flaps 131,133 or panels in a curve towards the sole 13. The side flaps are covered by elastic and impermeable covers 35*a*, 35*b*. The covers are fixed to the intermediate shell portion 29 by rivets 36 and the buckle base plates 38. Adhesives can also be used. In FIG. 8 the reduction of the cuts 91*a*, 91*b* is illustrated when the shaft is bent forward.

Figure 10:
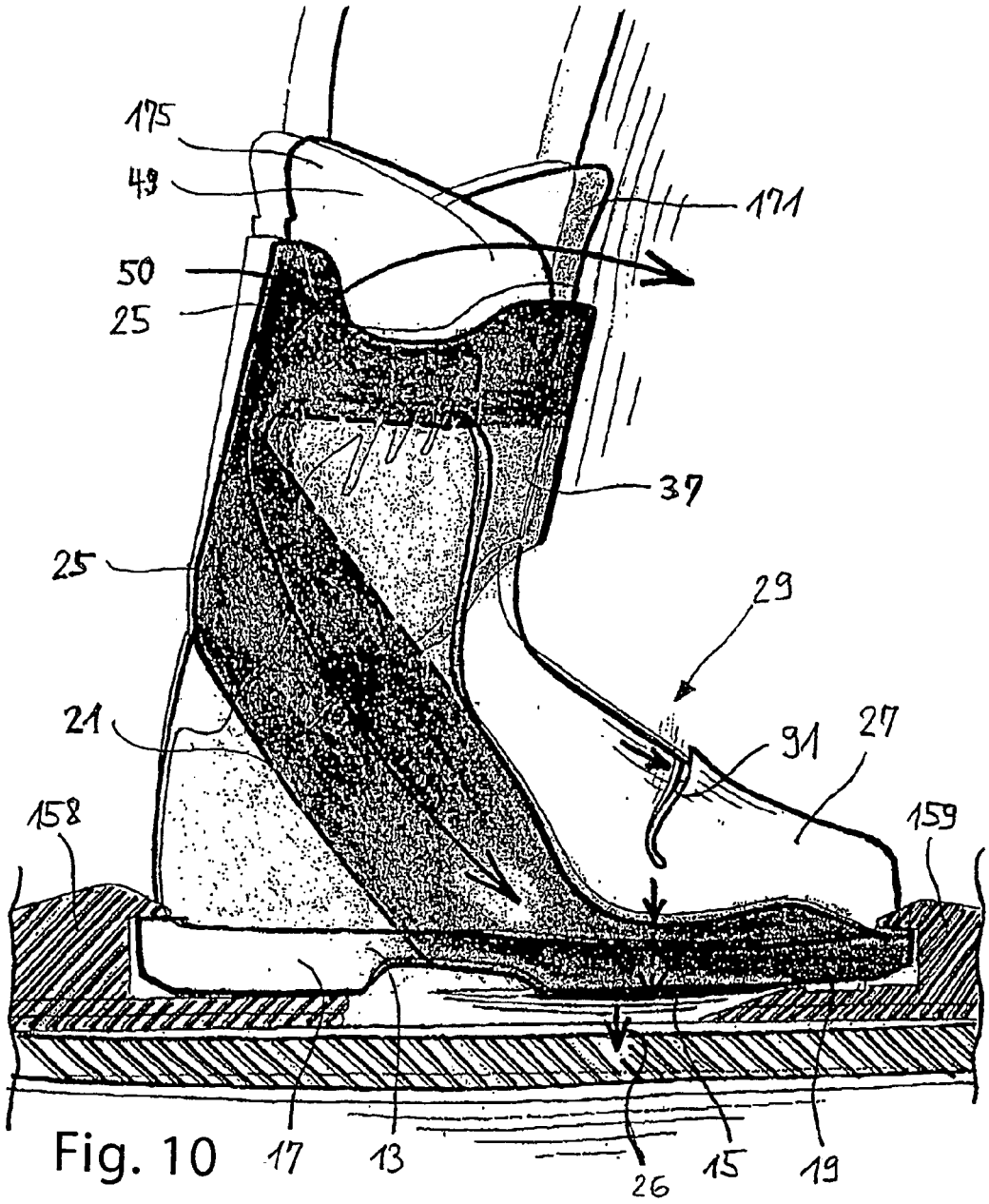
Figure 11:
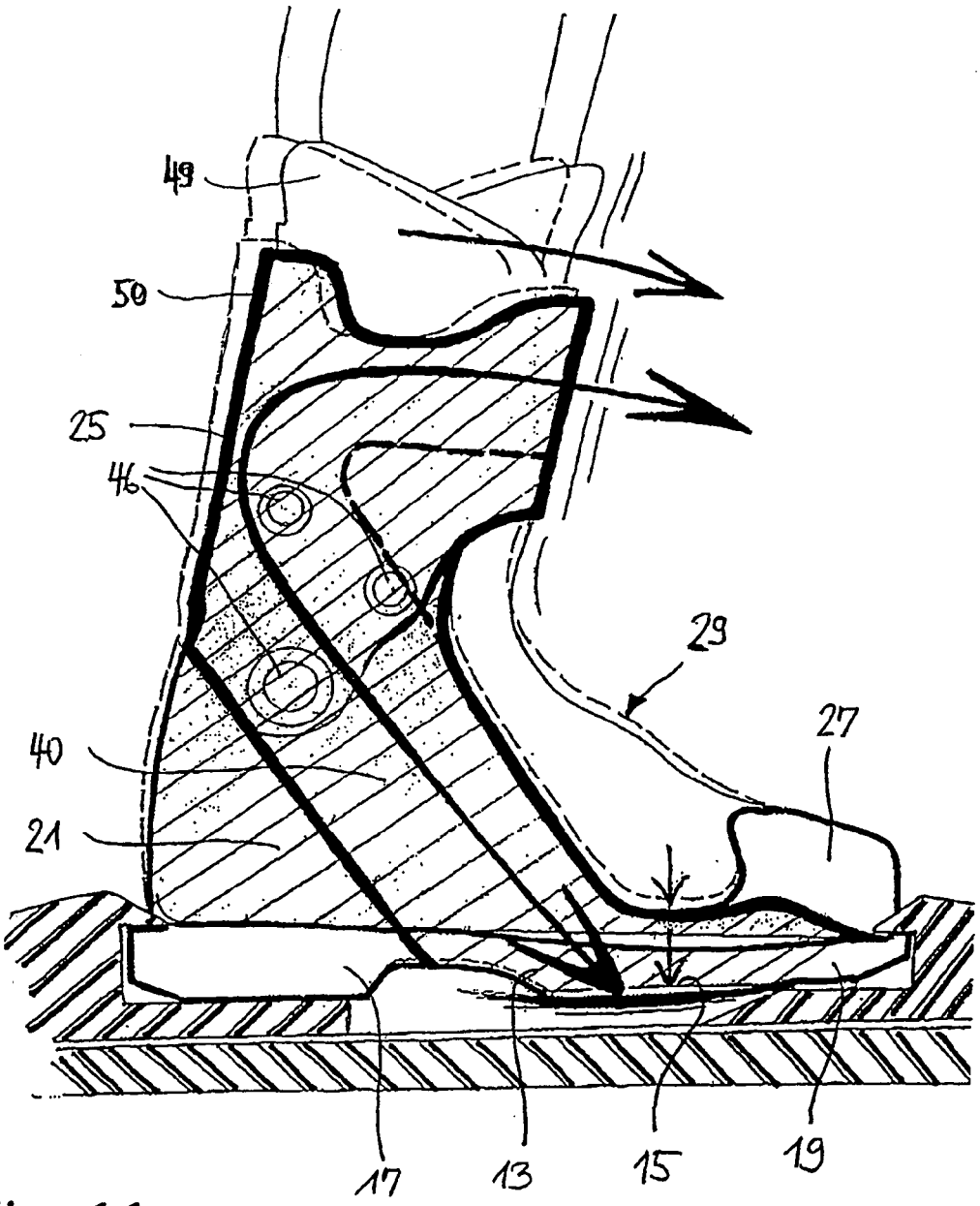
Figure 12:
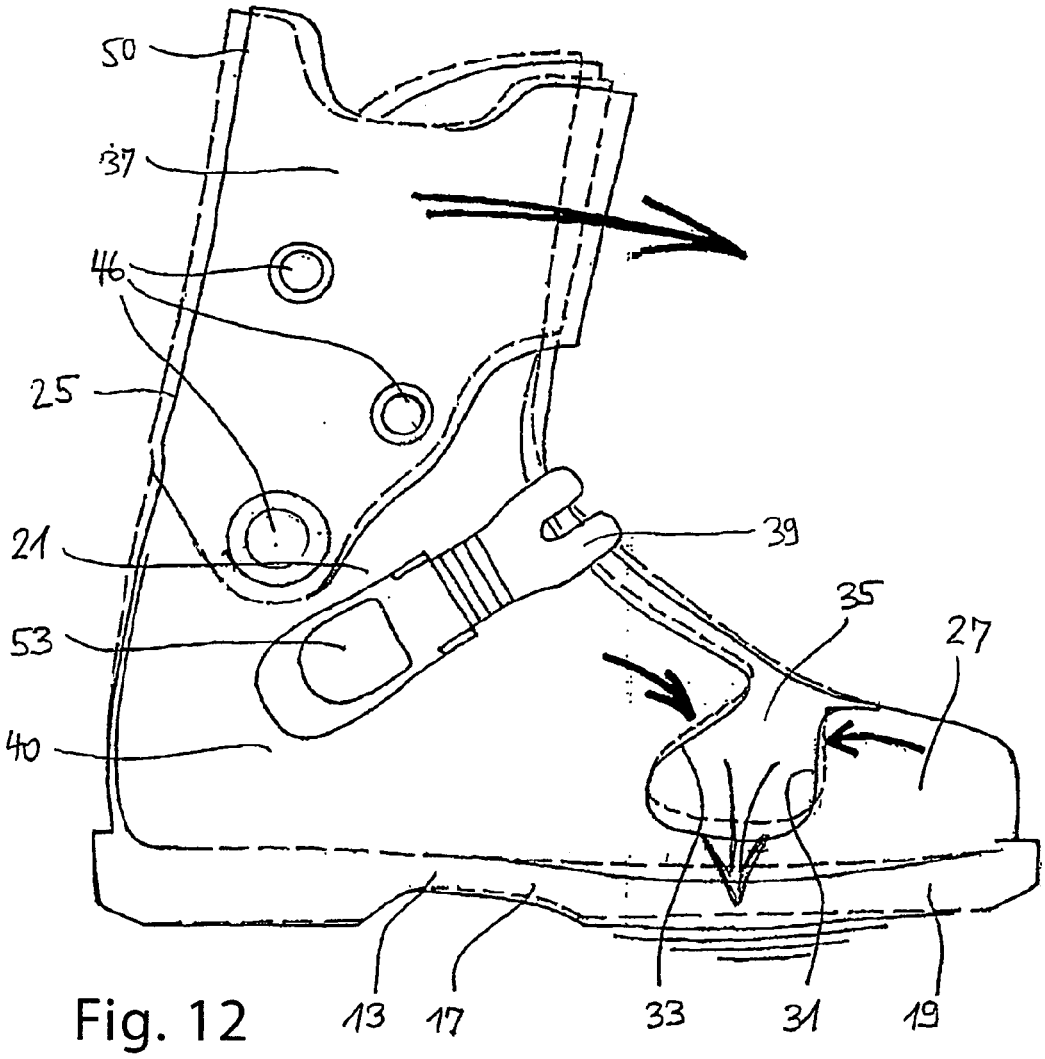

Common to all embodiments is that the shaft of the lower leg is coupled with the liner against the rear spoiler shaft 25, rear side shell portions 40, 42 and rear sole portion to form an essentially stiff ensemble so that a force triangle is created. The force triangle as schematically illustrated in FIG. 10 allows the user to apply a maximum lever to the metatarsal sole portion where the elastic zone 15 is located. The rear side shell portions 40, 42 may be designed as reinforcements of the outer boot shell as illustrated in FIGS. 54 and 55. They can be designed as reinforced shell plastic sections that extend from the upper shaft at an angle downwards to the mid-foot area behind the elastic zone.

Although the shaft 25 may be made of one piece, the shaft 25 can comprise a cuff 37 being connected to the rear shell portion 21. Unlike conventional ski boots the cuff 37 of the novel ski boot is connected to the rear shell portion 21 such that rear shell portion 21 and cuff 37 are rigidly interconnected. Reference numeral 50 designates the spoiler extending above the shaft 25 and/or cuff 37, respectively, at their rear side. By way of example, the cuff 37 can be fixed to the rear shell portion 21 by at least two rivets 46 on both sides of the boot. The more rivets 46 that are used to fasten the cuff 37 to the shell shaft 25 the more supportive and rigid the shaft 25 and cuff system 37 become. The rivets 46 can be selectively added or withdrawn on either side of the cuff and shaft to create the desired amount of resistance torsion to the medial and lateral sides respectively and according to the skier's preferences. The rear shell portion 21, shaft 25 and the cuff 37 are designed such that they are in a rigid relationship to more effectively brace the ankle from forward flexing motion. By this means the skier is able to introduce a force directly into the elastic zone of the sole 13 via the boot shaft 25. If the skier exerts a force on the shaft parallel to the boot axis by bending forward with the knee, then a vertically downward directed force component (arrow 26) results in the bending of the metatarsal sole region. This effect is illustrated in FIG. 10. As the sole 13 can be elastically deformed, the ankle essentially does not flex and the center of gravity of the skier can therefore be easily maintained in its most favored and balanced position. According to the conventional ski technique using a rigid sole and flexible or pivotable cuff shaft the ankle of the skier articulates and moves forward and backward when the skier bends forward or backward. Although not apparent at first, the novel design of the ski boot 11, which is contrary to the design of presently commercially available ski boots, the important flex element has been moved from the ankle and leg shaft to the ball of the foot. This allows for better control as the forces can be applied more directly into the skis, without the usual deformation of the shell plastics with bending which causes a loss of stability and control, respectively.

For an optimum control it is of importance that the lower leg and ankle of the skier are attached to the shaft 25 with a minimum play by pulling the leg shaft back and fastening it against the spoiler with the power strap, before the cuff is closed with the closure fastening system. Until now the cuff closures were closed first and before the power strap, which was then closed on the outside and in front of the cuff. For this reason it is preferable that the outer boot is easily deformable or compressible at the instep and metatarsal portion 29. In order to achieve this the opening 31 of the rather hard outer shell plastics preferably extends to the shaft 25 so that an ankle fastening means, e.g. a strap 39, extending from the inner side of the boot to the outer side can embrace and more effectively pull the ankle and heel of the skier back into the heel portion 23. The ankle of the skier is thereby essentially immobilized—unlike in conventional boots where the adaptability of the shell plastics is noticeably limited and often not effective in pulling the ankle and heel back into the heel portion. As the sole of the ski boot 11 can bend, there is also no tendency of the skier's ankle and heel to move forward or backward.

A first lower leg or shaft fastening means, e.g. a strap 41, extending around the upper cuff or shaft portion is adapted to secure the lower leg of the skier to the shaft 25 with a minimum play. As can best be seen from FIGS. 1 to 6 and 13 and 14 the first shaft strap 41 is attached to the spoiler 50 so that inner and outer boot shafts are coupled at their upper ends. This allows the skier to apply a maximum force to the metatarsals by means of the rigid shaft and cuff portions. Optionally, second and third shaft fastening means, e.g. plastic straps or buckle fasteners 43 and 44, can be provided along the outer boot shaft. The second and third straps may be integral with the outer boot shell plastics. Using two or more shaft straps 41, 43, 44 is optional and allows the skier more leverage in closing the cuff 37 and shell shaft 25 to support around the lower leg and ankle, and permits a more uniform and comfortable distribution of closing pressures. A foot fastening means, e.g. a strap or buckle fastener 45, in the metatarsal region serves for the fixation of the forefoot. It is understood that a strap in terms of the present invention can be any of already known closures used with ski boots.

Figure 13:
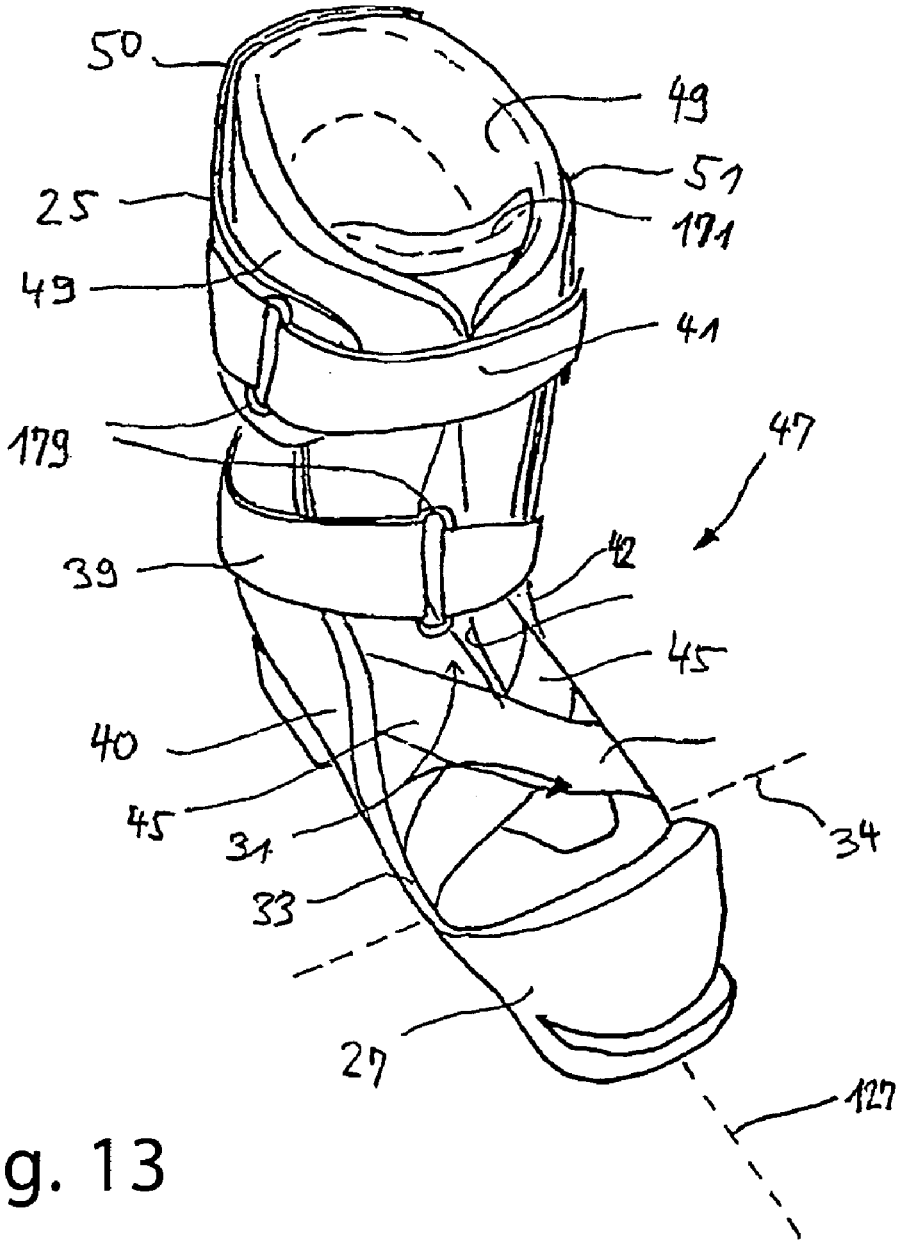
Figure 14:
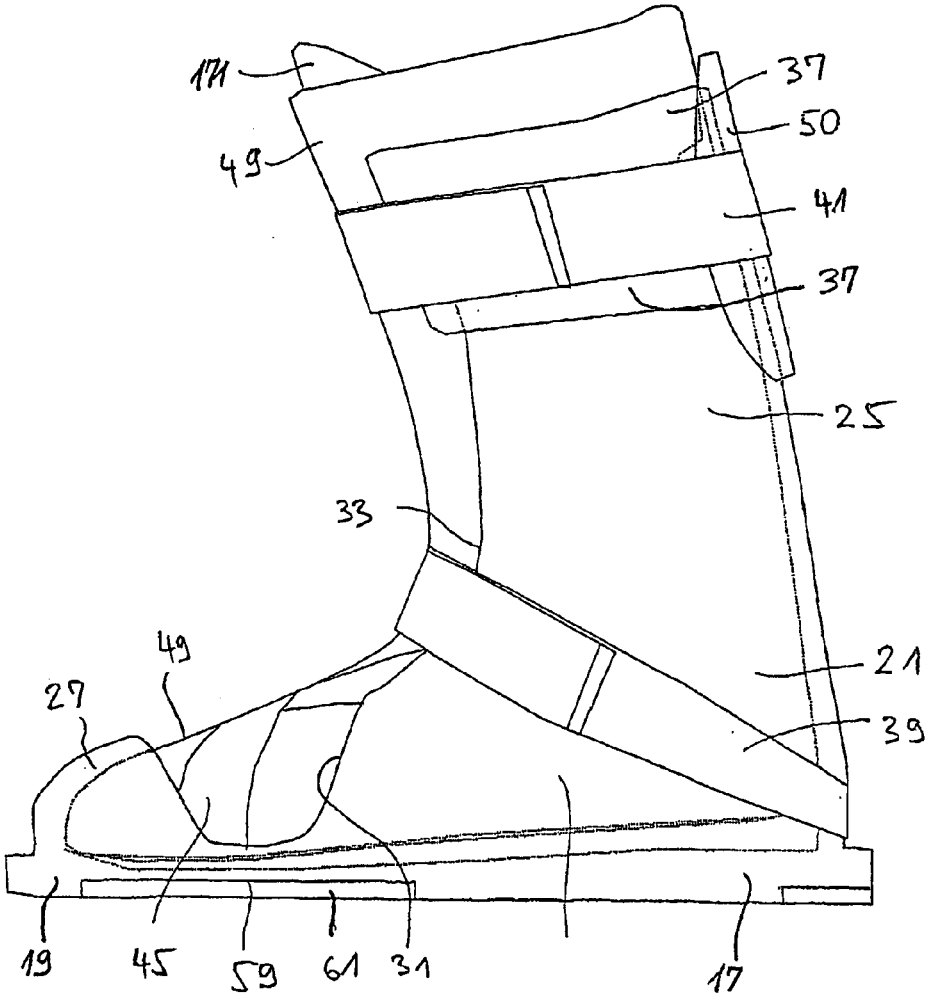

According to a fourth embodiment shown FIGS. 13 and 14 the opening 31 is increased to significantly reduce the amount of shell plastic surrounding the foot and metatarsal bones. In contrast to the embodiments discussed above the fourth embodiment has an outer boot shell made of one piece. The outer boot comprises an essentially open shell 47 in which the inner boot 49 is received. The opening 31 extends from the toe cap 27 to the upper shaft end 51. The ankle strap 39 is arranged at about 40 to 50 degrees to the vertical such that the ankle of the skier can be effectively fixed in the heel portion 23. The inner boot 49 exceeds the edges 33 of the opening 31 so that the straps 41 and 39 cooperate directly with the inner boot 49.

The straps 39, 41, 43, 45 can be fastened to the outer boot by means of ordinary buckles 53 (FIG. 5), ratchet buckles 55 (FIG. 1), Velcro fastening means 57 (FIG. 13) etc. or the like.

In FIG. 14 a cavity 59 is shown in the metatarsal region of the sole 13. In the cavity 59 plastics plates 61 with different elasticity coefficients may be inserted and fastened so that the flexing characteristics of the sole 13 can be varied depending on the weight and ability of the skier, the equipment used etc. The foot strap 45 is mounted in the forefoot region directly on the upper surface of the sole of the inner boot and crosses on the instep portion of the inner boot 49 to act as a supportive closure system. This is the preferred forefoot closure and adjustment system in the shell embodiment depicted in FIGS. 3, 4, whereby the crossing of the velcro supporting straps normally needs only one adjustment and fine tuning to the foot for the best support.

Figure 15:
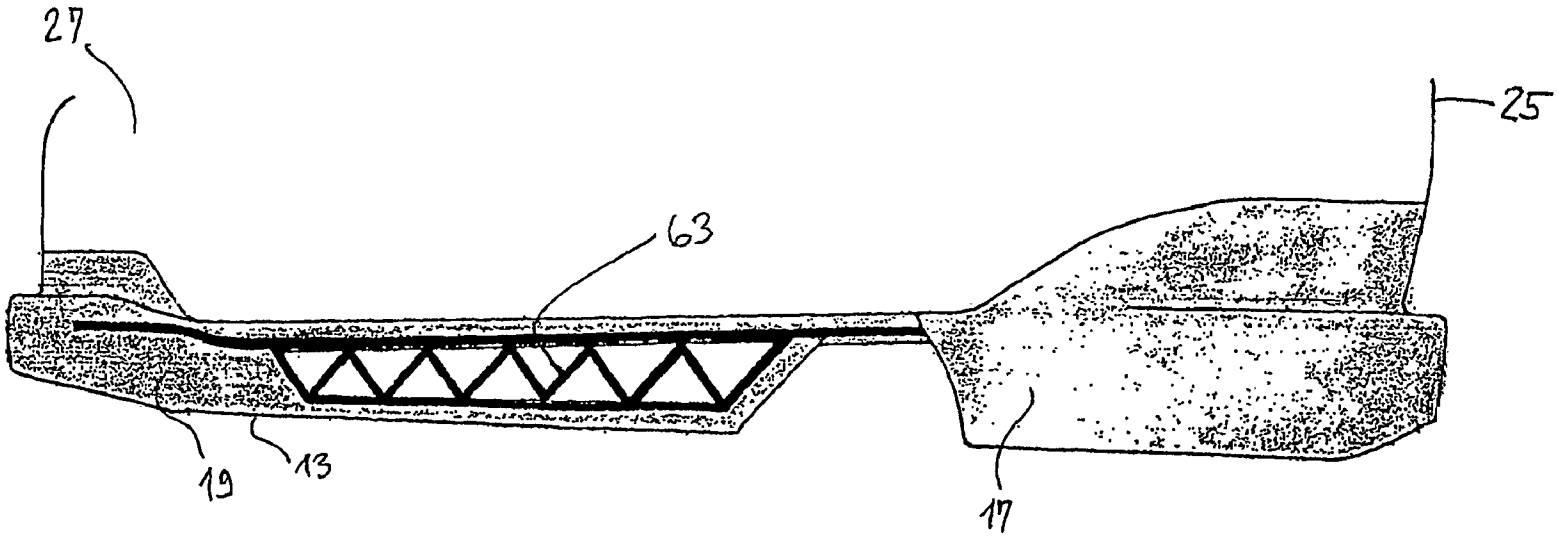

FIGS. 15 to 18 show different embodiments of the elastic sole 13. As illustrated in FIG. 15 a first embodiment of a sole 13 has a reinforcement body 63 embedded in the sole 13. The reinforcement body 63 provides for the desired flex and torsion qualities of the sole in order to control downward and to block upward sole elasticity, dynamic response and torsion. Alternatively, the reinforcement body 63 can be built into a replaceable toe and heel walking plates 97, 99 which allow for adjustment of the sole elasticity to combine the boot sole elasticity and rebound qualities.

Figure 16:
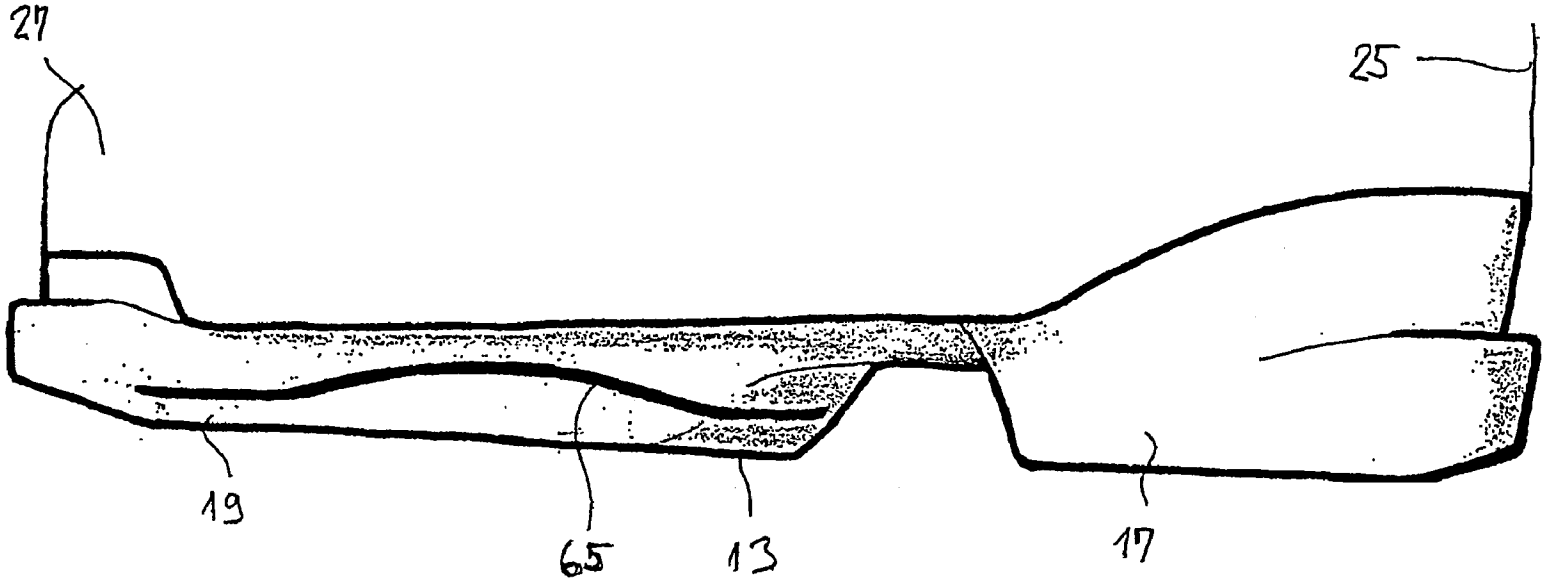

FIG. 16 shows a further embodiment of an inventive sole comprising a leaf spring 65 embedded in the sole under the forefoot region. The leaf spring 65 can also be imbedded permanently into the shell sole or into detachable toe and heel walking soles 97, 99 (FIG. 18). Various leaf spring properties and combinations, such as opposing leaf springs, can be predetermined and exchanged according to the demands of the skier's weight and ability.

Figures 18A, 18B:
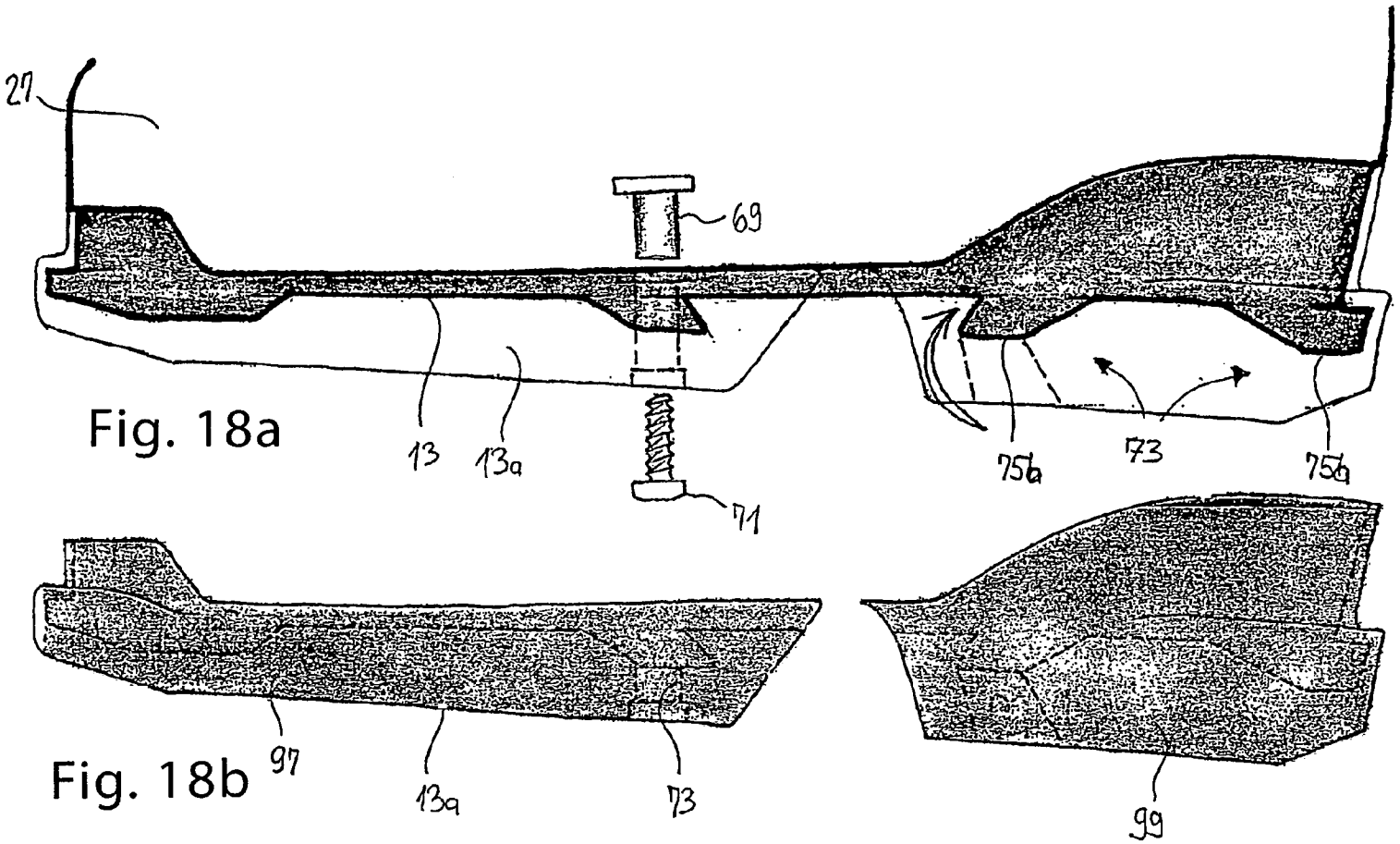

FIGS. 18*a* and 18*b* show a leaf spring reinforcement insert sole with replaceable toe and heel walking sole plates that can be attached either by bolts or a plastic snap-on system that fastens onto premolded shell retainers. The replacement sole parts can also incorporate select dynamic properties to match the skier's weight and ability, and can also incorporate various degrees of sole angles relative to the horizontal plane to adjust easily for the biomechanical peculiarities of each lower leg alignment anatomy.

FIGS. 17*a* and 17*b* show the leaf spring system in neutral and unloaded position (FIG. 12*a*) and again in the dynamic loaded position (FIG. 17*b*). In this embodiment the sole has a concave surface 67 so that the sole's dynamic bending does not extend below the horizontal plane of the sole (FIG. 17*b*).

In FIG. 18 a detachable sole 13*a* is shown. The detachable sole 13*a* is secured to the boot sole 13 with a bolt 69 and a screw 71, which are inserted into a hole 73 in the soles 13, 13*a*. An alternative attachment system is shown with the heel 17 which is attached and fastened by a snap-on system 73 where the rear heel portion slides onto it's premolded notch 75*a* and the forward heel portion is levered and stretched forward over the forward premolded notch 75*b* with a leverage tool or screw driver.

Figure 19:
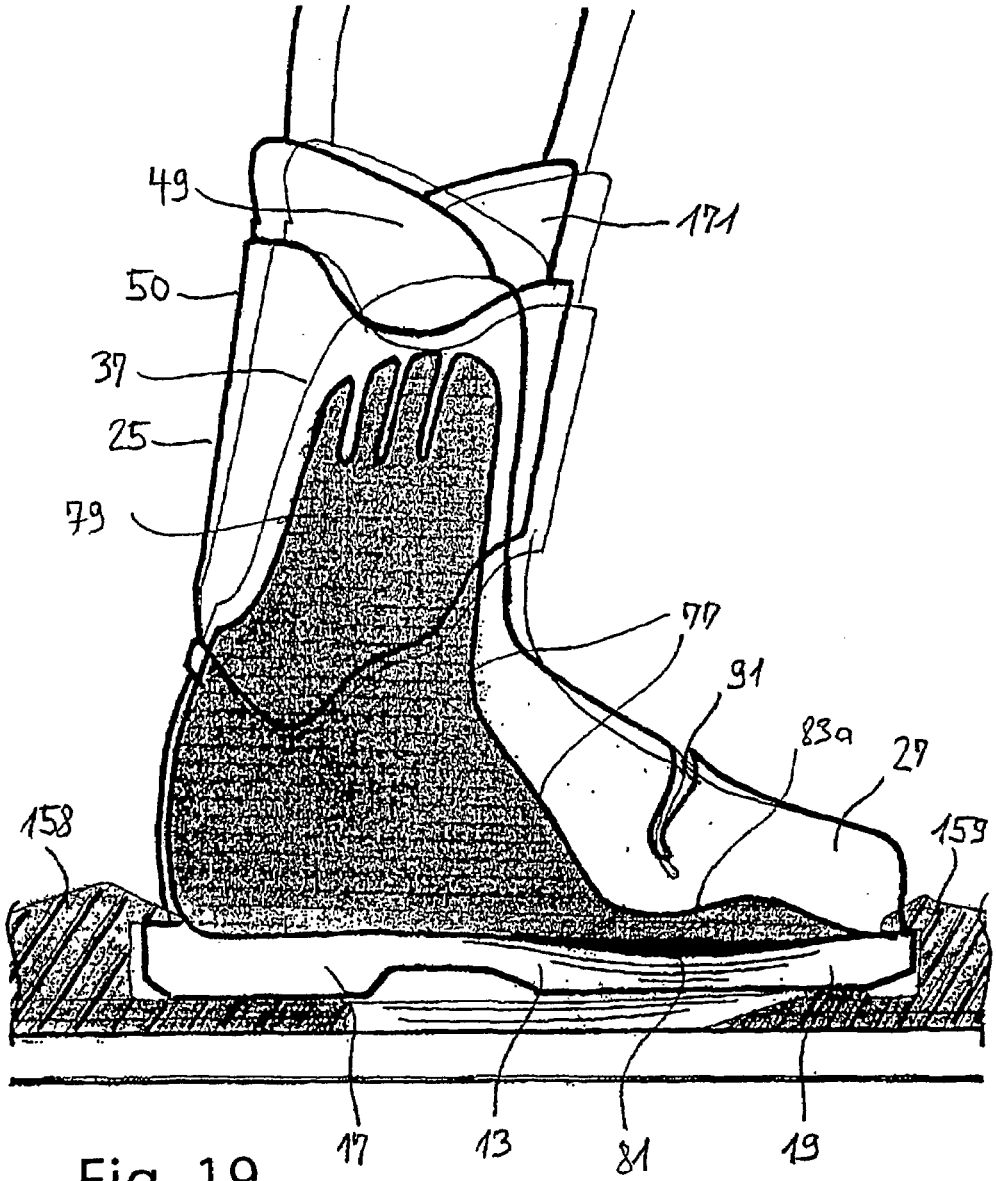
Figure 20:
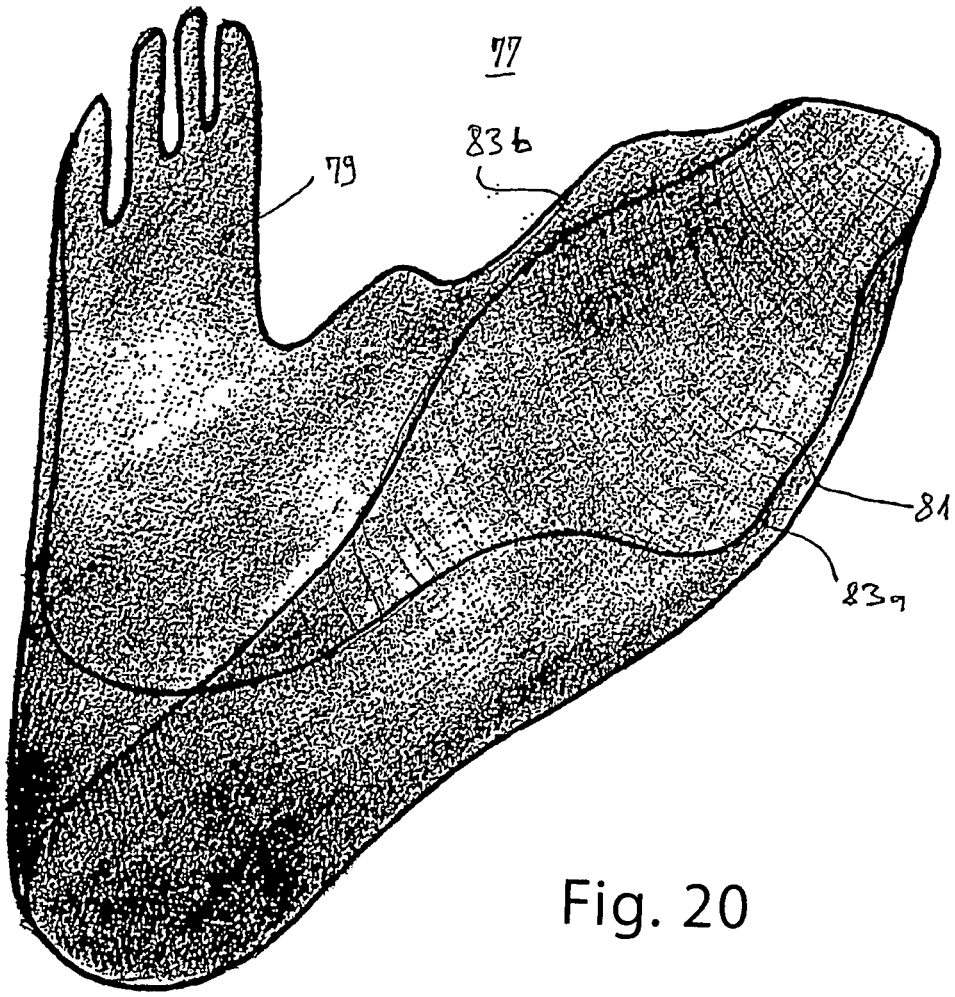
Figure 21:
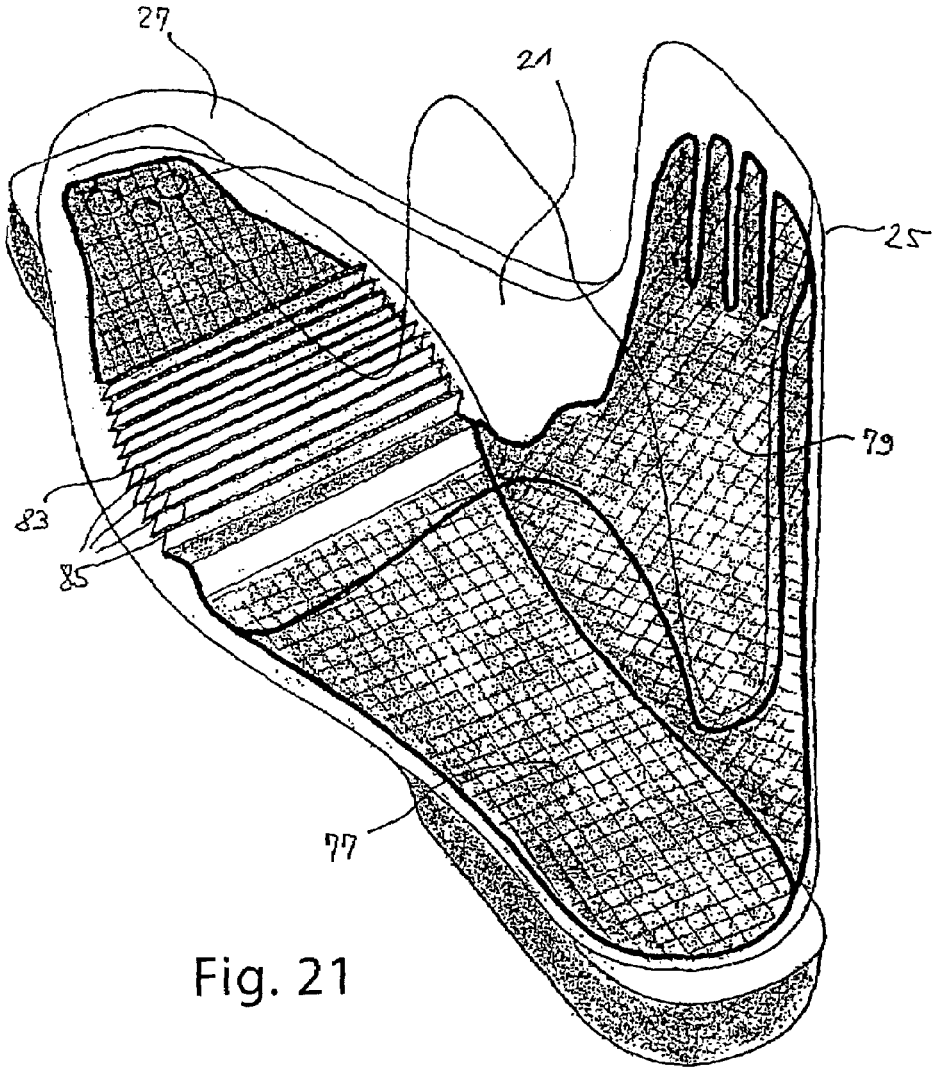

In order to control the flex and torsion characteristics of the inventive ski boot, the outer boot shell may comprise an essentially rigid reinforced inner shell frame 77 (FIGS. 19 to 21). The inner shell frame 77 is made of reinforced injection molded plastics or composite plastics and preferably from one piece. Preferably the frame is engineered such that it can control downward flex and torsion, and block upward flex of the sole. On the inner side the shell frame 77 has an upward extending ankle spoiler 79 in order to provide an optimum hold for the ankle, and to control both bending and torsional resistance between the horizontal plane of the sole and the medial side vertical plane of the shell shaft. The inner shell frame wraps around behind the heel and along side the lateral ankle to form a strong and stable heel counter to support the integrity of the sole and medial shaft relationship. In the forefoot region the frame 77 has a concave shape 81 and vertical extending side walls 83*a*, 83*b* that allows bending downward and blocks bending upward. The inner frame 77 is fixed to or embedded within the surrounding outer boot shell plastics. The frame 77 embedded into the boot shell plastics allows controlled dynamic response qualities in downward flex and torsion, and connects the sole directly to the heel counter and medial aspect of the shell to eliminate unwanted distortion during the steering and edging of the skis.

FIG. 21 shows a further embodiment of the imbedded inner shell frame 77 where corrugations 85 are used to allow controlled forefoot bending in the desired axis, while eliminating any sole torsion tendencies.

Figure 22:
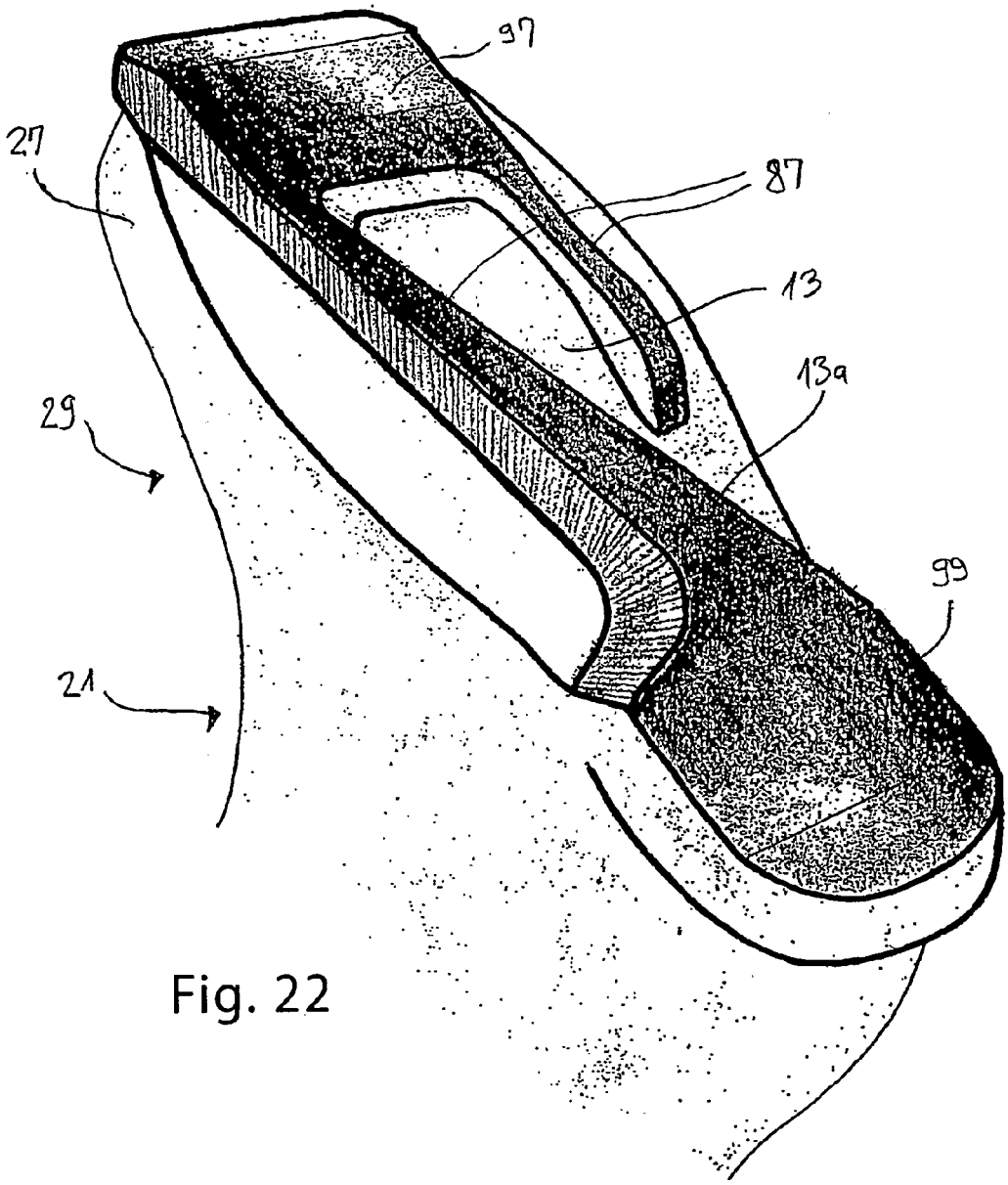
Figure 23:
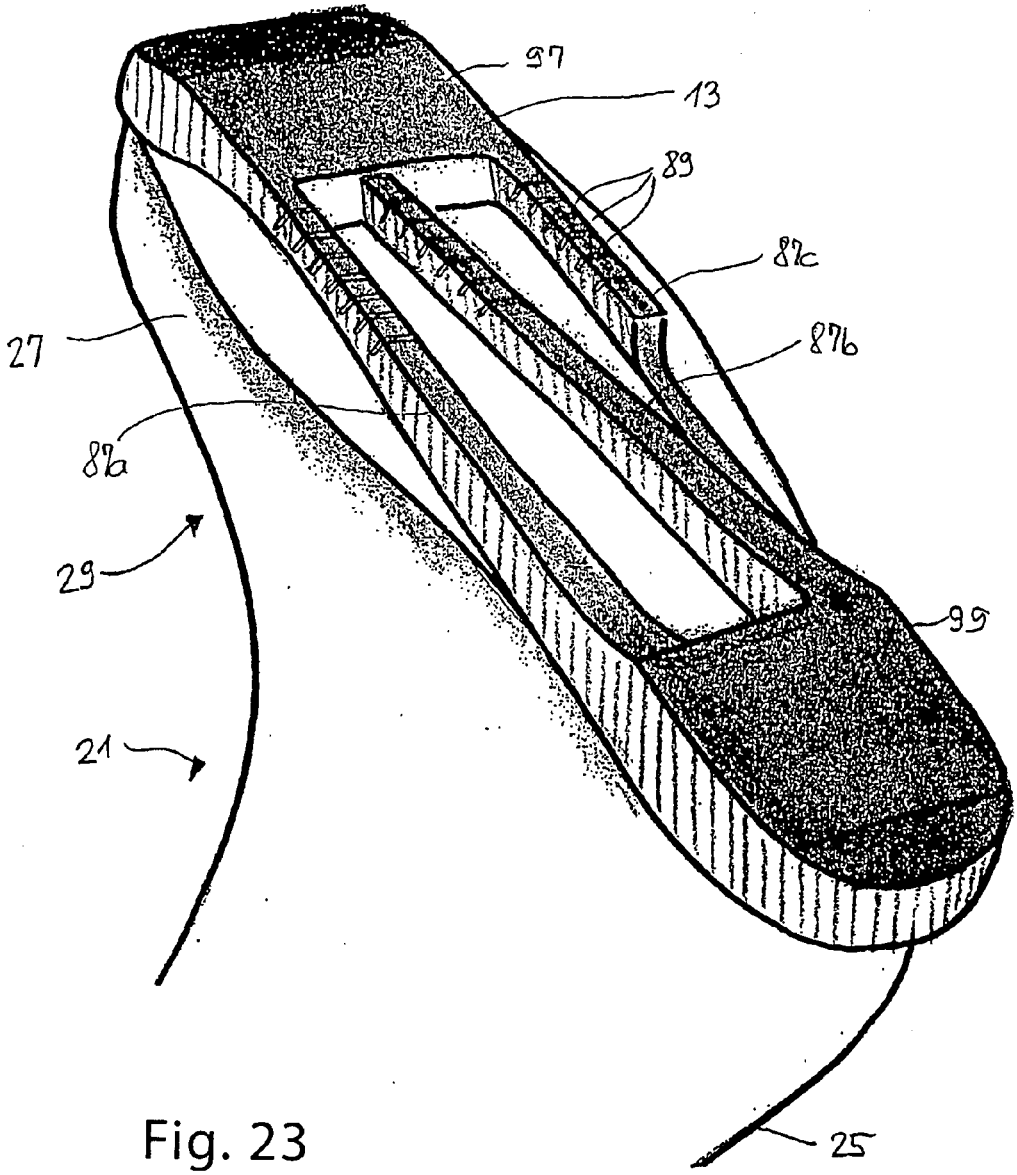

In order to achieve the desired boot sole characteristics reinforcing beams can be provided within or on the outside of the shell sole (FIG. 22). In this case a transverse beam 87 runs the entire length between the toe and heel areas of the ISO 5380 boot sole norm, from the medial aspect of the toe plate 97 to the lateral aspect of the heel plate 99 to reinforce against the sole's tendency to twist and torque with steering and edging motions of the foot and the leg usually directed at the ski's inside edges.

Another embodiment of a boot sole uses 3 reinforcing beams 87*a*, 87*b*, 87*c* and siping cuts 89 in the beams 87 to allow downward bending at specific points in the beams, while restricting upward bending when the siping cuts are squeezed together. The beam 87*a* extends parallel to the longitudinal boot axis on the inner (medial) side of the boot sole 13. The second beam 87*b* extends from the outer side of the heel walking plate at an angle to attach to the center of the longitudinal boot axis to the toe walking plate 97. The beam 87*c* extends a distance from the toe walking plate 97 backwards under the midfoot region. The asymmetric beam arrangement controls the sole torsion of the rear boot portion relative to the front boot portion when twisting and edging motions are applied to the sole, and blocks twisting internally to allow more stability and control of the skis, and to allow more pressure to be applied onto the skis inside edges.

Figure 24:
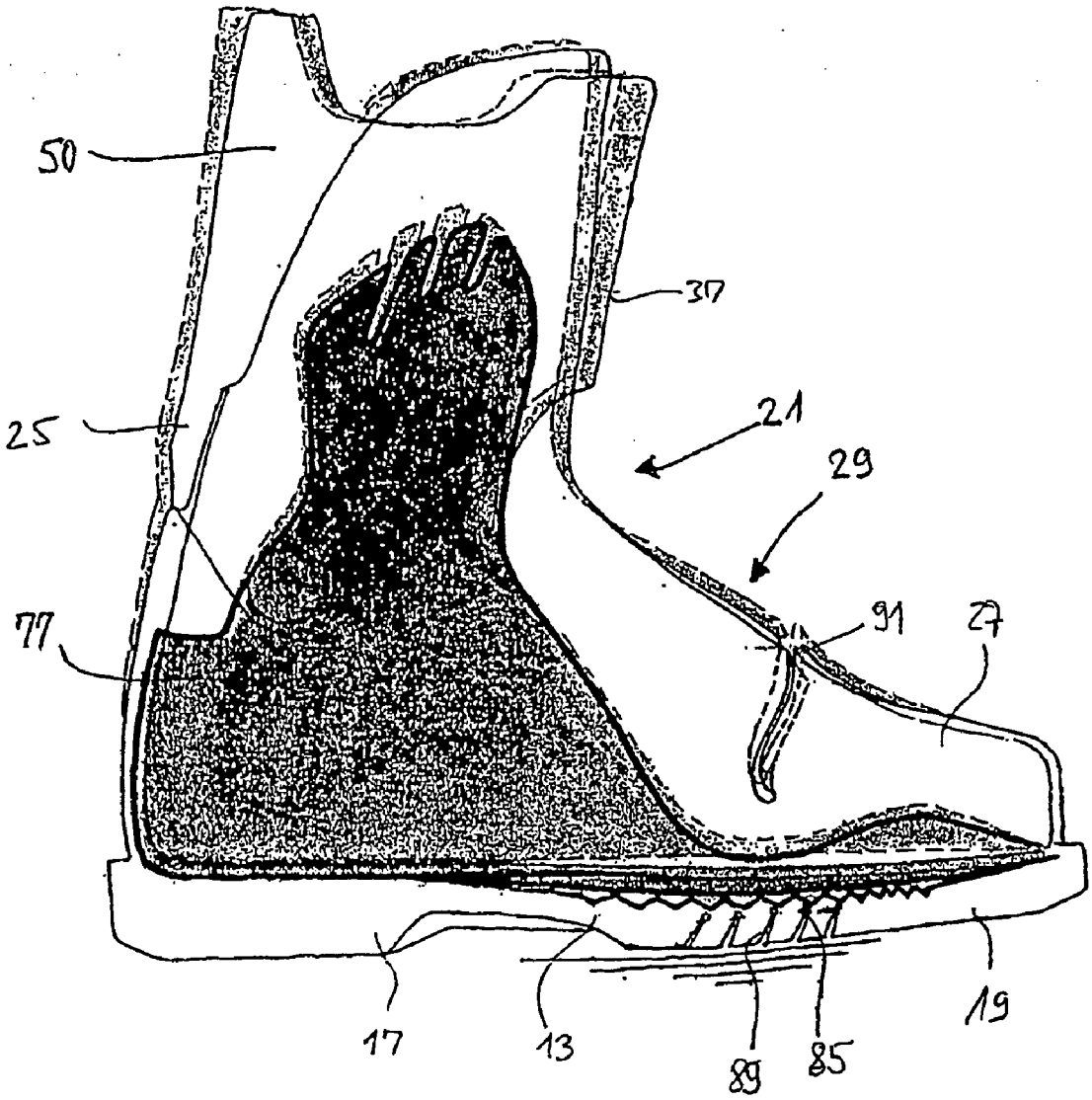

FIG. 24 shows an embodiment of the ski boot comprising an inner shell frame as illustrated in FIG. 19 and siping cuts in the sole beams 87. The inner shell frame 77 extends around the heel counter and the shell shaft. The opening 31 above the elastic zone in the form of a transverse flex cut 91 or slit permits the upper shell to close as the sole 13 bends. The depth of the flex cut 91 also determines the sole's flexibility combined with the shell's plastic thicknesses, resistance to elongation and the imbedded inner frame when used. The closer the flex cut 91 comes to the sole 13 the more bending is possible. The dotted lines show the initial position of the boot and the solid lines show the range of flexing action of the boot in action, where the forward motion of the cuff 37 causes the bending of the sole 13 through a force triangle.

Figure 25:
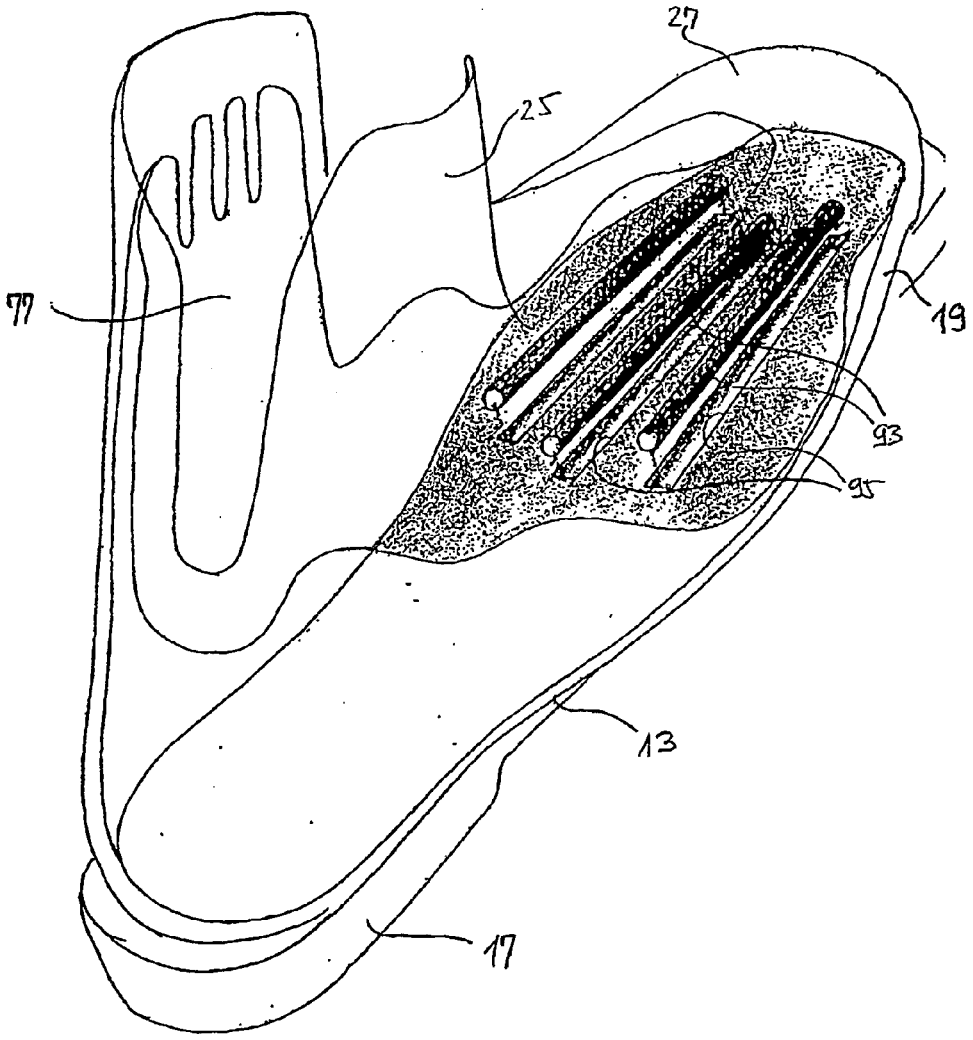

FIG. 25 shows another means of adjusting the sole bending and dynamic response qualities: In this case rigid composite or metal rods 93 are inserted into premolded slots 95 within the imbedded reinforcement and shell plastics. The rods 93 block the tendency for the sole to flex downward and their predetermined physical properties also adjust the dynamic response qualities.

Figure 26:
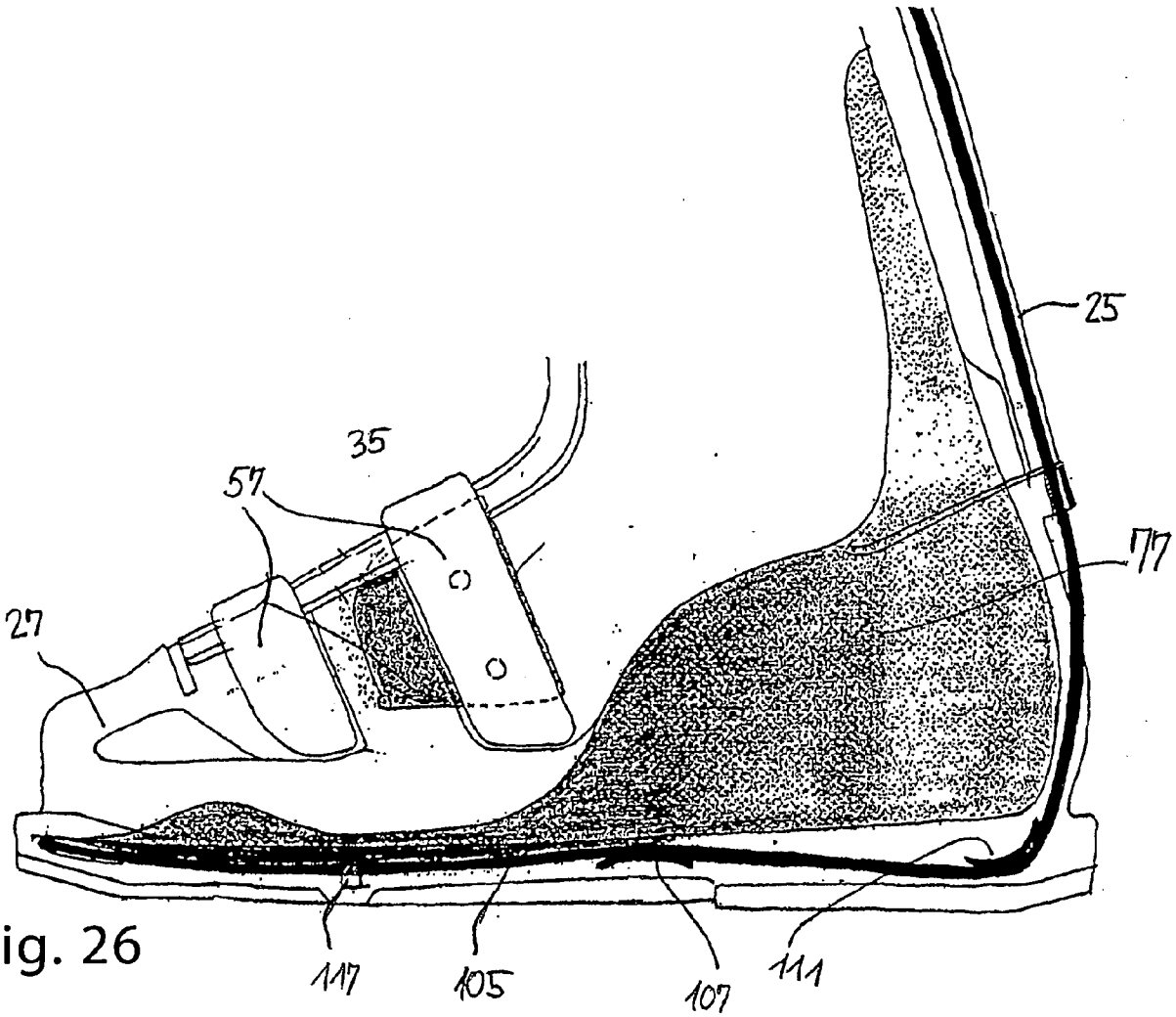
Figures 27, 28, 29:
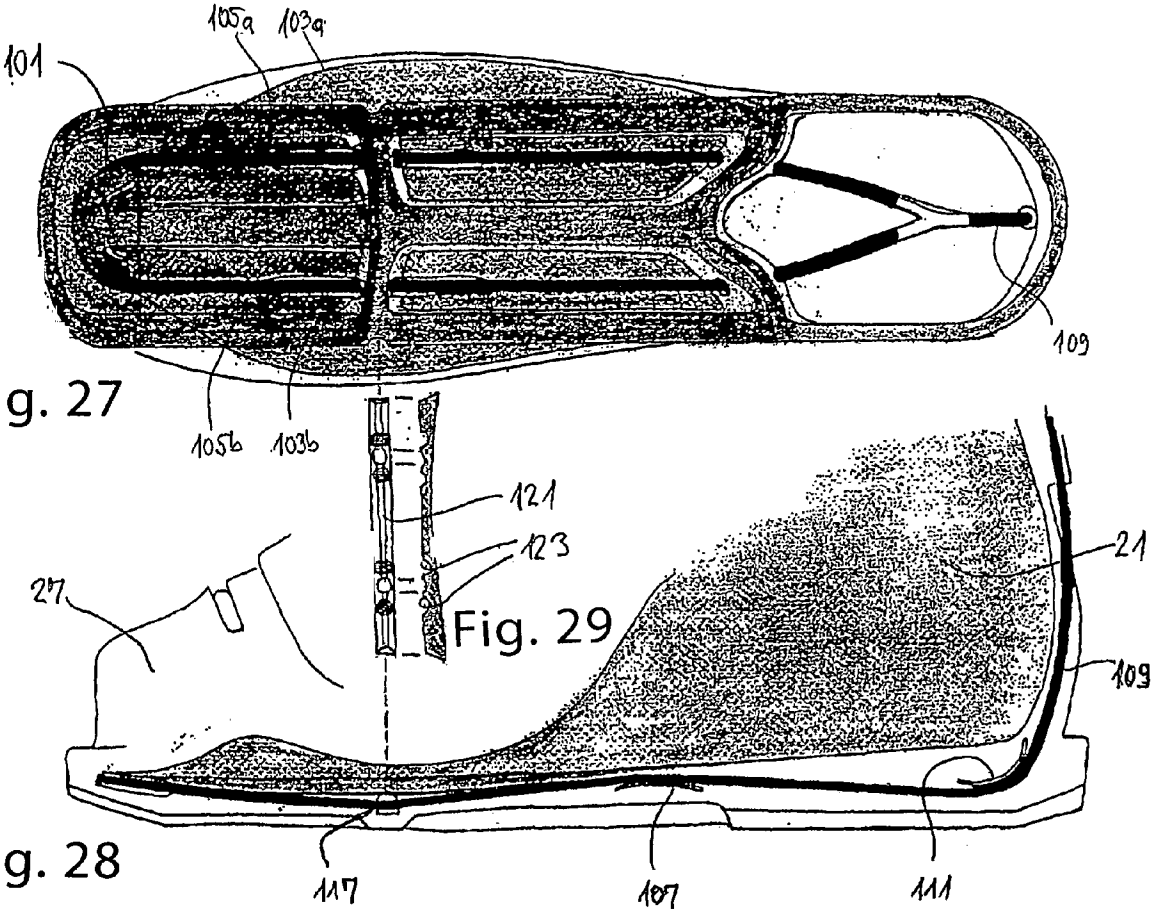

In FIGS. 26 to 28 a cable assembly, protected within the reinforcing beams 87 of the sole 13 and covered with the toe and heel walling plates 97, 99, is looped around a molded mushroom 101 or stop under the toes and curves through guiding grooves 103*a*,103*b* within the convex external aspect of the imbedded reinforcement. Two cables 105*a*, 105*b* are stabilized through tension guides 107 under the midfoot and the heel, and continue separately or are joined into one cable 109 to pull vertically through another cable tension bridge 111 at the back of the shell. These tension bridges 107, 111 work like the string bridges on a violin. The cable ends loop around another molded mushroom 113 inside the top of the spoiler, or through a buckle or spool adjustment mechanism 115 on the back of the shell. Then, when the lower leg flexes and pulls the spoiler forwards, the cable 109 is pulled and tensioned tighter against the convex surface of the imbedded reinforcement under the forefoot and proportionately increases the stiffness and dynamic response of the sole while the spoiler also restrains the forward motion of the lower leg.

Figure 30:
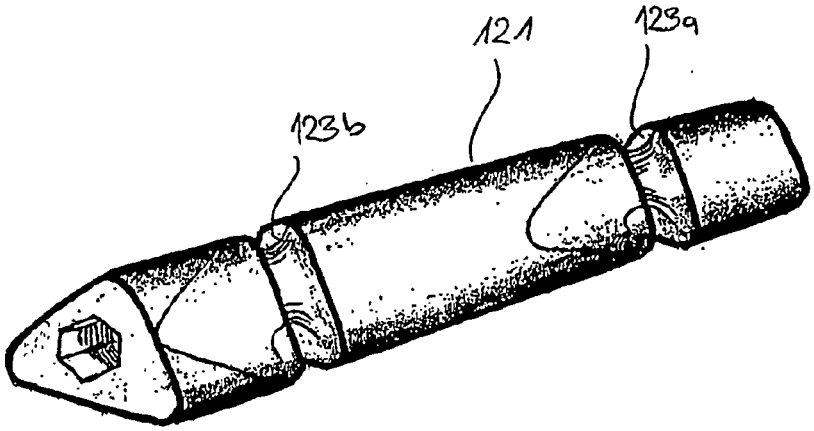
Figure 31:
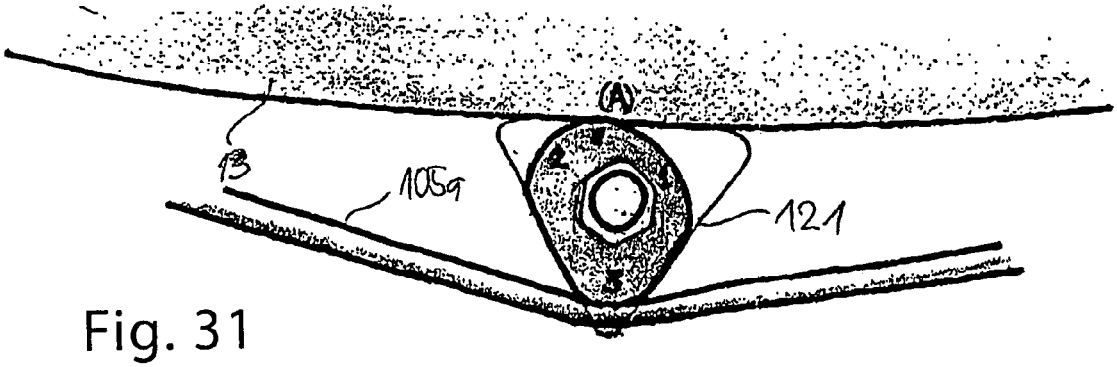
Figure 32:
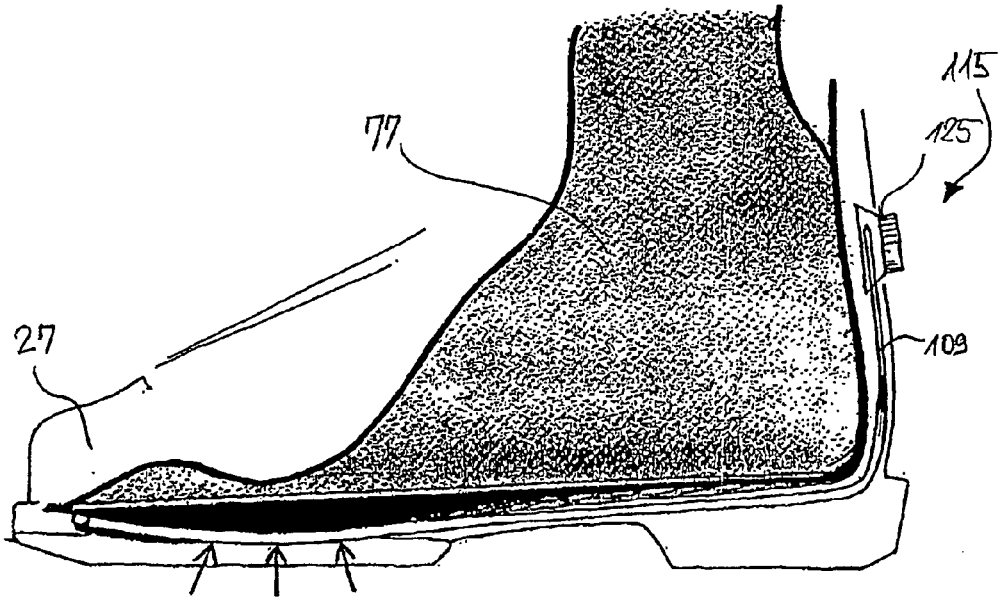
Figure 33:
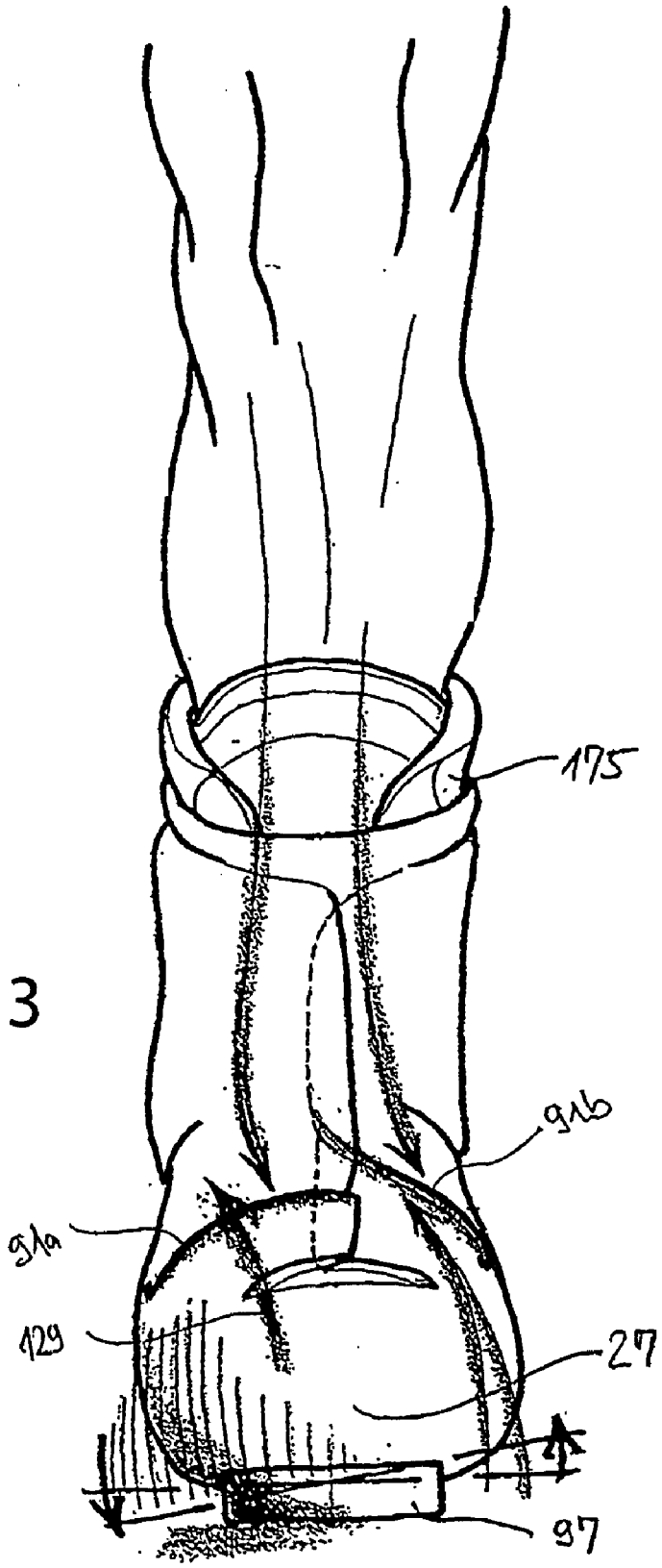
Figure 34:
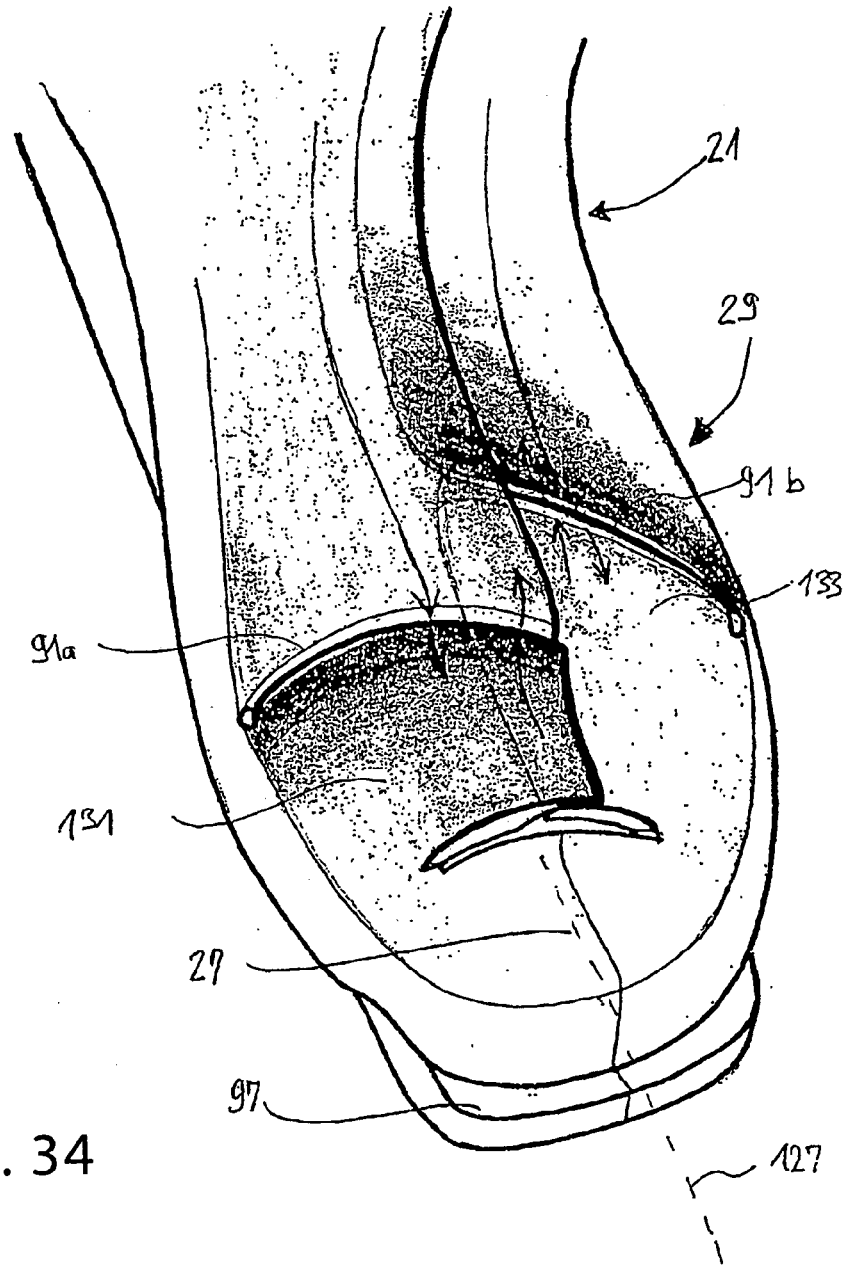
Figure 35:
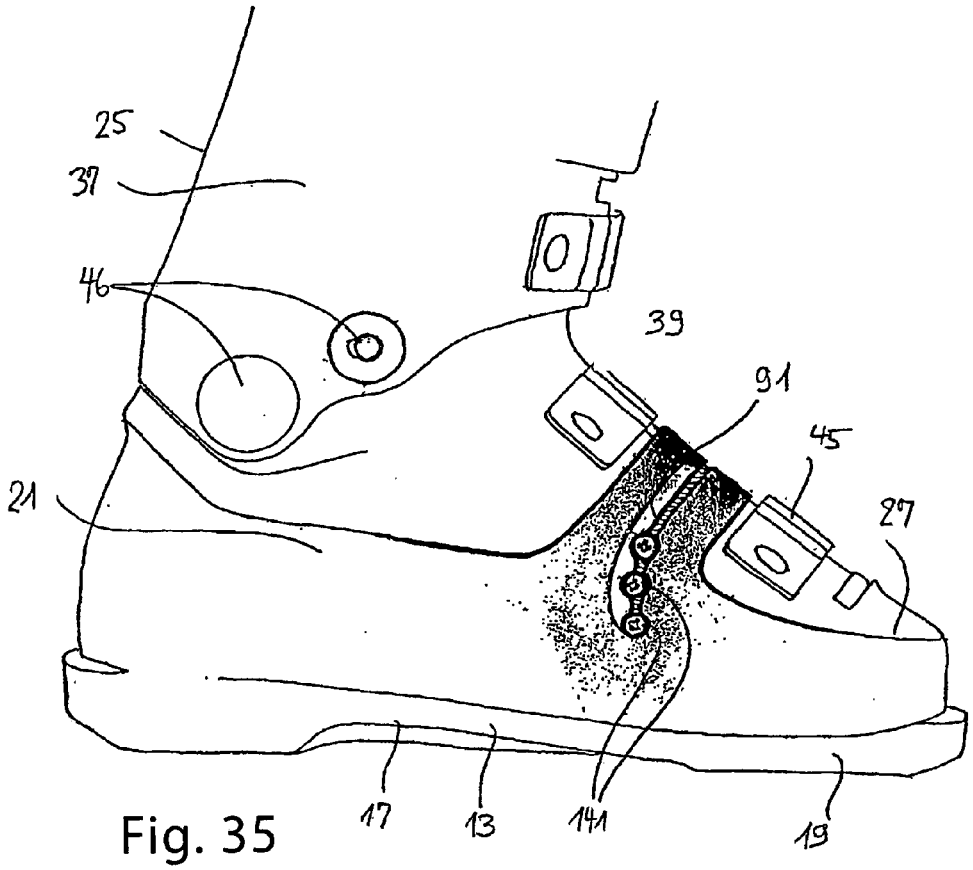
Figure 36:
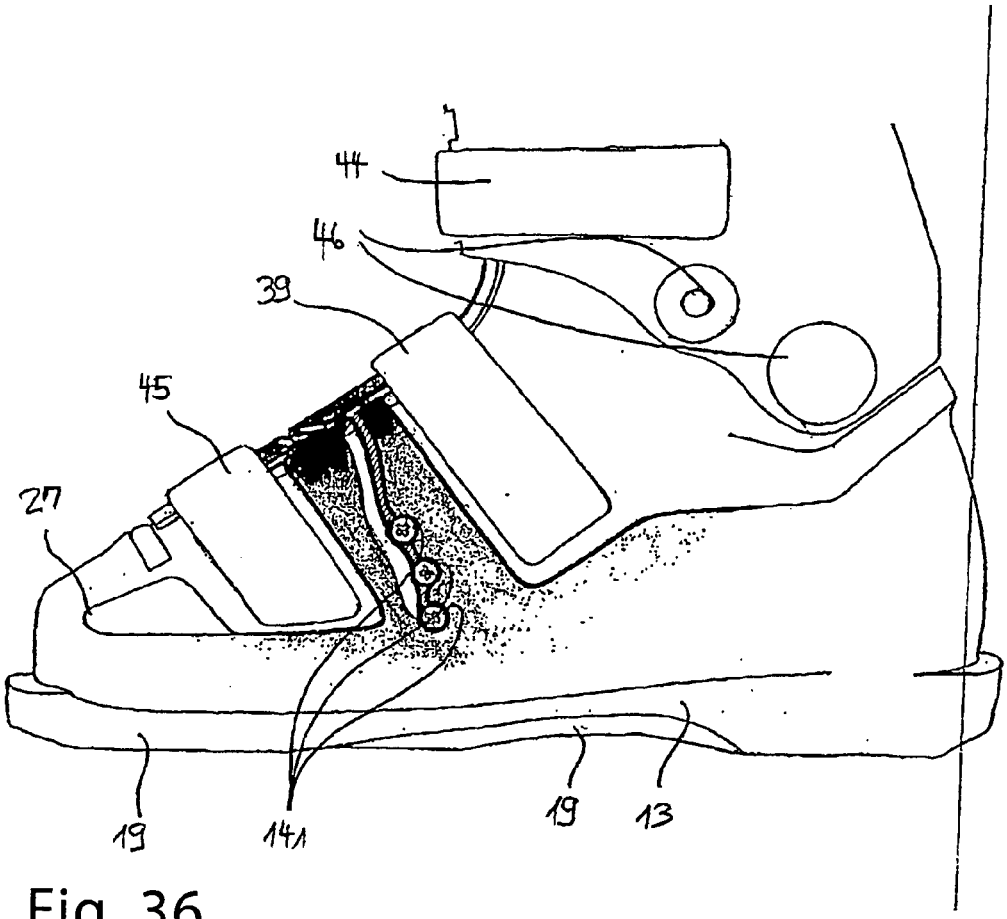

The tension bridge 107 can be engineered as a cam rod 121 with a triangular cross-section providing three tensioning positions (FIGS. 29 and 30). The cam rod 121 has two grooves 123*a*, 123*b* arranged at a distance from each other. The grooves 123*a*, 123*b* are guides for the cables 125*a*, 125*b* and have different depths so that depending on the flat side on which the cam rod rests selected tensions can be applied to the cable assembly. The rod 121 can be rotated into one of three positions to apply different tensions to the cables 105*a*, 105*b* and 109, respectively. The cables 105*a*, 105*b* and 109 control the concave frame ability to bend and alters the spring rate and dynamic response. The tension of the cables 105*a*, 105*b* and 109 can be released by an adjustable buckle or micro adjustment spool 125 (FIG. 32).

Increased cable tension against the convex surface of the imbedded reinforcement frame, adjusts and increases the resistance of the sole 13 to bend—as well as—how far the sole can displace downwards and the sole's dynamic response, rebound or spring rate. This enables the skier to adjust the sole 13 according to weight, ability and energy level and the dynamic response performance of the skis.

The tension adjustment bridge can be inserted into a channel 117 through the side of the sole. This allows the cable to be positioned on one of several grooves of various depths to progressively increase the cable tension and thereby control the dynamic response of the sole flex.

Drawing 26 also shows a preferred system for sealing out snow and water from the flex slot between the buckles on the four buckle boot model. The material used is impermeable to snow and water, affected little by changing temperatures, and it is soft and flexes easily.

There may be more than one flex cut 91 in the instep portion of the outer boot shell. The embodiment of a boot shown in FIGS. 28 and 29 has two flex cuts 91*a* and 91*b* arranged at a distance from each other in the instep of the outer boot shell. The flex cuts 91*a* and 91*b* extend at an angle with respect to the longitudinal boot axis 127. The flex cuts are angled in the same direction so that when flexing begins they deflect the rear shell portion in the same direction. As the lower leg moves forwards the axis of the upper rear part of the outer shell is deflected laterally with respect to the front part of the shell. This causes the front part to effectively increase angulation and will torque the sole medially over the ski's inside edges. This can be a preferred performance quality for advanced and expert skiers to facilitate increasing edging pressure and ski control at high speeds and in complex snow and terrain situations when it is otherwise strenuous and difficult to edge and manage the skis.

As can be seen in more detail in FIG. 29 the medial cut 91*a* of the rear shell deflects under the front shell flap 131, and the lateral cut 91*b* of the rear shell deflects over the front shell flap 133, causing the front part of the shell to deflect downward toward the inside medial edge of the sole and ski edges.

Determining the length or depths of the flex cut depends on the collective response of the shell plastic and inner frame reinforcements to the designer's desired sole flexing behavior. Generally, the longer or deeper the flex slot cut into the shell the softer and deeper the sole flex will become. Consequently, the sole flex can be adjusted by shortening the effective length of the flex slot. The shorter the length of the flex slot the "stiffer" the sole flex becomes.

Figure 37:
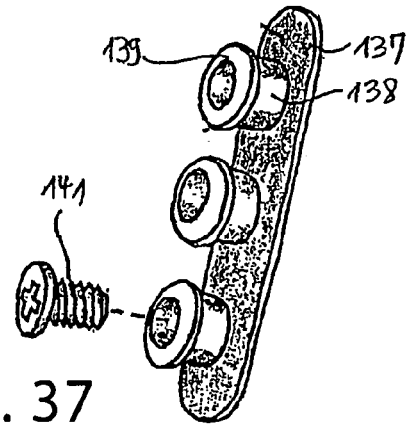
Figure 38A:
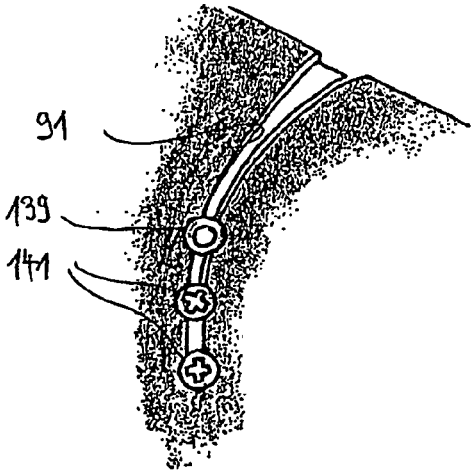
Figure 38B:
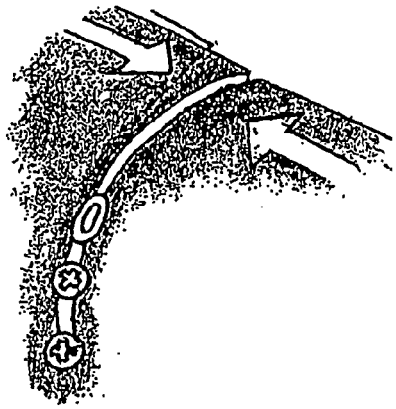
Figure 39:
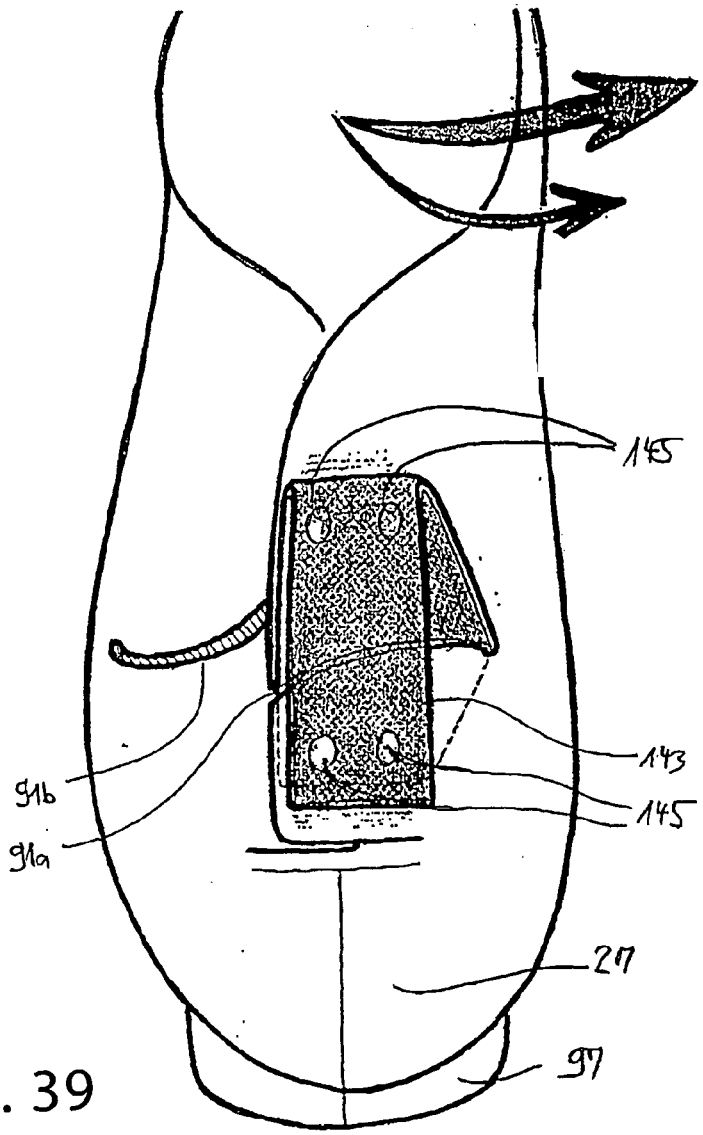

Flex cut adjustment or blocking means, e.g. plugs, bolts or other inserts, can be provided for adjusting or limiting the maximum relative flexing of front and rear boot portions. According to a preferred embodiment the flex cut adjustment means comprises a longitudinal retaining plate 137 with a plurality of upwards extending plugs 138 with external retaining brims 139 arranged at a distance from each other (FIG. 37). The plugs 138 can receive a screw 141, which, when inserted, blocks and limits the forward motion of the rear shell portion. The retaining plate 137 can be inserted and screwed into position as shown in FIGS. 35 to 38. The plugs 138 are seated into the flex cut 91 and cooperate with the adjacent edges of front and rear shell portions. It is understood that the retaining plate is preferably a premolded rubber like insert made e.g. from rubber or another elastomer unaffected by temperature changes. The stiffest position is attained with all three positions blocked. With one, two or all three positions relieved the flex slot becomes relieved and progressively softer. When the flex cut closes the empty rubber plugs 138 are compressed easily (FIG. 38*b*). By adding screws 141 in the two lower plugs, the plugs can no longer compress and thereby reduce the effective length of the flex cut 91 and stiffen the sole flex. The skier can adjust the medial and lateral bending resistance separately.

In order to prevent opening of the flex cuts 91, e.g. when the skier is leaning backwards, the front and rear shell portions may be interconnected by non-stretchable connecting means 143, e.g. a strap, reinforced webbing or the like. By this means the most desirable edging and rotational supportive qualities of a normal ski boot are preserved, while the flex slot can close and reduce as desired. The connecting means 143 in the form of a reinforced webbing is attached to the upper front and rear shell portion by rivets or bolts 145.

Figure 40:
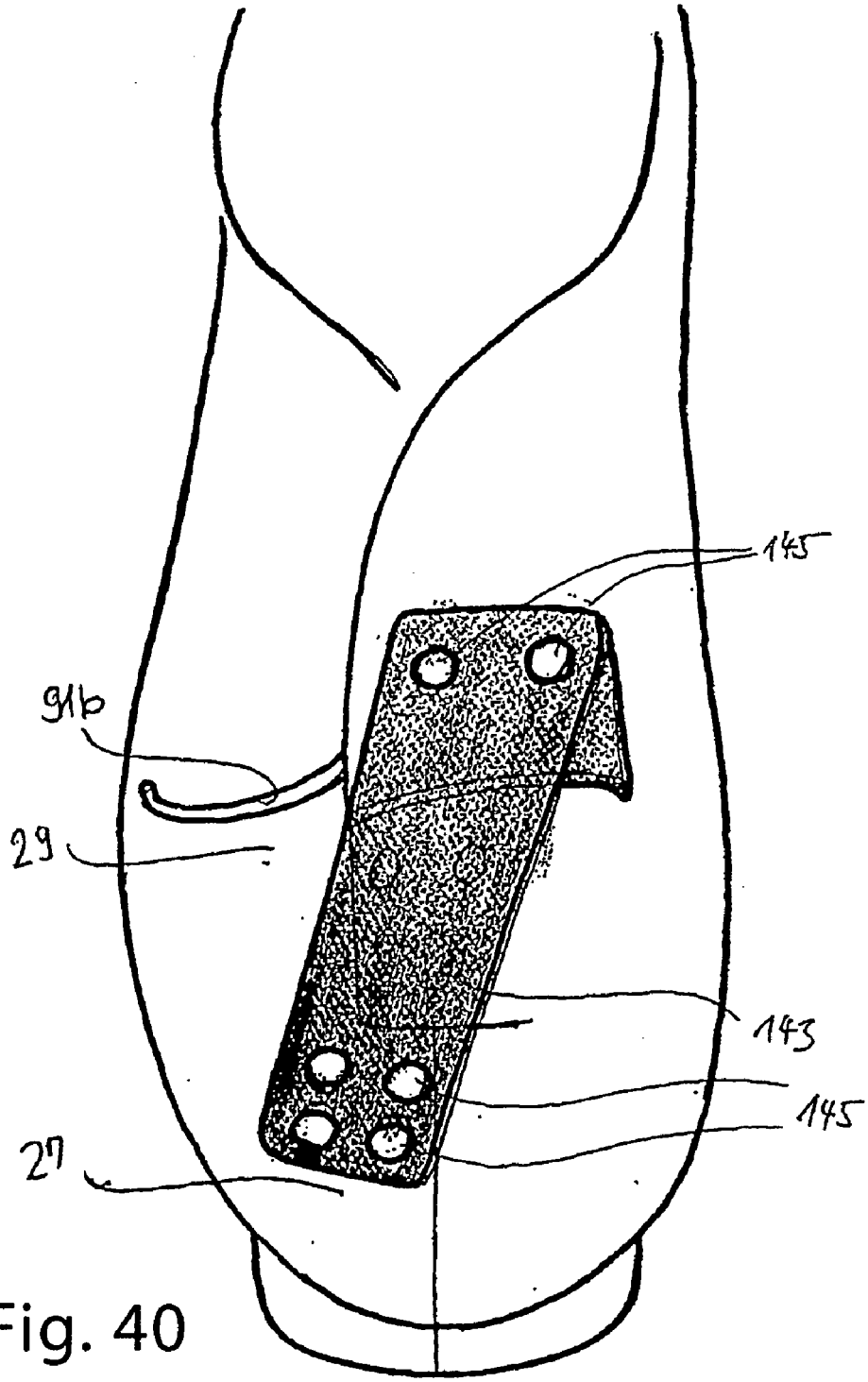

When the medial aspect of the rear shell is connected to the toes of the lateral aspect of the shell by a transverse bridge 143 of reinforced webbing, the opening of the flex cut can be more effectively controlled (FIG. 40). Thereby the webbing strap is anchored in line with the shell deforming torsional forces that result from edging.

Figure 41:
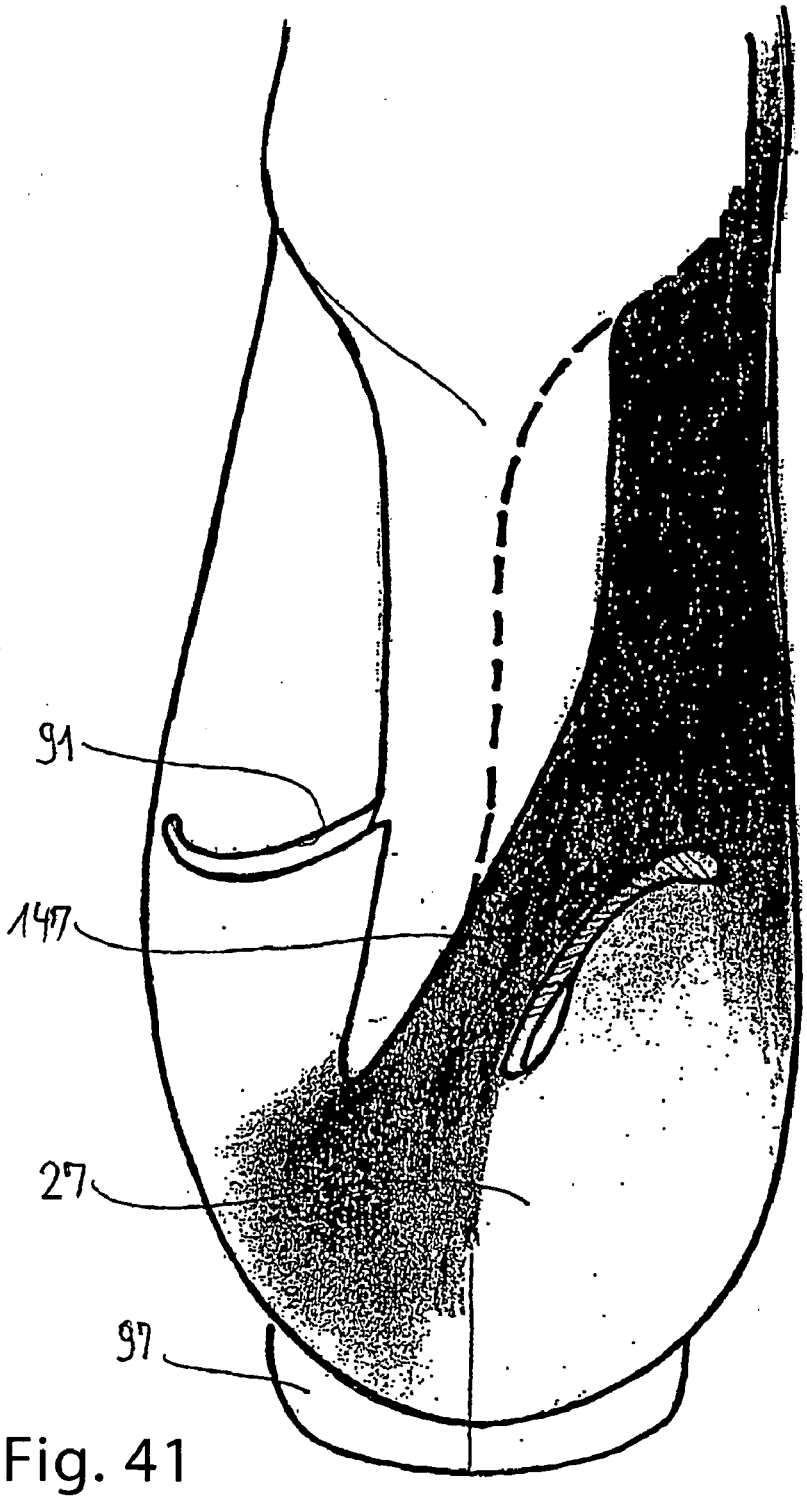
Figure 42:
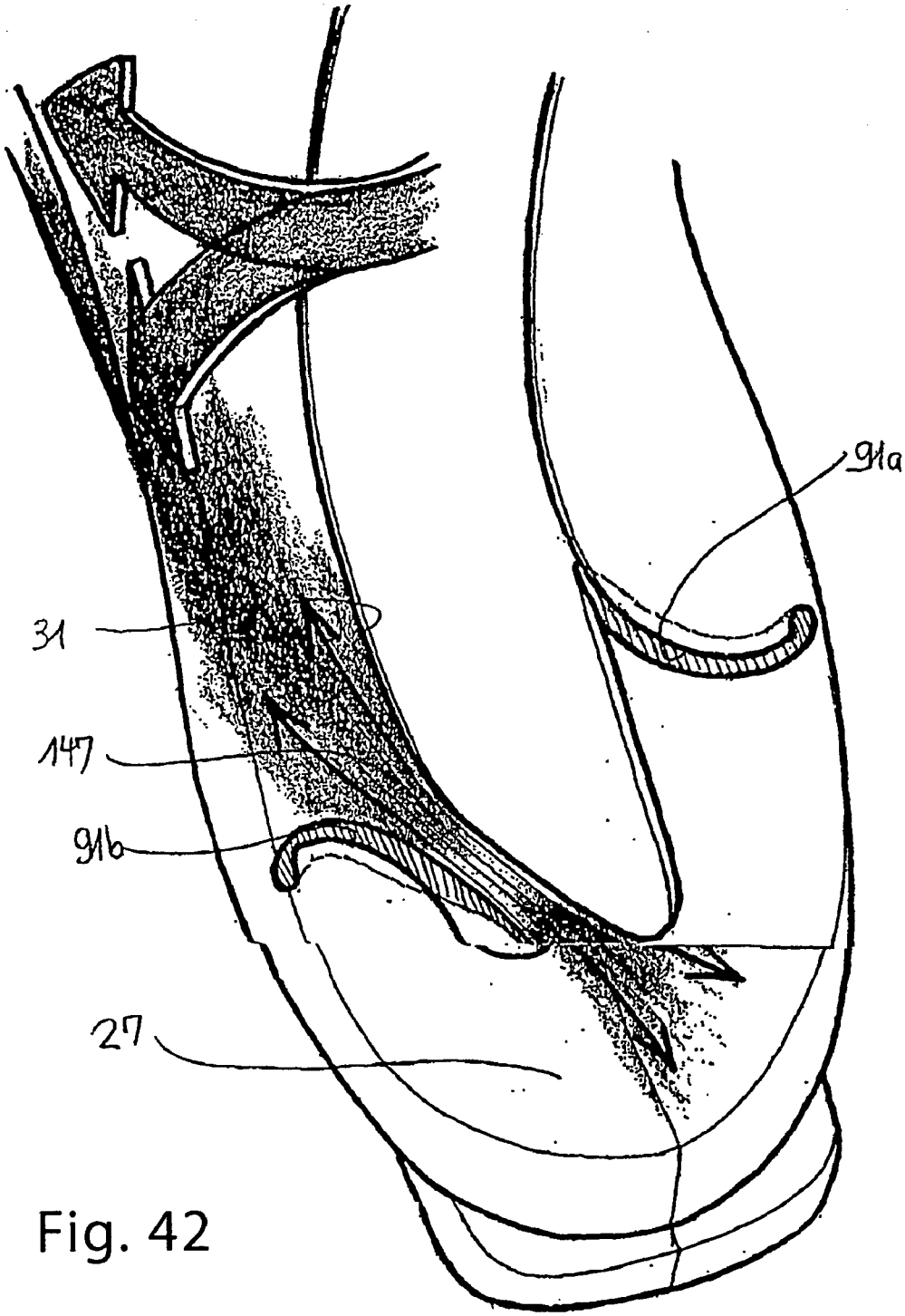
FIG. 42 shows how the rotational and opening forces are limited by the transverse bridge.
Figure 43:
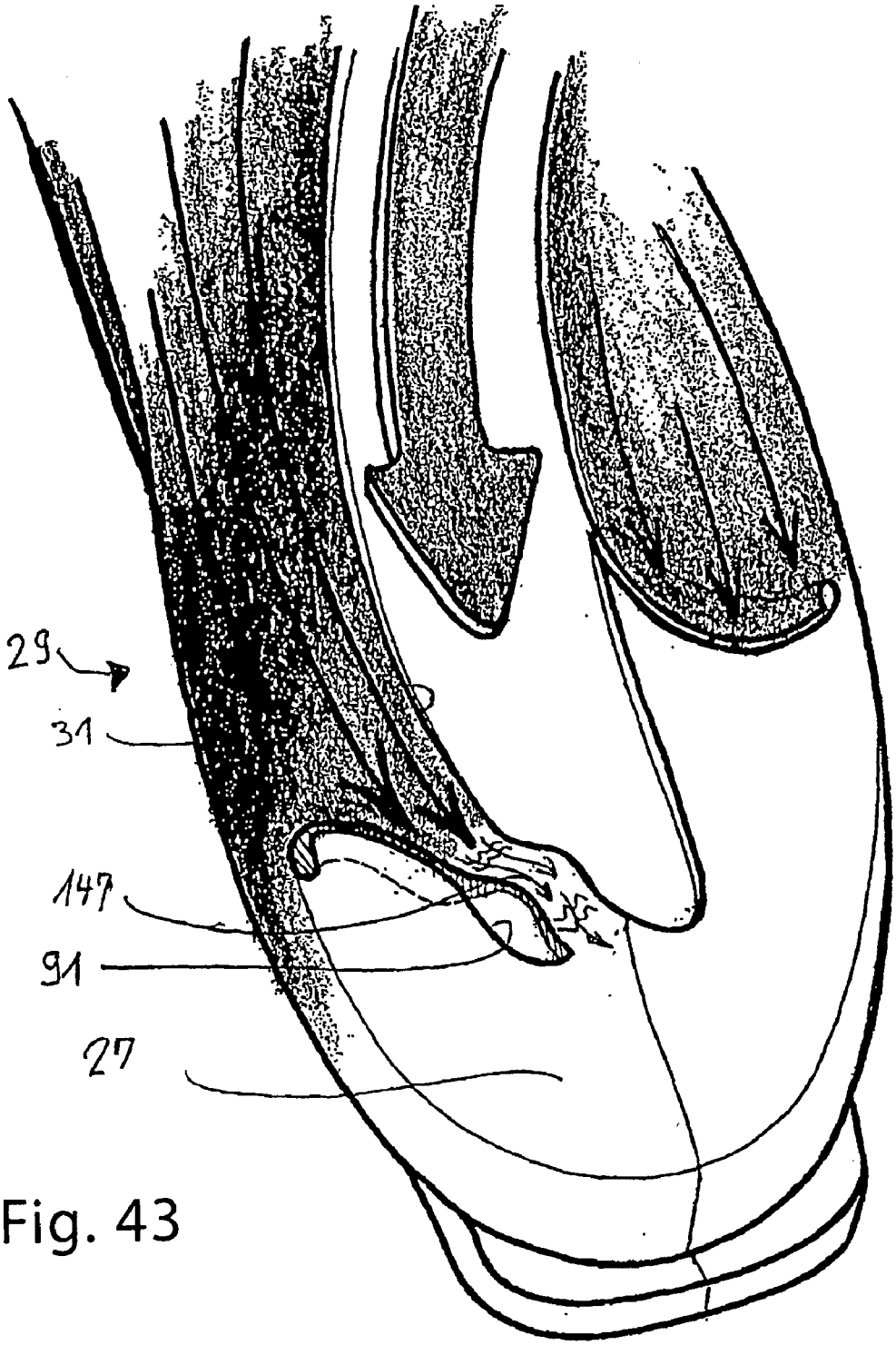
FIG. 43 shows the outer boot shell when forward flexing forces are applied.

FIGS. 41 to 43 show an embodiment of an outer boot shell comprising an integrated bridge 147 molded into the shell for blocking the flex cuts from opening when opening forces are applied. The transverse bridge 147 is designed soft and flexible enough so that it can bend easily without interfering with the sole's bending qualities (FIG. 43), but can effectively block any further opening of the flex cuts 91 when the skier leans backwards.

The embodiment illustrated in FIGS. 44 and 45 are characterized by a reinforced webbing 151 which is attached with rivets 152 to the boot shell. The webbing 151 extends approximately parallel to the forward flex cut 91*a* connecting the toe cap with the rear shell portion. Creases 153 provided in the webbing 151 for favoring a folding of the webbing 151 when front and rear shell portions are bent relative to each other.

Common to all embodiments is that the webbing 151 or connecting means bridge the shell gap or flex cuts above the sole bending area. The webbing 151 may be riveted into position and even secured by buckle base plates 155 as shown in FIG. 46. The webbing bends easily to allow for the closing of the shell upper gap or cut 91 but blocks any tendency for the gap to open, either by backward pressure on the spoiler or driving against the shell's torsional resistance to steering and edging forces.

The embodiments of FIGS. 47 to 53 have a torsion box 157 built into the imbedded reinforcement frame with a bubble relief 156 on the superior (proximal) surface of the sole. This allows for a pre-stressed and dynamic bending surface to be created respective to the less bendable lower (distal) surface.

FIGS. 52 and 53 show a cross section of the shell and the torsion box 157 with a flexible superior surface and a fully reinforced inflexible distal surface that cannot be flexed. This means that only the upper opening or slot system and the internal parts of the shell will bend and deform dynamically as needed while the external aspect of the shell sole will not bend or deform at all. This can be important in consideration of the mechanical relationship to some binding functions and the demands of skiers in extreme skiing situations where the forces are very high and the sole bending and rebound qualities must be controlled and finite.

The ski, ski binding and ski boot system shown in FIGS. 54 and 55 comprises a leaf-spring type suspension element 164 mounted under the boot sole 13 on the ski surface. Reference numeral designates the ski. The suspension element 164 extends through binding spacers 160 under the rear and front bindings 158,159. A mounting and adjustment plate 165 provided at the ends of the suspension element 164 facilitates the attachment thereof to the ski surface. The suspension element 164 may additionally be in contact with an elastic or spring-based suspension element 161 mounted under the elastic zone 15. The elastic or spring-based suspension element 161 may comprise a tension adjustment element 162. On the upper surface of the leaf-spring type suspension element 164 may have a mounting and adjustment plate which is in contact with the boot sole 13 when the boot is mounted in the binding.

FIG. 56 shows an embodiment of an inner boot 49 for use with an inventive ski boot. The inner boot 49 or liner is constructed with select reinforcement materials 169, that are laminated to the outside of the liner or under liner's outer skin materials, or in a combination of both, to create a gentle transition and lamination that complements the hard shell plastic and the supportive padding systems that serve to protect and insulate the foot and lower leg. The reinforcements 169 can be flexible and thermally moldable, designed and assembled asymmetrically according to the asymmetrical and biomechanical supportive needs of the foot and lower leg, so that they combine to create a combined lamination with the shell plastics to create a sandwich structure stiffening effect. This means that thinner and lighter outer shell plastics can be used, which are also more adaptable and flexible, so that they are more readily bent and layered in combination with the outer shell plastic and uniting to create an effective and adaptable lamination of stiffening and supportive materials. In addition the more flexible shell and liner materials also make the boot considerably more user friendly and comfortable, being also easier to put on the foot, to adjust the closures and then to take the boot off. The inner boot 49 has a tongue 171 with optional reinforcements 173. A short distance from the top of the inner boot shaft 175 a strap 177 is provided. The strap 177 is preferably a Velcro-strap which can also be used as first lower leg fixing and attaching means when it is fastened to the rear spoiler shaft 25 of the outer boot. The end of the strap 177 is held by strap guides 179.

11 ski boot
13 sole
15 elastic zone
17 rear sole portion
19 front sole portion
21 rear shell portion 21
23 heel portion
25 shaft
26 arrow indicating resulting vertical force component
27 front shell portion
29 intermediate shell portion (or instep portion)
31 opening
33 edges 33 of the opening 31
34 transverse axis in the metatarsal region
35 elastic (rubber) cover covering opening
36 rivets for fastening elastic rubber
37 cuff
38 buckle base plates
39 ankle fixing and attaching means (ankle strap)
40,42 medial and lateral rear side shell portions
41 first lower leg or shaft fastening and attaching means (first or top power strap)
43 second lower leg or shaft fastening and attaching means (2nd power strap)
44 third lower leg or shaft fastening and attaching means ($3^{rd}$ power strap)
45 foot strap
46 rivets for fixing cuff
47 open shell of $4^{th}$ embodiment
49 inner boot
50 spoiler of the outer boot shaft
51 shaft rim
53 buckle
55 ratchet buckle
57 Velcro fastening means
59 cavity
61 plastics plates
63 reinforcement body

65 leaf spring
67 concave surface
69 bolt
71 screw
73 snap-on system
75*a*, 75*b* notch
77 inner shell frame
79 ankle spoiler
81 internal concave shape of the sole in the forefoot region
83*a*,83*b* side walls
85 corrugations
87 beam
89 siping cut
91 flex cut (transverse slit in the outer boot shell above the elastic zone)
93 metal or composite rod
95 premolded slots
97 toe walking plates
99 heel walking plates
101 molded mushroom
103*a*,103*b* guiding grooves
105*a*,105*b* cables
107 tension guides
109 cable
111 cable tension bridge
113 another molded mushroom at the top of the spoiler
115 spool adjustment mechanism
117 channel for cam rod
121 cam rod
123*a*,123*b* grooves of the cam rod
125 buckle for tensioning the cables 105*a*,105*b* and 109
127 longitudinal boot axis
129 arrow indicating lateral deflection of the rear boot portion
131 front shell flap
133 rear shell flap
137 retaining plate
138 from the retaining plate upwards extending plug
139 external retaining brim of retaining plate
141 screw for plug 137
143 connecting means for connecting front and rear shell portions
145 rivets or bolts for connecting webbing to front and rear shell portions
147 integrated bridge moulded into the shell plastics
151 webbing
152 rivets for fastening webbing
153 creases
155 buckle base plate
156 bubble relief
157 torsion box system
158 rear binding
159 front binding
160 binding spacers
161 elastic or spring based suspension element
162 tension adjustment element for elastic or spring based suspension element
163 leaf-spring type suspension element
164 suspension element and boot sole pressure dispersion plate
165 leaf-spring mounting and adjustment plate
169 reinforcement materials and sections, respectively
171 tongue
173 reinforcements on tongue
175 inner boot shaft
177 strap
179 strap guides

The invention claimed is:

1. A ski boot comprising:

an essentially stiff outer boot and a soft inner boot or inner lining for receiving the foot of a skier, the outer boot including a sole, a rear shell portion fixed to the sole and configured to receive the rear part of the foot and at least a front shell portion fixed to the sole and configured to receive the front part of the foot, the rear shell portion comprising a heel portion and a shaft extending upwards from the sole and configured to extend alongside and at least behind the lower leg shaft of a skier, attaching or fastening means for attaching or fixing the heel and lower leg of a skier received by the inner boot or lining with respect to the outer boot, characterized in that the sole of the outer boot is made of an essentially rigid material, and includes an elastic zone in the metatarsal region of the sole dividing the sole into front and rear sole portions; and an intermediate upper shell portion provided between the front and rear shell portions of the outer boot, such that the front and rear shell portions are bendable with respect to each other;

wherein the heel portion, shaft and rear sole portion are designed to be in an essentially rigid relationship;

wherein the attaching means includes at least an ankle fixing and attaching means for extending around the ankle region and fixing the ankle and heel in the rear heel portion, and at least first lower leg fixing and attaching means for extending around the shinbone or inner boot shaft and attaching the lower leg to the shaft preferably with little or no play, wherein the intermediate shell portion having one or more transverse cuts for causing a torsion of the front and rear boot portions about the longitudinal boot axis when they are bent with respect to each other.

2. A ski boot according to claim 1 wherein on both sides of the outer boot, preferably essentially non-deformable rear side shell portions are provided extending between the heel portion, shaft and the rear sole portion.

3. A ski boot as claimed in claim 2, further comprising a tranverse beam formed in the sole.

4. A ski boot according to claim 1, wherein the heel portion, shaft and rear sole portion of the outer boot are made of essentially non-flexible plastics such that the heel portion, shaft and rear sole portion form a rigid or essentially non-flexible assembly.

5. A ski boot as claimed in claim 4, further comprising a tranverse beam formed in the sole.

6. A ski boot according to claim 1 wherein the elasticity of the elastic zone is such that the bent sole has a tendency to flex back into the neutral plane position.

7. A ski boot as claimed in claim 6, further comprising a tranverse beam formed in the sole.

8. A ski boot according to claim 1 characterized in that the elastic zone allows bending about a transverse axis in the metatarsals.

9. A ski boot as claimed in claim 8, further comprising a tranverse beam formed in the sole.

10. A ski boot according to claim 1 wherein the elastic zone in addition to bending about a transverse axis also allows for a torsion of the rear sole portion with respect to the front sole portion, about the longitudinal boot axis, to the lateral side and limits or blocks to the medial side.

11. A ski boot as claimed in claim 10, further comprising a tranverse beam formed in the sole.

12. A ski boot according to claim 1 further comprising flex cut adjustment or blocking means provided for insertion into the transverse cuts to limit or adjust the medial and lateral bending resistance separately.

13. A ski boot according to claim 12 wherein the flex cut adjustment or blocking means are plugs, bolts or other inserts.

14. A ski boot according to claim 12 further comprising connecting means for interconnecting shell portions located in front and behind the transverse cuts in order to prevent opening of the transverse cuts.

15. A ski boot according to claim 1 wherein the intermediate shell portion extends from the front shell portion or toe cap to the shaft and preferably comprises an opening at least in the metatarsal area.

16. A ski boot according to claim 15 wherein the opening in the outer boot shell extends in the metatarsal area from the instep towards the sole so that flexing of front and rear boot portions relative to each other is possible or alleviated.

17. A ski boot according to claim 15 wherein the opening is covered by an elastic, compressible or foldable cover.

18. A ski boot according to claim 1 wherein the intermediate shell portion comprises two oppositely arranged V-shaped, round, oval or longitudinal cuts or slots in the outer boot shell for allowing bending of the front and rear parts of the ski boot.

19. A ski boot according to claim 18 wherein the cuts extend from the instep in a curve towards the sole.

20. A ski boot according to claim 1 further comprising a rigid leaf type spring embedded in the sole to allow a designated range of bending and dynamic response downward.

21. A ski boot according to claim 1 further comprising a flex and torsion box that is open at both sides of the sole to allow a designated amount of downward and blocked upward bending, with the respective dynamic rebound response of both the top and bottom surfaces.

22. A ski boot according to claim 21 wherein the flex and torsion box connects the top and bottom surfaces of the sole with a vertical reinforcing I-beam membrane so that bending pressures on the top surface are transferred directly to bend the bottom surface to create a more effective bending and torsion box zone.

23. A ski boot according to claim 21 wherein the flex and torsion box comprises a flexible "bubble" on one (superior) surface and the lower (anterior) rigid non flexible surface, so that when the superior surface is flexed enough by direct metatarsal pressure and/or the rear portion of the shell force triangle to make contact with the anterior surface, then any further flexion is restricted and blocked.

24. A ski boot according to claim 23 wherein reinforcement of the flex and torsion box is provided such that the superior surface closest to the metatarsal bones is thinner and flexible, while the distal surface is made completely rigid to resist all bending forces.

25. A ski boot according to claim 1 wherein one or more transverse cuts provide a range of dynamic response qualities.

26. A ski boot according to claim 25 further comprising detachable toe and heel walking sole plates, that can be screwed onto or snap-fitted over respective retainers molded into the shell's sole.

27. A ski boot according to claim 1 wherein the outer boot comprises an inner shell frame extending in or on the sole and also upward to form a part of the heel and ankle shaft to manage medial and lateral flexibility, and torsional rotations of the lower leg.

28. A ski boot according to claim 27 wherein the inner shell frame comprises on the medial side a shaft that extends a distance above the ankles on both sides.

29. A ski boot according to claim 1 wherein the sole, rear and front shell portions are made in one piece.

30. A ski boot according to claim 1 wherein the sole comprises a detachable lower sole.

31. A ski boot according to claim 30 wherein the detachable lower sole is made in at least two separate portions.

32. A ski boot according to claim 30 wherein the detachable sole is attachable to the outer boot by screw and bolt and/or snap-on connections.

33. A ski boot according to claim 1 wherein the inner boot is retractable from the outer boot.

34. A ski boot according to claim 1 wherein the ankle fixing and attaching means extends from the medial (inner) side of the outer boot to the lateral (outer) side and embraces and pulls the ankle of the skier back into the heel portion.

35. A ski boot according to claim 1 wherein the ankle fixing and attaching means are arranged at an angle greater than 120 degrees, preferably at an angle between 130 and 145 degrees with respect to the sole for pulling the ankle of the skier back into the heel portion.

36. A ski boot according to claim 1 wherein the first leg fixing and attaching means are flexible but essentially non-stretchable strap means attached to the spoiler of the shaft.

37. A ski boot according to claim 1 wherein the first leg fixing and attaching means are attached or fixed to the shaft a short distance from the top of the shaft.

38. A ski boot according to claim 1 further comprising a second and third lower leg fastening and attaching means provided at the shaft as part of the outer boot shell plastics.

39. A ski boot according to claim 1 further comprising foot fastening means provided in the metatarsal region of the outer boot.

40. A ski boot according to claim 1 wherein the instep portion of the outer boot under the ankle fixing and attaching means is compressible.

41. A ski according to claim 1 wherein the front sole portion and the shaft are interconnected by at least a cable extending from the boot shaft to the front sole portion.

42. A ski boot according to claim 41 further comprising means for controlling and adjusting the tension of the cable.

43. A system comprising a ski boot according to claim 1, a ski, and a ski binding comprising front and rear binding parts for receiving the front and heel boot portions.

44. A ski boot according to claim 1 arranged such that the rear boot or shell portion is deflected laterally relative to the front boot or shell portion.

45. A ski boot according to claim 1 further comprising flex cut adjustment or blocking means provided for insertion into the transverse cuts to limit or adjust the maximum relative flexing or approaching of front and rear shell portions.

46. A ski boot according to claim 45 wherein the flex cut adjustment or blocking means are plugs, bolts or other inserts.

47. A ski boot according to claim 45 further comprising connecting means for interconnecting shell portions located in front and behind the transverse cuts in order to prevent opening of the transverse cuts.

48. A ski boot as claimed in claim 1, further comprising a tranverse beam formed in the sole.

* * * * *